US011767198B2

(12) United States Patent
Conejo Castaño et al.

(10) Patent No.: US 11,767,198 B2
(45) Date of Patent: Sep. 26, 2023

(54) SLING BARS, METHODS FOR ATTACHING A SUBJECT SLING TO SLING BARS, AND LIFT SYSTEMS USING SLING BARS

(71) Applicant: LIKO RESEARCH & DEVELOPMENT AB, Luleå (SE)

(72) Inventors: Alejandro Noe Conejo Castaño, Batesville, IN (US); Christian H. Reinke, York, SC (US); Todd P. O'Neal, Fairfield, OH (US); Nishita Vanita Shashikant, Batesville, IN (US); Scott M. Corbin, Sunman, IN (US); Katie Osborne, Fairfield, OH (US); James Walke, Batesville, IN (US); Jeffrey Scott Jelinek, Batesville, IN (US); Marcus Linde, Öjebyn (SE)

(73) Assignee: LIKO Research & Development AB, Luleå (SE)

( * ) Notice: Subject to any disclaimer, the term of this patent is extended or adjusted under 35 U.S.C. 154(b) by 134 days.

(21) Appl. No.: 17/222,219

(22) Filed: Apr. 5, 2021

(65) Prior Publication Data

US 2021/0316964 A1 Oct. 14, 2021

Related U.S. Application Data

(60) Provisional application No. 63/058,072, filed on Jul. 29, 2020, provisional application No. 63/006,978, filed on Apr. 8, 2020.

(51) Int. Cl.
*A61G 7/10* (2006.01)
*B66C 1/16* (2006.01)

(52) U.S. Cl.
CPC ..... *B66C 1/16* (2013.01); *A61G 7/1061* (2013.01)

(58) Field of Classification Search
CPC ..... B66C 1/16; B66C 1/36; A61G 7/1015; A61G 1/1051; A61G 1/1076; A61G 1/061; A61G 2203/12
See application file for complete search history.

(56) References Cited

U.S. PATENT DOCUMENTS 283,464 A * 8/1883 Brown et al.
453,877 A * 6/1891 Bonfoey
(Continued)

FOREIGN PATENT DOCUMENTS

AU 2008101113 B4 5/2014
CN 208626072 U 3/2019
(Continued)

OTHER PUBLICATIONS

Amico,"Installation and Operation Instructions Go Lift Patient Lift (400 lbs & 700 lbs)", link: http://www.amico.com/sites/default/files/product/downloads/amo_instal_instr_golift.pdf, Retrieved on Jun. 1, 2020, pp. 1-28.
(Continued)

*Primary Examiner* — Dean J Kramer
(74) *Attorney, Agent, or Firm* — Dinsmore & Shohl LLP

(57) ABSTRACT

Sling bars, lift systems, and methods of attaching a subject sling to a sling bar are disclosed. A sling bar includes a bar extending in a longitudinal direction, a protrusion extending from an upper part of the bar, a sling attachment portion extending to define a receiving aperture, a terminus of the sling attachment portion facing the protrusion, defining an opening into the receiving aperture, the protrusion defining an undercut portion of the receiving aperture, a retention latch pivotally coupled to the protrusion and defining an engagement face that selectively interfaces with a stop surface at the terminus in a closed position to cover the opening, the retention latch being constrained to pivot to an open position whereby the retention latch ceases to interface
(Continued)

with the stop surface at the terminus, and a biasing mechanism coupled to the retention latch to force the retention latch toward the closed position.

19 Claims, 19 Drawing Sheets

(56) References Cited

U.S. PATENT DOCUMENTS

| | | | | |
|---|---|---|---|---|
| 779,972 | A * | 1/1905 | Rowland et al. | |
| 4,554,712 | A * | 11/1985 | Le Beon | B66C 1/36 294/82.19 |
| 5,438,736 | A * | 8/1995 | Terada | F16B 45/02 24/265 H |
| 6,201,195 | B1 | 3/2001 | Carey | |
| 6,523,195 | B1 | 2/2003 | Rodier et al. | |
| 7,654,593 | B2 | 2/2010 | Hjort | |
| 8,844,904 | B2 | 9/2014 | Bogh-Sorensen | |
| 9,084,709 | B2 | 7/2015 | Karlsson et al. | |
| 9,222,498 | B2 | 12/2015 | Faucher et al. | |
| 9,700,474 | B2 | 7/2017 | Karlsson et al. | |
| 9,757,297 | B2 * | 9/2017 | Arespong | A61G 7/1061 |
| 9,808,388 | B2 | 11/2017 | Powell, Sr. | |
| 10,010,468 | B2 | 7/2018 | Duquette et al. | |
| 10,532,914 | B2 | 1/2020 | Autissier et al. | |
| 2010/0043140 | A1 | 2/2010 | Chepurny | |
| 2010/0270252 | A1 | 10/2010 | Chepurny et al. | |
| 2011/0108784 | A1 * | 5/2011 | Bogh-Sorensen | A61G 7/1073 254/133 R |
| 2015/0351985 | A1 * | 12/2015 | Powell, Sr. | A61G 7/1074 5/83.1 |
| 2018/0353358 | A1 | 12/2018 | Lingegård | |
| 2018/0369044 | A1 | 12/2018 | Lyckestig et al. | |
| 2020/0010305 | A1 * | 1/2020 | Newman | A61G 7/1078 |
| 2020/0138657 | A1 | 5/2020 | Chandan et al. | |

FOREIGN PATENT DOCUMENTS

| | | | |
|---|---|---|---|
| DE | 202017005436 | U1 | 11/2017 |
| EP | 0241096 | A3 | 8/1988 |
| EP | 2982359 | A1 | 2/2016 |
| EP | 3510987 | A1 | 7/2019 |
| EP | 3824861 | A1 | 5/2021 |
| JP | 5557047 | B2 | 7/2014 |
| TW | 201714815 | A | 5/2017 |
| WO | 2019213785 | A1 | 11/2019 |

OTHER PUBLICATIONS

"Compatible for phones magnetic stand,Remote Control Holder.For Apple TV Remote Mounting Shelf Magnetic Holder For Apple TV 4", Ali Express, link: https://www.aliexpress.com/i/32950019076.html, Retrieved on Dec. 24, 2019, p. 1-10.

European Extended Search Report for Appl. No. 21166897.5-1113, completed on Nov. 8, 2021, 10 pages.

* cited by examiner

SLING BARS, METHODS FOR ATTACHING A SUBJECT SLING TO SLING BARS, AND LIFT SYSTEMS USING SLING BARS

CROSS-REFERENCE TO RELATED APPLICATION

The present application claims the priority benefit of U.S. Provisional Application Ser. No. 63/006,978, filed Apr. 8, 2020 and entitled "SLING BARS, METHODS FOR ATTACHING A SUBJECT SLING TO THE SLING BARS, AND LIFT SYSTEMS USING THE SLING BARS" and claims the priority benefit of U.S. Provisional Application Ser. No. 63/058,072, filed Jul. 29, 2020 and entitled "SLING BARS, METHODS FOR ATTACHING A SUBJECT SLING TO SLING BARS, AND LIFT SYSTEMS USING SLING BARS," the entire contents of both are incorporated herein in their respective entireties.

BACKGROUND

Field

The present disclosure generally relates to sling bars, and more specifically, to sling bars including sling attachment portions arranged to ensure retention of sling loops associated with a subject sling, as well as methods of operating the sling bars and lift systems that use the sling bars.

Technical Background

Caregivers often use a lift system to lift a subject. A conventional sling bar may require a user, such as a caregiver, to use both hands to attach a sling loop of a sling to the sling bar. For example, the user may have to manipulate a sling attachment portion of the sling bar with one hand and use their other hand to couple the sling loop to the sling attachment portion of the sling bar. In such instances, simultaneously manipulating the sling attachment portion while attaching the sling loop may be difficult. This often frustrates a user because they are unable to keep one hand available for assisting the subject. Accordingly, sling bars including alternative sling attachment portions, that may be manipulated and/or usable with one hand to securely attach sling loops to a sling bar, may be desired.

SUMMARY

In a first aspect A1, a sling bar includes a first bar portion that extends in a first longitudinal direction, the first bar portion defining a first latch slot and a first spring aperture; a first sling attachment portion positioned at a first end of the first bar portion, the first sling attachment portion extending from a lower part of the first bar portion to define a first receiving aperture, and the first sling attachment portion defining a first stop surface; a first retention latch pivotally coupled to an upper part of the first bar portion and defining a first engagement face, the first engagement face restraining the first retention latch to pivot between an open position, where the first retention latch is positionable against the first bar portion within the first latch slot, and a closed position, where the first engagement face interfaces with the first stop surface of the first sling attachment portion; and a first spring positioned within the first spring aperture to force the first retention latch toward the closed position.

A second aspect A2 includes the sling bar of the first aspect A1, wherein a first lock protrusion is defined on the first engagement face; and a first lock aperture is defined on the first stop surface, the first lock aperture shaped to receive the first lock protrusion to maintain the first retention latch in the closed position.

A third aspect A3 includes the sling bar of the first aspect A1, wherein the first spring is configured to produce a first closing force between the first engagement face and the first stop surface.

A fourth aspect A4 includes the sling bar of the third aspect A3, wherein the first retention latch includes a first actuation surface, and wherein the first closing force is overcomable when a first insertion force is applied to a sling loop in contact with the first actuation surface.

A fifth aspect A5 includes the sling bar of the first aspect A1, wherein at least one of the first bar portion and the first sling attachment portion is cast aluminum.

A sixth aspect A6 includes the sling bar of the first aspect A1, the second aspect A2, the third aspect A3, the fourth aspect A4, or the fifth aspect A5, wherein the first retention latch is defined by a material such that the first engagement face interfaces with the first stop surface without a lateral deflection or a vertical deformation in the first retention latch.

A seventh aspect A7 includes the sling bar of the sixth aspect A6, wherein the material of the first retention latch is cast aluminum or steel.

An eighth aspect A8 includes the sling bar of the first aspect A1, further including a hub portion, wherein the first bar portion extends from the hub portion; a shaft positioned within the hub portion, wherein the sling bar is rotatable about an axis defined through the shaft; and a lift hook pivotally coupled to a connector portion of the shaft, wherein the sling bar is pivotable about an axis defined through the connector portion, and wherein the axis defined through the connector portion is transverse to the axis defined through the shaft.

A ninth aspect A9 includes the sling bar of the first aspect A1, the second aspect A2, the third aspect A3, the fourth aspect A4, the fifth aspect A5, or the eighth aspect A8, wherein the first sling attachment portion extends in the first longitudinal direction a first predetermined distance, extends in a first vertical direction a second predetermined distance, and extends in a second longitudinal direction back toward the first bar portion a third predetermined distance to define the first receiving aperture, and wherein the first, second, and third predetermined distance are based on a plurality of sling loops to be retained within the first receiving aperture.

A tenth aspect A10 includes the sling bar of the first aspect A1, the second aspect A2, the third aspect A3, the fourth aspect A4, the fifth aspect A5, or the eighth aspect A8, further including at least one bar insert coupled within at least one cavity defined in the first bar portion, wherein the at least one bar insert includes a material to which a device associated with a subject lift is removably couplable.

An eleventh aspect A11 includes the sling bar of the tenth aspect A10, wherein the material includes a ferrous material, wherein the device includes a lift control device including a magnet, and wherein the magnet removably couples the lift control device to the at least one bar insert of the sling bar.

A twelfth aspect A12 includes the sling bar of the first aspect A1, the second aspect A2, the third aspect A3, the fourth aspect A4, the fifth aspect A5, or the eighth aspect A8, further including a second bar portion that extends in a second longitudinal direction, the second bar portion defining a second latch slot and a second spring aperture; a second sling attachment portion positioned at a second end of the second bar portion, the second sling attachment portion extending from a lower part of the second bar portion to define a second receiving aperture, and the second sling attachment portion defining a second stop surface; a second retention latch pivotally coupled to an upper part of the second bar portion and defining a second engagement face, the second engagement face restraining the second retention latch to pivot between an open position, where the second retention latch is positionable against the second bar portion within the second latch slot, and a closed position, where the second engagement face interfaces with the second stop surface of the second sling attachment portion; and a second spring positioned within the second spring aperture to force the second retention latch toward the closed position.

In a thirteenth aspect A13, a method of attaching a subject sling to a sling bar includes applying a first insertion force, via one or more than one sling loop, to a first retention latch on a sling bar, wherein the first insertion force is a predetermined force that overcomes a first closing force, generated by a first spring positioned within a first spring aperture defined in a first bar portion of the sling bar, to pivot the first retention latch toward an open position where the first retention latch is positionable within a first latch slot defined in the first bar portion of the sling bar, and where a first engagement face of the first retention latch is separated from a first stop surface defined on a first sling attachment portion positioned at a first end of the first bar portion; and inserting the one or more than one sling loop associated with a subject sling over the first sling attachment portion into a first receiving aperture defined by the first sling attachment portion.

A fourteenth aspect A14 includes the method of the thirteenth aspect A13, wherein the predetermined force is greater than a hanging weight associated with at least one of: the one or more than one sling loop, or the subject sling.

In a fifteenth aspect A15, a sling bar includes a first bar portion that extends in a first longitudinal direction; and a first sling attachment portion positioned at a first end of the first bar portion, wherein the first sling attachment portion includes a wireform that extends from a lower part of the first bar portion in vertical alignment with the first bar portion to define a first receiving aperture, and wherein the first receiving aperture is defined by a proximal curl portion and a distal curl portion to receive one or more than one sling loop.

A sixteenth aspect A16 includes the sling bar of the fifteenth aspect A15, wherein the distal curl portion is dimensioned such that the one or more than one sling loop may be placed over the distal curl portion and between the proximal curl portion and the distal curl portion to seat the one or more than one sling loop within the first receiving aperture.

A seventeenth aspect A17 includes the sling bar of the fifteenth aspect A15, wherein the distal curl portion retains the one or more than one sling loop within the first receiving aperture.

An eighteenth aspect A18 includes the sling bar of the fifteenth aspect A15, wherein the first sling attachment portion is defined by a solid cylindrical wireform.

A nineteenth aspect A19 includes the sling bar of the eighteenth aspect A18, wherein the solid cylindrical wireform includes stainless steel bar stock.

A twentieth aspect A20 includes the sling bar of the fifteenth aspect A15, wherein the wireform is a corkscrew-shaped wireform.

A twenty-first aspect A21 includes the sling bar of the fifteenth aspect A15, the sixteenth aspect A16, the seventeenth aspect A17, the eighteenth aspect A18, the nineteenth aspect A19, or the twentieth aspect A20, wherein the wireform extends downward a first predetermined distance, curls at a first predetermined angle a second predetermined distance, curls at a second predetermined angle a third predetermined distance, and curls a third predetermined angle a fourth predetermined distance to define the first receiving aperture, and wherein the first, second and third predetermined angle and the first, second, third, and fourth predetermined distance are based on a plurality of sling loops to be retained within the first receiving aperture.

A twenty-second aspect A22 includes the sling bar of the twenty-first aspect A21, wherein the first longitudinal direction is in a +X direction of a coordinate axes, and wherein the wireform curls toward the +X, +Y, −Z octant at the first predetermined angle the second predetermined distance, curls toward the −X, +Y, +Z octant at the second predetermined angle the third predetermined distance, and curls toward the +X, −Y, −Z octant the third predetermined angle the fourth predetermined distance.

A twenty-third aspect A23 includes the sling bar of the twenty-second aspect A22, wherein a distal end of the first sling attachment portion extends toward a −Z direction.

A twenty-fourth aspect A24 includes the sling bar of the twenty-first aspect A21, wherein the first longitudinal direction is in a +X direction of a coordinate axes, and wherein the wireform curls toward the +X, +Y, +Z octant at the first predetermined angle the second predetermined distance, curls toward the −X, −Y, +Z octant at the second predetermined angle the third predetermined distance, and curls toward the +X, −Y, +Z octant the third predetermined angle the fourth predetermined distance.

A twenty-fifth aspect A24 includes the sling bar of the twenty-fourth aspect A24, wherein a distal end of the first sling attachment portion extends toward the +X direction.

A twenty-sixth aspect A25 includes the sling bar of the twenty-first aspect A21, wherein the first longitudinal direction is in a +X direction of a coordinate axes, and wherein the wireform curls toward the −X, +Y, −Z octant at the first predetermined angle the second predetermined distance, curls toward the −X, −Y, +Z octant at the second predetermined angle the third predetermined distance, and curls toward the −X, −Y, −Z octant the third predetermined angle the fourth predetermined distance.

A twenty-seventh aspect A27 includes the sling bar of the twenty-sixth aspect A26, wherein a distal end of the first sling attachment portion extends toward a +Z direction.

A twenty-eighth aspect A28 includes the sling bar of the fifteenth aspect A15, the sixteenth aspect A16, the seventeenth aspect A17, the eighteenth aspect A18, the nineteenth aspect A19, or the twentieth aspect A20, wherein the wireform of the first sling attachment portion curls away from the first end of the first bar portion.

A twenty-ninth aspect A29 includes the sling bar of the fifteenth aspect A15, the sixteenth aspect A16, the seventeenth aspect A17, the eighteenth aspect A18, the nineteenth aspect A19, or the twentieth aspect A20, wherein the wireform of the first sling attachment portion curls away from the first end of the first bar portion, and curls back toward the first end to overlap at least a portion of the first end on a lateral side of the first bar portion.

A thirtieth aspect A30 includes the sling bar of the fifteenth aspect A15, the seventeenth aspect A17, the eighteenth aspect A18, the nineteenth aspect A19, or the twentieth aspect A20, wherein the wireform of the first sling attachment portion curls around the first end of the first bar portion in a second longitudinal direction.

A thirty-first aspect A31 includes the sling bar of the fifteenth aspect A15, the sixteenth aspect A16, the seventeenth aspect A17, the eighteenth aspect A18, the nineteenth aspect A19, or the twentieth aspect A20, further including a hub portion, wherein the first bar portion extends from the hub portion; a shaft positioned within the hub portion, wherein the sling bar is rotatable about an axis defined through the shaft; and a lift hook pivotally coupled to a connector portion of the shaft, wherein the sling bar is pivotable about an axis defined through the connector portion, and wherein the axis defined through the connector portion is transverse to the axis defined through the shaft.

A thirty-second aspect A32 includes the sling bar of the fifteenth aspect A15, the sixteenth aspect A16, the seventeenth aspect A17, the eighteenth aspect A18, the nineteenth aspect A19, or the twentieth aspect A20, further including at least one bar insert coupled within at least one cavity defined in the first bar portion, wherein the at least one bar insert comprises a material to which a device associated with a subject lift is removably couplable.

A thirty-third aspect A33 includes the sling bar of the thirty-second aspect A32, wherein the material comprises a ferrous material, wherein the device comprises a lift control device including a magnet, and wherein the magnet removably couples the lift control device to the at least one bar insert of the sling bar.

A thirty-fourth aspect A34 includes the sling bar of the fifteenth aspect A15, the sixteenth aspect A16, the seventeenth aspect A17, the eighteenth aspect A18, the nineteenth aspect A19, or the twentieth aspect A20, wherein at least one of the first bar portion and the first sling attachment portion is cast aluminum.

In a thirty-fifth aspect A35, a method of attaching a subject sling to a sling bar includes selecting one or more than one sling loop associated with a subject sling to loop over a distal curl portion of a first sling attachment portion positioned at a first end of a first bar portion of a sling bar, the first sling attachment portion comprising a wireform that extends from a lower part of the first bar portion in vertical alignment with the first bar portion to define a first receiving aperture, the first receiving aperture defined by a proximal curl portion and the distal curl portion; and placing the one or more than one sling loop over the distal curl portion into the first receiving aperture.

A thirty-sixth aspect A36 includes the method of the thirty-fifth aspect A35, further including determining whether the one or more than one sling loop is seated within the first receiving aperture.

In a thirty-seventh aspect A37, a lift system includes a subject lift including a lift mechanism coupled to a lift strap, wherein a sling bar attachment mechanism is coupled to the lift strap; and a sling bar coupled to the sling bar attachment mechanism, the sling bar including a first bar portion that extends in a first longitudinal direction, the first bar portion defining a first latch slot and a first spring aperture; a first sling attachment portion positioned at a first end of the first bar portion, the first sling attachment portion extending from a lower part of the first bar portion to define a first receiving aperture, and the first sling attachment portion defining a first stop surface; a first retention latch pivotally coupled to an upper part of the first bar portion and defining a first engagement face, the first engagement face restraining the first retention latch to pivot between an open position, where the first retention latch is positionable against the first bar portion within the first latch slot, and a closed position, where the first engagement face interfaces with the first stop surface of the first sling attachment portion; and a first spring positioned within the first spring aperture to force the first retention latch toward the closed position.

A thirty-eighth aspect A38 includes the lift system of the thirty-seventh aspect A37, wherein the sling bar further includes a hub portion, wherein the first bar portion extends from the hub portion; a shaft positioned within the hub portion; and a lift hook pivotally coupled to the shaft, wherein the lift hook couples the sling bar to the sling bar attachment mechanism of the subject lift.

A thirty-ninth aspect A39 includes the lift system of the thirty-seventh aspect or the thirty-eighth aspect A38, wherein the sling bar further includes at least one bar insert coupled within at least one cavity defined in the first bar portion, wherein the at least one bar insert comprises a ferrous material; and a lift control device communicatively coupled to the lift mechanism, wherein the lift control device comprises a magnet, wherein the magnet removably couples the lift control device to the at least one bar insert of the sling bar.

In a fortieth aspect A40, a lift system includes a subject lift including a lift mechanism coupled to a lift strap, wherein a sling bar attachment mechanism is coupled to the lift strap; and a sling bar coupled to the sling bar attachment mechanism, the sling bar including a first bar portion that extends in a first longitudinal direction; and a first sling attachment portion positioned at a first end of the first bar portion, wherein the first sling attachment portion comprises a wireform that extends from a lower part of the first bar portion in vertical alignment with the first bar portion to define a first receiving aperture, and wherein the first receiving aperture is defined by a proximal curl portion and a distal curl portion to receive one or more than one sling loop.

A forty-first aspect A41 includes the lift system of the fortieth aspect A40, wherein the sling bar further includes a hub portion, wherein the first bar portion extends from the hub portion; a shaft positioned within the hub portion; and a lift hook pivotally coupled to the shaft, wherein the lift hook couples the sling bar to the sling bar attachment mechanism of the subject lift.

A forty-second aspect A42 includes the lift system of the fortieth aspect A40 or the forty-first aspect A41, wherein the sling bar further includes at least one bar insert coupled within at least one cavity defined in the first bar portion, wherein the at least one bar insert comprises a ferrous material; and a lift control device communicatively coupled to the lift mechanism, wherein the lift control device comprises a magnet, wherein the magnet removably couples the lift control device to the at least one bar insert of the sling bar.

In a forty-third aspect A43, a sling bar includes a first bar portion extending in a first longitudinal direction; a first protrusion extending from an upper part of a first end of the first bar portion in the first longitudinal direction; a first sling attachment portion positioned at the first end of the first bar portion, the first sling attachment portion extending to define a first receiving aperture, wherein a first terminus of the first sling attachment portion faces the first protrusion at a distance from the first protrusion, defining an opening into the first receiving aperture, wherein the first protrusion defines a first undercut portion of the first receiving aperture located underneath the first protrusion between the first protrusion and the first sling attachment portion; a first retention latch pivotally coupled to the first protrusion and defining a first engagement face that selectively interfaces with a first stop surface at the first terminus in a closed position to cover the opening into the first receiving aperture, the first retention latch being constrained to pivot to an open position whereby the first retention latch ceases to interface with the first stop surface at the first terminus; and a first biasing mechanism coupled to the first retention latch to force the first retention latch toward the closed position.

A forty-fourth aspect A44 includes the forty-third aspect A43, wherein the first biasing mechanism is configured to produce a first closing force between the first engagement face and the first stop surface.

A forty-fifth aspect A45 includes the forty-fourth aspect A44, wherein the first retention latch includes a first actuation surface, and wherein the first closing force is overcomable when a first insertion force is applied to a sling loop in contact with the first actuation surface.

A forty-sixth aspect A46 includes any one of the forty-third-forty-fifth aspects A43-A45, wherein at least one of the first bar portion and the first sling attachment portion is cast aluminum.

A forty-seventh aspect A47 includes any one of the forty-third-fort-sixth aspects A43-A46, wherein the first retention latch is defined by a material such that the first engagement face interfaces with the first stop surface without a lateral deflection or a vertical deformation in the first retention latch.

A forty-eighth aspect A48 includes the forty-seventh aspect A47, wherein the material of the first retention latch is cast aluminum or steel.

A forty-ninth aspect A49 includes any one of the forty-third-forty-eighth aspects A43-A48, further including a hub portion, wherein the first bar portion extends from the hub portion; a shaft positioned within the hub portion, wherein the sling bar is rotatable about an axis defined through the shaft; and a lift hook pivotally coupled to a connector portion of the shaft, wherein the sling bar is pivotable about an axis defined through the connector portion, and wherein the axis defined through the connector portion is transverse to the axis defined through the shaft.

A fiftieth aspect A50 includes any one of the forty-third-forty-ninth aspects A43-A49, wherein the first sling attachment portion extends in the first longitudinal direction a first predetermined distance, extends in a first vertical direction a second predetermined distance, and extends in a second longitudinal direction back toward the first bar portion a third predetermined distance to define the first receiving aperture, and wherein the first, second, and third predetermined distance are based on a plurality of sling loops to be retained within the first receiving aperture.

A fifty-first aspect A51 includes any one of the forty-third-fiftieth aspects A43-A50, further including at least one bar insert coupled within at least one cavity defined in the first bar portion, wherein the at least one bar insert comprises a material to which a device associated with a subject lift is removably couplable.

A fifty-second aspect A52 includes the fifty-first aspect A51, wherein the material comprises a ferrous material, wherein the device comprises a lift control device including a magnet, and wherein the magnet removably couples the lift control device to the at least one bar insert of the sling bar.

A fifty-third aspect A53 includes any one of the forty-third-fifty-second aspects A43-A52, wherein the first undercut portion is shaped and sized to maintain a positioning of one or more than one sling loop when the sling bar is positioned in an extreme angle positioning.

A fifty-fourth aspect A54 includes any one of the forty-third-fifty-third aspects A43-A53, further including a second bar portion extending in a second longitudinal direction; a second protrusion extending from an upper part of a second end of the second bar portion in the second longitudinal direction; a second sling attachment portion positioned at the second end of the second bar portion, the second sling attachment portion extending to define a second receiving aperture, wherein a second terminus of the second sling attachment portion faces the second protrusion at a distance from the second protrusion, defining an opening into the second receiving aperture, wherein the second protrusion defines a second undercut portion of the second receiving aperture located underneath the second protrusion between the second protrusion and the second sling attachment portion; a second retention latch pivotally coupled to the second protrusion and defining a second engagement face that selectively interfaces with a second stop surface at the second terminus in a closed position to cover the opening into the second receiving aperture, the second retention latch being constrained to pivot to an open position whereby the second retention latch ceases to interface with the second stop surface at the second terminus; and a second biasing mechanism coupled to the second retention latch to force the second retention latch toward the closed position.

In a fifty-fifth aspect A55, a lift system includes a subject lift including a lift mechanism coupled to a lift strap, wherein a sling bar attachment mechanism is coupled to the lift strap; and the sling bar according to any one of the forty-third-fifty-fourth aspects A43-A54, the sling bar coupled to the sling bar attachment mechanism.

In a fifty-sixth aspect A56, a sling bar includes a first bar portion that extends in a first longitudinal direction, the first bar portion defining a first latch slot and a first spring aperture, a first sling attachment portion positioned at a first end of the first bar portion, the first sling attachment portion extending from an upper part of the first bar portion to define a first receiving aperture, and the first sling attachment portion defining a first stop surface, a first retention latch pivotally coupled to a lower part of the first bar portion and defining a first engagement face, the first engagement face restraining the first retention latch to pivot between an open position, where the first retention latch is positionable against the first bar portion within the first latch slot, and a closed position, where the first engagement face interfaces with the first stop surface of the first sling attachment portion, and a first spring positioned within the first spring aperture to force the first retention latch toward the closed position.

A fifty-seventh aspect A57 includes the sling bar of the fifty-sixth aspect A56, wherein the first spring is configured to produce a first closing force between the first engagement face and the first stop surface.

A fifty-eighth aspect A58 includes the sling bar of the fifty-seventh aspect A57, wherein the first retention latch includes a first actuation surface, and wherein the first closing force is overcomable when a first insertion force is applied to a sling loop in contact with the first actuation surface.

A fifty-ninth aspect A59 includes any one of the fifty-sixth-fifty-eighth aspects A56-A58, wherein the first sling attachment portion extends in the first longitudinal direction a first predetermined distance, extends in a first vertical direction a second predetermined distance, extends in a second longitudinal direction a third predetermined distance, and extends in a second vertical direction back toward the first bar portion a fourth predetermined distance to define the first receiving aperture, and wherein the first, second, third, and fourth predetermined distance are based on a plurality of sling loops to be retained within the first receiving aperture.

A sixtieth aspect A60 includes any one of the fifty-sixth-fifty-ninth aspects A56-A59, further including a second bar portion that extends in a second longitudinal direction, the second bar portion defining a second latch slot and a second spring aperture, a second sling attachment portion positioned at a second end of the second bar portion, the second sling attachment portion extending from an upper part of the second bar portion to define a second receiving aperture, and the second sling attachment portion defining a second stop surface, a second retention latch pivotally coupled to a lower part of the second bar portion and defining a second engagement face, the second engagement face restraining the second retention latch to pivot between an open position, where the second retention latch is positionable against the second bar portion within the second latch slot, and a closed position, where the second engagement face interfaces with the second stop surface of the second sling attachment portion, and a second spring positioned within the second spring aperture to force the second retention latch toward the closed position.

In a sixty-first aspect A61, a lift system includes a subject lift including a lift mechanism coupled to a lift strap, wherein a sling bar attachment mechanism is coupled to the lift strap, and the sling bar according to any one of the fifty-sixth-sixtieth aspects A56-A60, the sling bar coupled to the sling bar attachment mechanism.

In a sixty-second aspect A62, a sling bar includes a hub portion and a first bar portion extending from the hub in a first longitudinal direction; a first protrusion extending from the hub portion in the first longitudinal direction; a first sling attachment portion positioned at the first end of the first bar portion, the first sling attachment portion extending to define a first opening, a first elevation channel, a first extension channel, and a first receiving aperture, wherein a first terminus of the first sling attachment portion faces the hub at a distance from the hub, defining the first opening, wherein the first protrusion defines a first undercut portion located underneath the first protrusion between the first protrusion and the first sling attachment portion.

A sixty-third aspect A63 includes the sixty-second aspect A62, wherein the first sling attachment portion comprises a first extension portion that defines the first elevation channel, the first extension channel, and the first receiving aperture, the first extension portion having a plurality of different thicknesses along a length thereof.

A sixty-fourth aspect A64 includes any one of the sixty-second-sixty-third aspects A62-A63, further comprising a shaft positioned within the hub portion, wherein the sling bar is rotatable about an axis defined through the shaft; and a lift hook pivotally coupled to a connector portion of the shaft, wherein the sling bar is pivotable about an axis defined through the connector portion, and wherein the axis defined through the connector portion is transverse to the axis defined through the shaft.

A sixty-fifth aspect A65 includes any one of the sixty-second-sixty-fourth aspects A62-A64, wherein the first sling attachment portion extends in the first longitudinal direction a first predetermined distance, extends in a first vertical direction a second predetermined distance, and extends in a second longitudinal direction back toward the first bar portion a third predetermined distance to define the first elevation channel, the first extension channel, and the first receiving aperture, and wherein the first, second, and third predetermined distance are based on a plurality of sling loops to be retained within the first receiving aperture.

A sixty-sixth aspect A66 includes any one of the sixty-second-sixty-fifth aspects A62-A65, wherein the first undercut portion is shaped and sized to maintain a positioning of one or more than one sling loop when the sling bar is positioned in an extreme angle positioning.

A sixty-seventh aspect A67 includes any one of the sixty-second-sixty-sixth aspects A62-A66, further including a second bar portion extending from the hub in a second longitudinal direction; a second protrusion extending from the hub portion in the second longitudinal direction; a second sling attachment portion positioned at the second end of the second bar portion, the second sling attachment portion extending to define a second opening, a second elevation channel, a second extension channel, and a second receiving aperture, wherein a second terminus of the second sling attachment portion faces the hub at a distance from the hub, defining the second opening, wherein the second protrusion defines a second undercut portion located underneath the second protrusion between the second protrusion and the second sling attachment portion.

Additional features and advantages of the aspects described herein will be set forth in the detailed description which follows, and in part will be readily apparent to those skilled in the art from that description or recognized by practicing the aspects described herein, including the detailed description which follows, the claims, as well as the appended drawings.

It is to be understood that both the foregoing general description and the following detailed description describe various aspects and are intended to provide an overview or framework for understanding the nature and character of the claimed subject matter. The accompanying drawings are included to provide a further understanding of the various aspects, and are incorporated into and constitute a part of this specification. The drawings illustrate the various aspects described herein, and together with the description serve to explain the principles and operations of the claimed subject matter.

BRIEF DESCRIPTION OF THE DRAWINGS

The aspects set forth in the drawings are illustrative and exemplary in nature and not intended to limit the subject matter defined by the claims. The following detailed description of the illustrative aspects can be understood when read in conjunction with the following drawings, where like structure is indicated with like reference numerals and in which:

DETAILED DESCRIPTION

Figure 1:
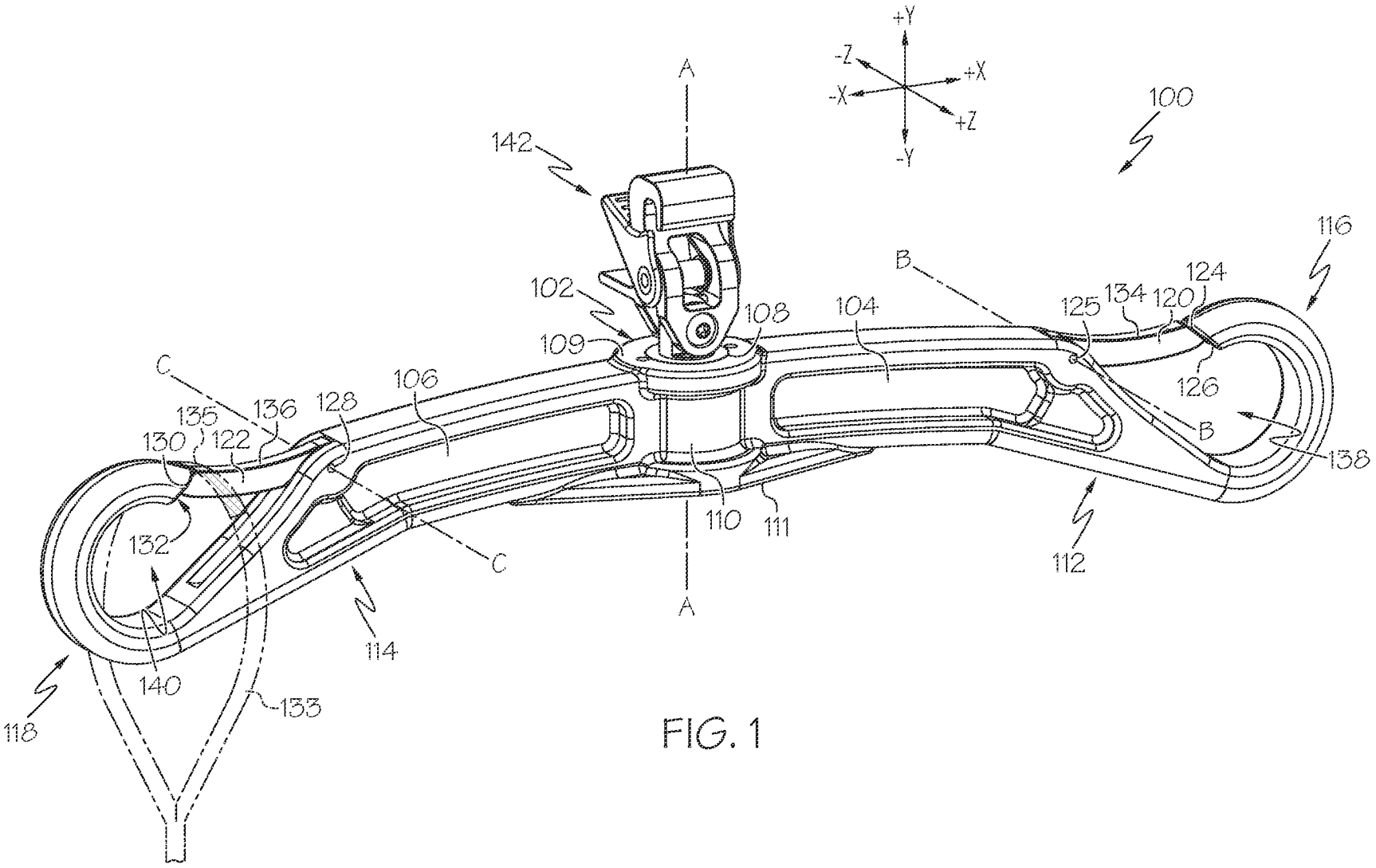
FIG. 1 depicts a perspective view of an illustrative sling bar including sling attachment portions according to one or more aspects shown and described herein.

Reference will now be made in detail to various aspects of sling bars for person lifting devices and methods of operating the same, examples of which are illustrated in the accompanying drawings. Whenever possible, the same reference numerals will be used throughout the drawings to refer to the same or like parts.

Figure 2:
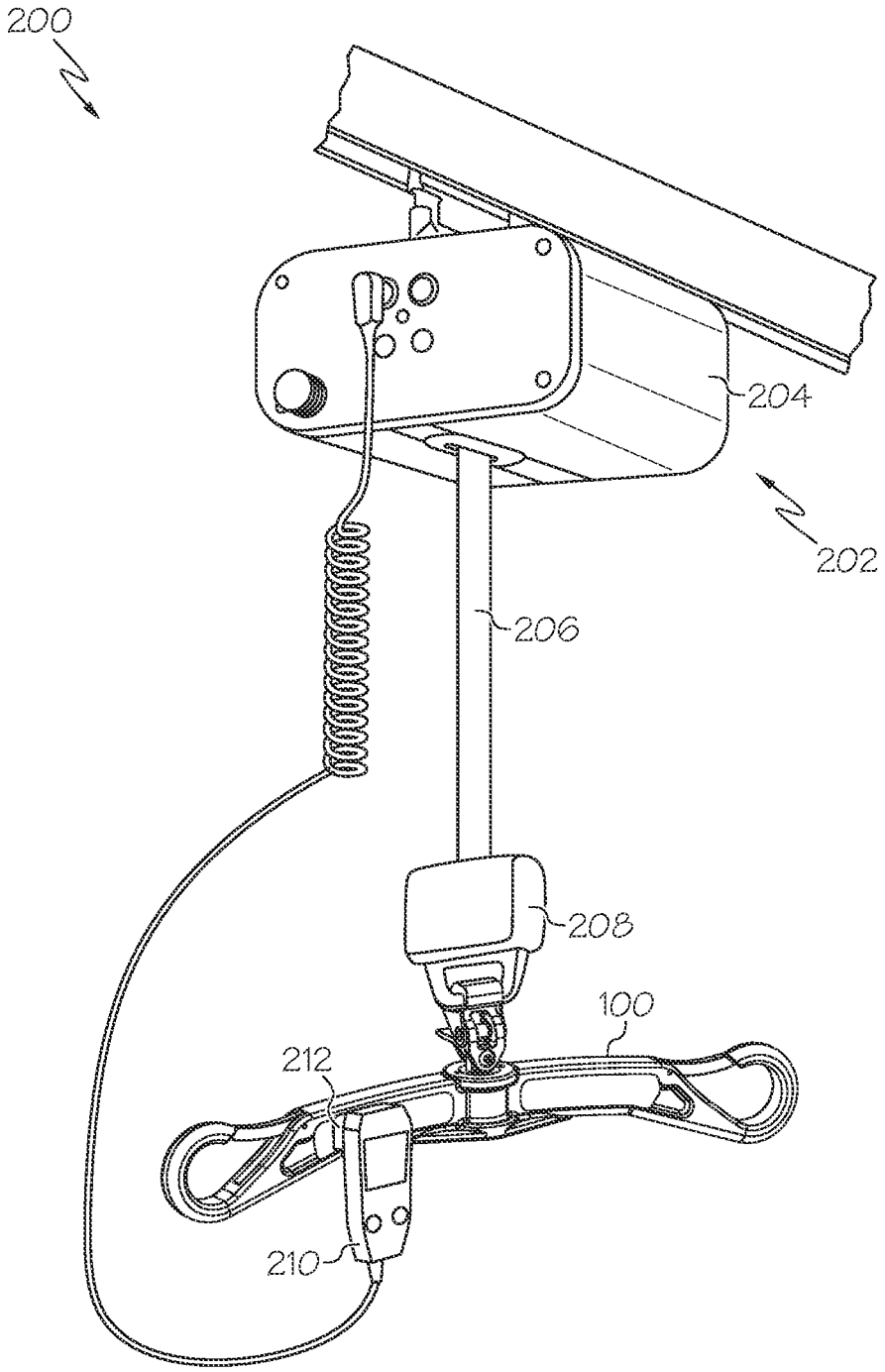
FIG. 2 depicts a perspective view of an illustrative lift system including the sling bar of FIG. 1 coupled to a subject lift according to one or more aspects shown and described herein.
Figure 5:
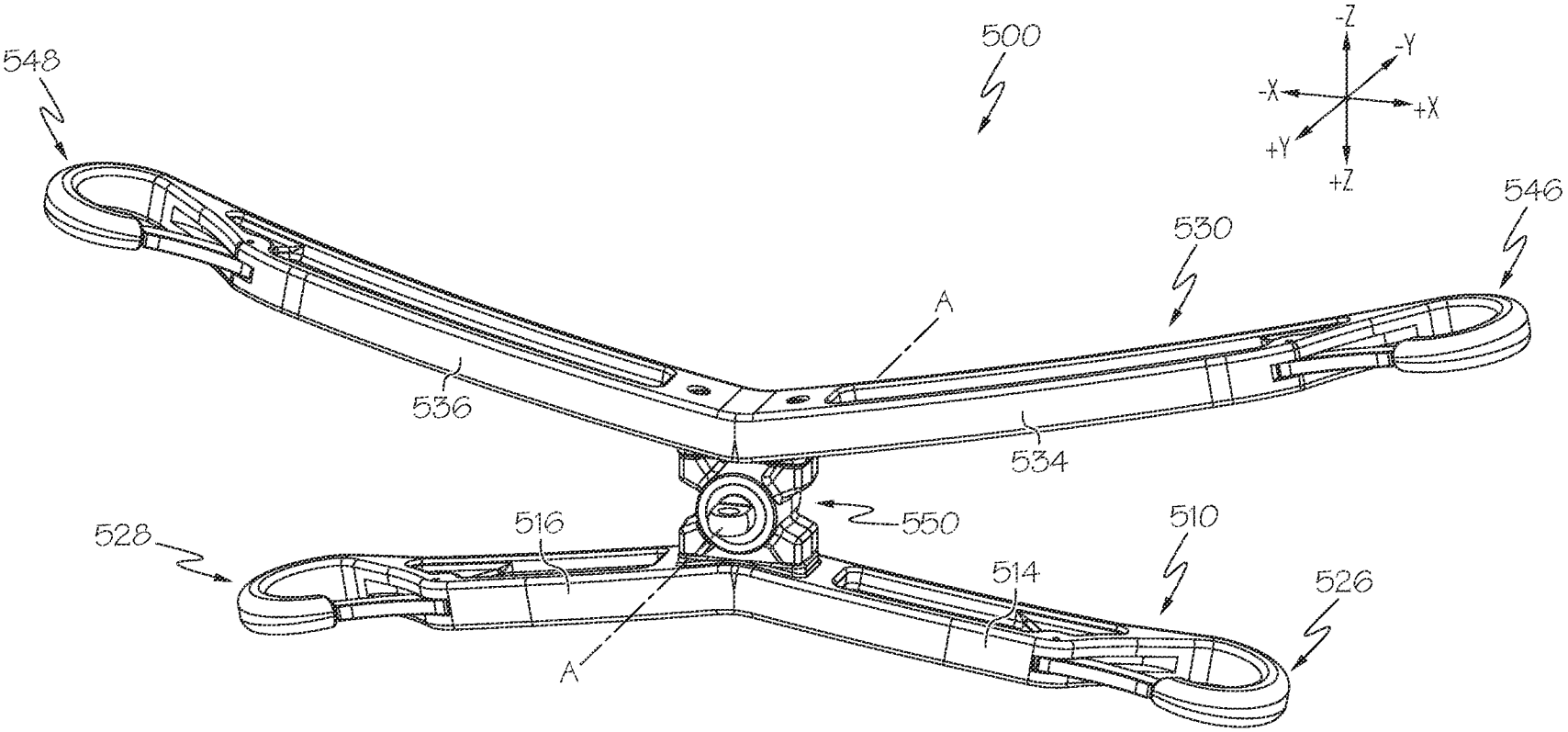
FIG. 5 depicts a perspective view of an illustrative sling bar assembly including a plurality of sling attachment portions according to one or more aspects shown and described herein.
Figure 7B:
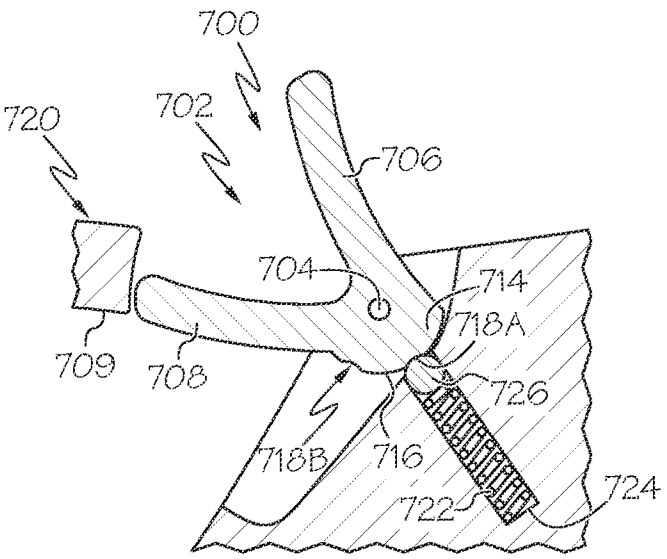
FIG. 7B depicts a cross-sectional view of the illustrative positional retention latch of FIG. 7A in the open position according to one or more aspects shown and described herein.
Figure 7D:
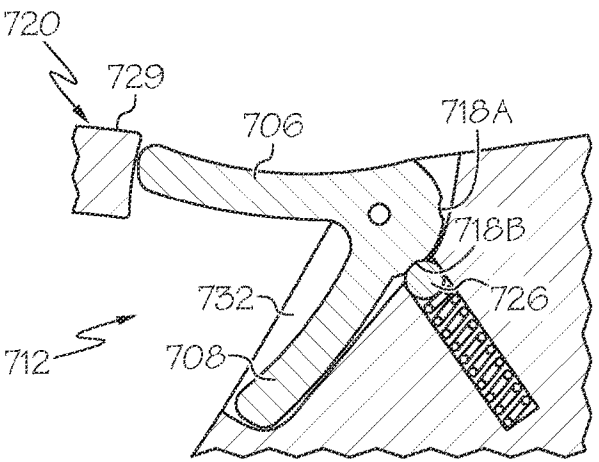
FIG. 7D depicts a cross-sectional view of the illustrative positional retention latch of FIG. 7A in the closed position according to one or more aspects shown and described herein.
Figure 7A:
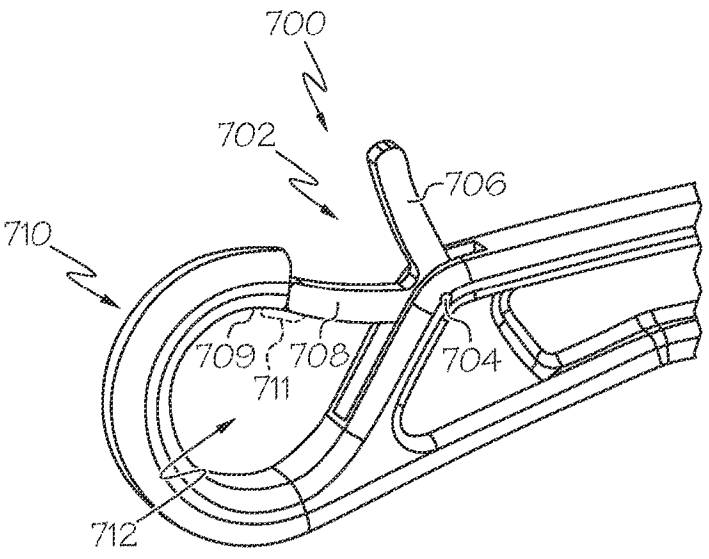
FIG. 7A depicts a perspective view of an illustrative positional retention latch in an open position according to one or more aspects shown and described herein.
Figure 7C:
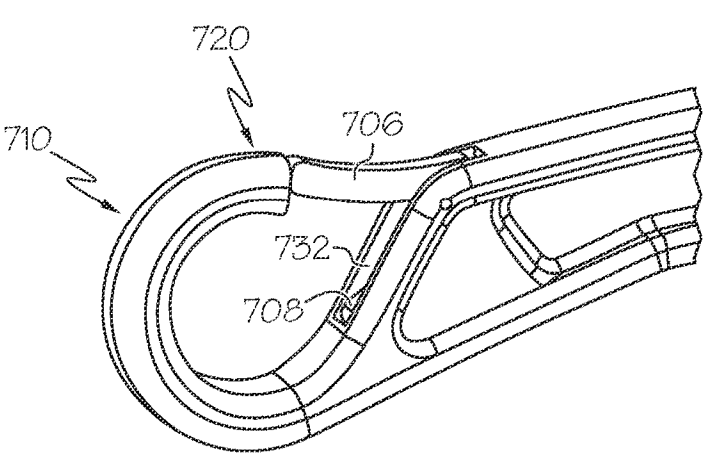
FIG. 7C depicts a perspective view of the illustrative positional retention latch of FIG. 7A in a closed position according to one or more aspects shown and described herein.
Figure 8:
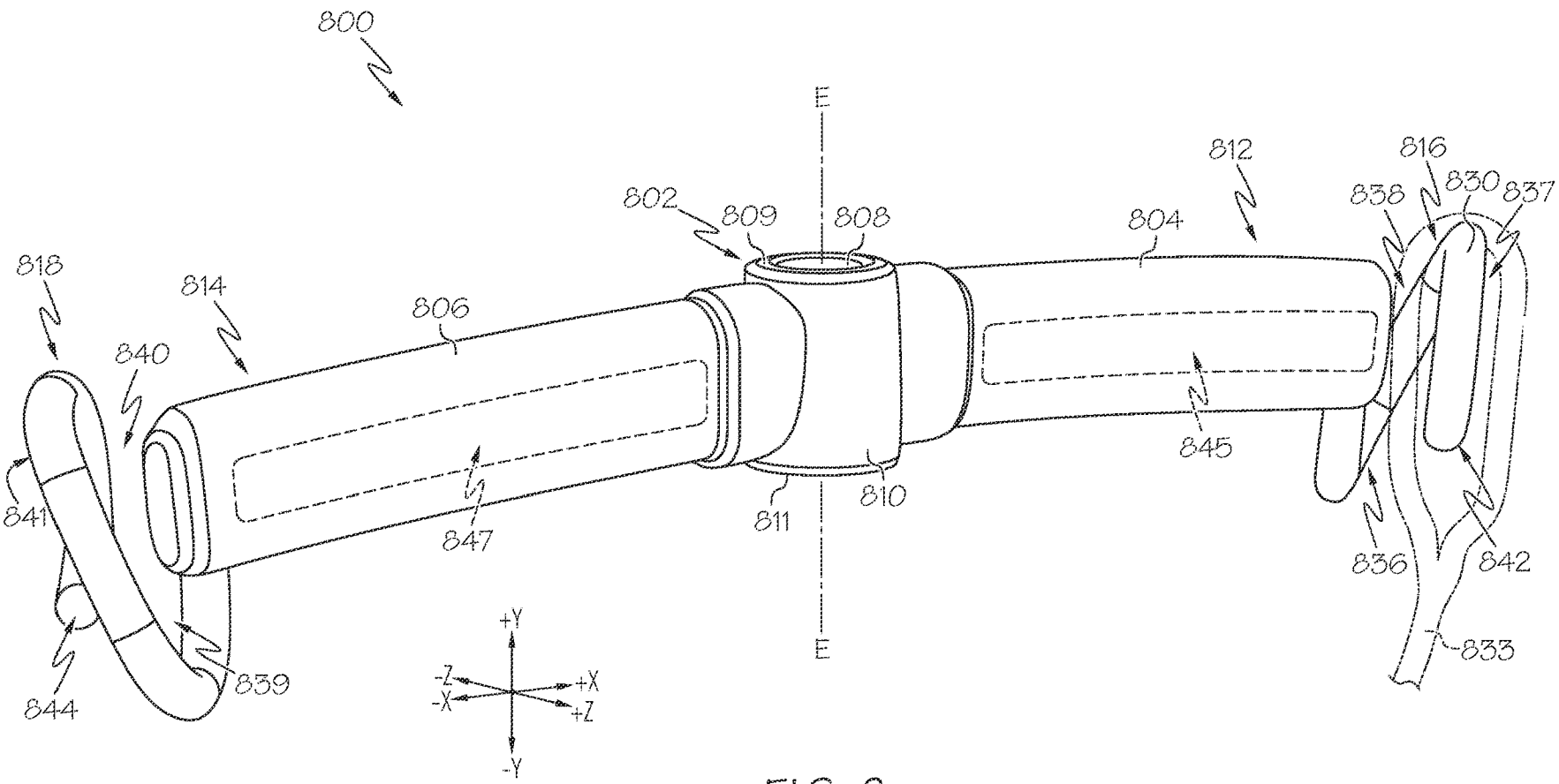
FIG. 8 depicts a perspective view of another illustrative sling bar including sling attachment portions according to one or more aspects shown and described herein.
Figure 9A:
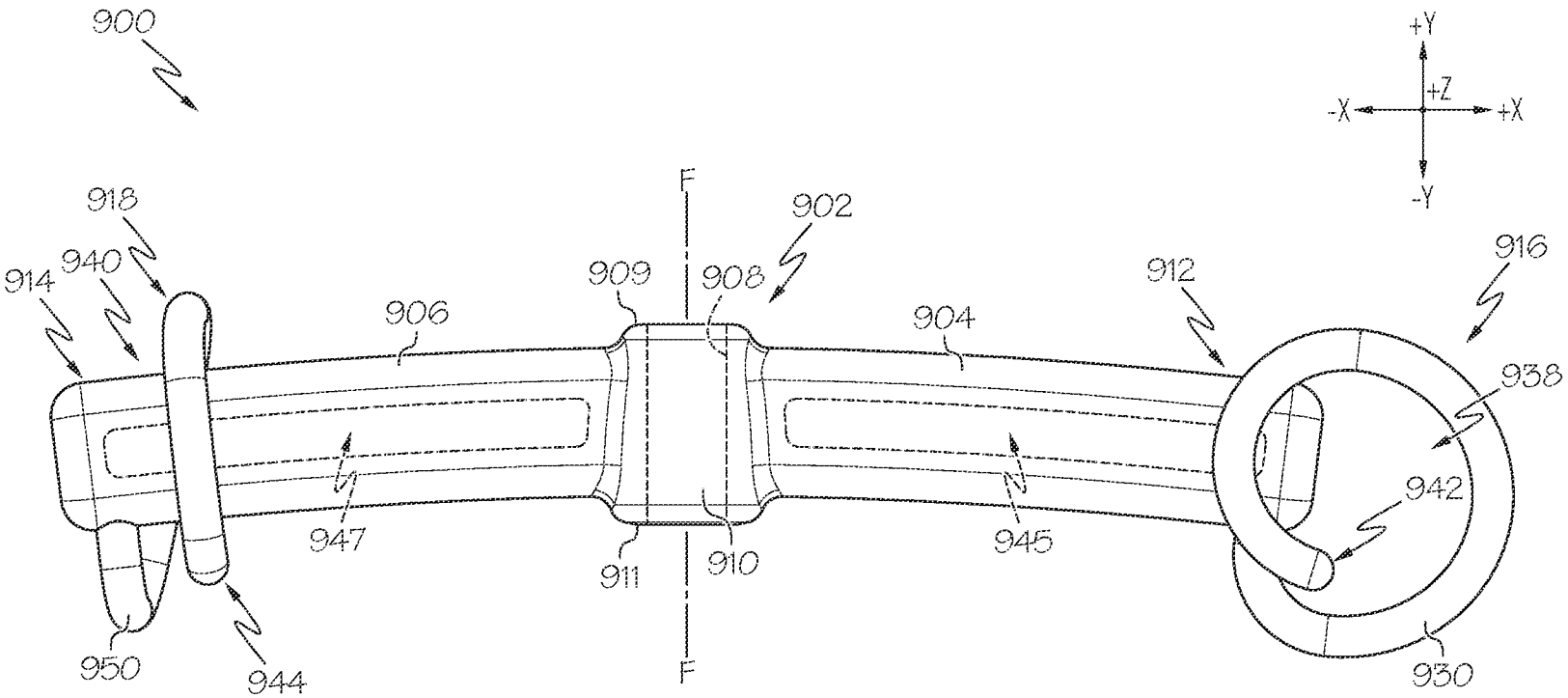
FIG. 9A depicts a front view of another illustrative sling bar including sling attachment portions according to one or more aspects shown and described herein.
Figure 10:
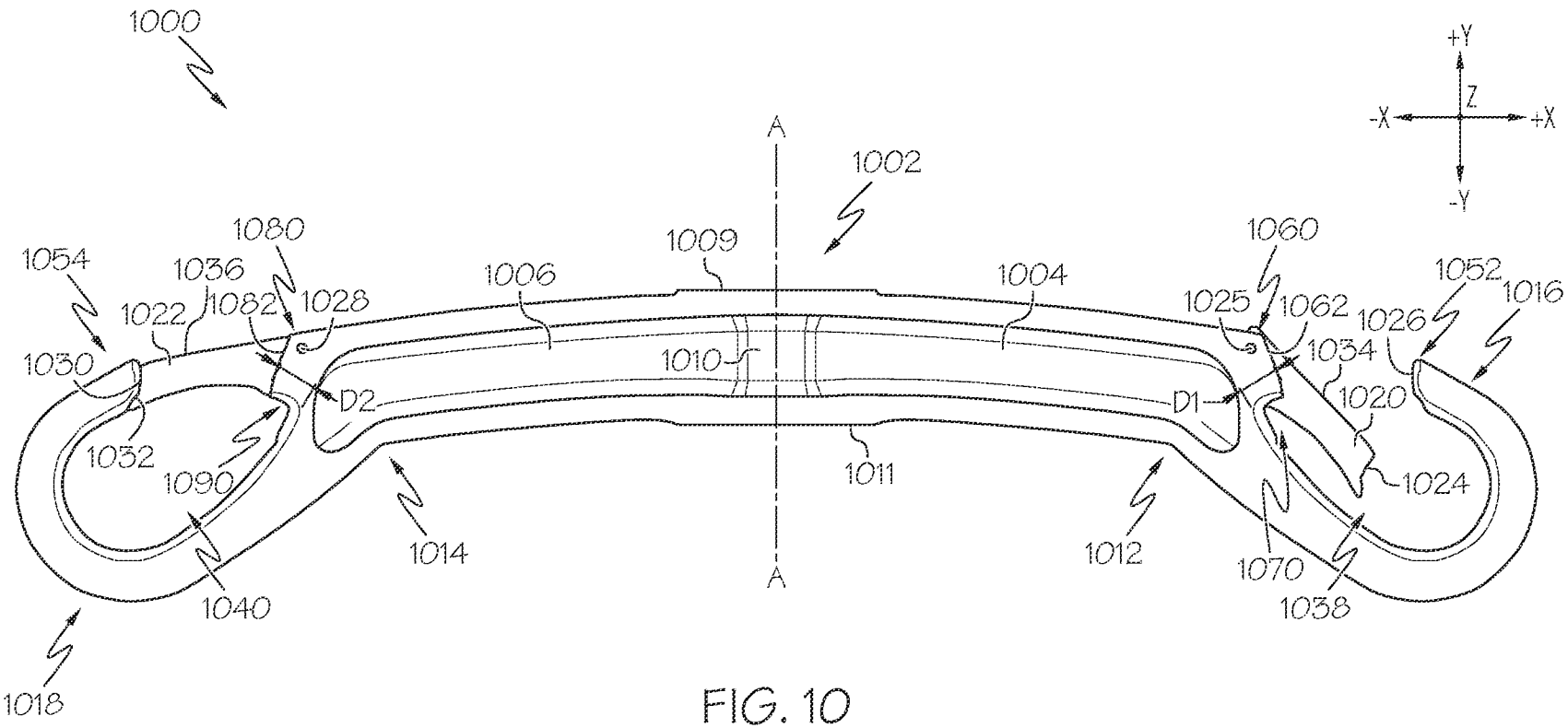
FIG. 10 depicts a side view of another illustrative sling bar including low profile sling attachment portions according to one or more aspects shown and described herein.
Figure 11A:
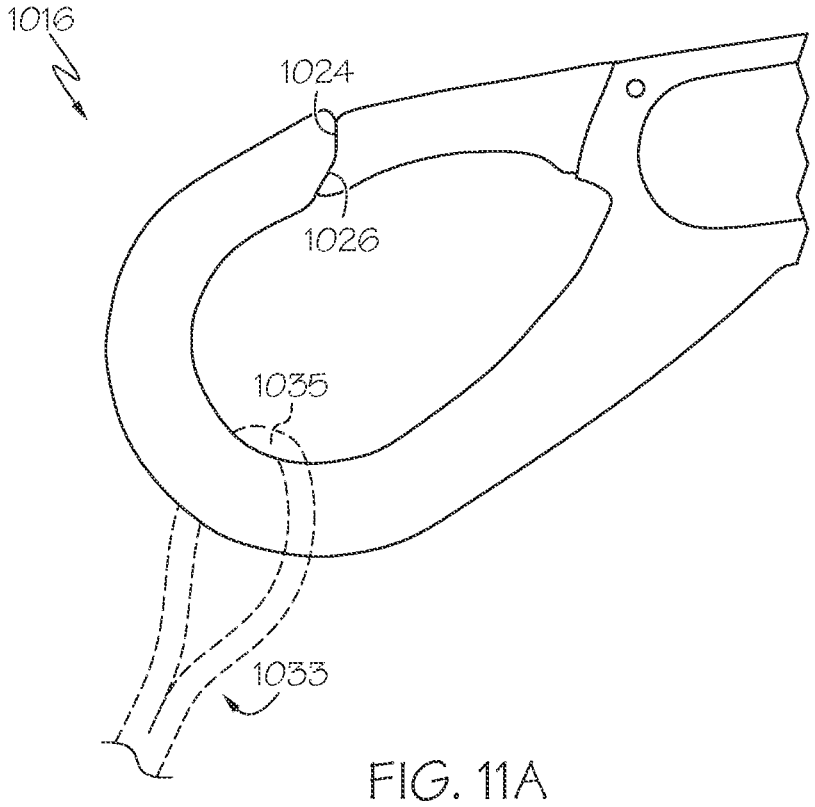
FIG. 11A depicts a perspective view of an illustrative low profile retention latch of the illustrative sling bar of FIG. 10 according to one or more aspects shown and described herein.
Figure 11B:
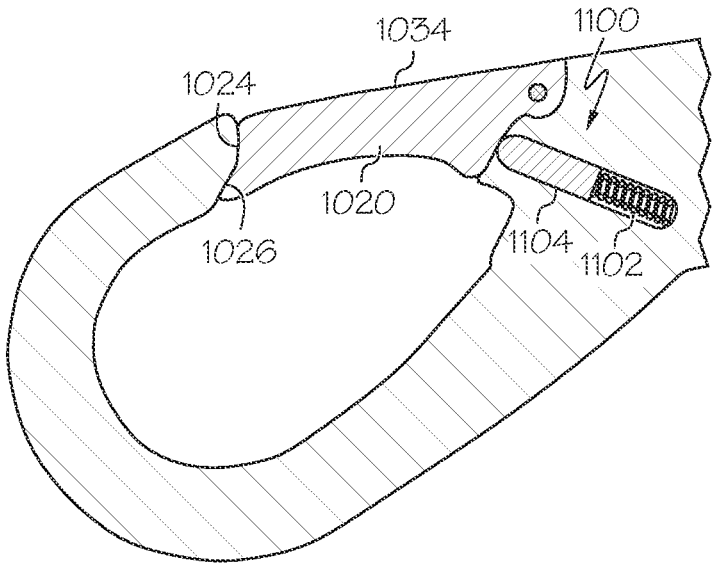
FIG. 11B depicts a cross-sectional view of the illustrative low profile retention latch of FIG. 11A according to one or more aspects shown and described herein.

Illustrative sling bars of the present disclosure are depicted in FIGS. 1, 5, 8, 9A, 10, and 12 for use with an illustrative subject lift as depicted in FIG. 2. Illustrative methods for attaching and detaching a subject sling to the illustrative sling bars are depicted in FIGS. 16A-16B and 17A-17B. In general, the illustrative sling bars include a bar portion that extends in a longitudinal direction and a sling attachment portion positioned at an end of the bar portion. The illustrative sling bars may further include a hub portion, a shaft, and a lift hook, as described herein. Yet further, the illustrative sling bars may include a bar insert couplable to the bar portion and comprising a material to which a lift control device of the subject lift is removably couplable. In some aspects, as depicted in FIGS. 1 and 5, the sling attachment portion may define a receiving aperture and a first stop surface. Further in such aspects, a retention latch, which defines an engagement face, may be coupled to the bar portion and may pivot between an open position, where the retention latch is positionable against the bar portion, and a closed position, where the engagement face interfaces with the stop surface. Yet further in such aspects, a spring may force the retention latch toward the closed position. FIGS. 7A-7D depict an illustrative positional retention latch according to various aspects. In other aspects, as depicted in FIGS. 8 and 9A, the sling attachment portion may include a wireform that defines a receiving aperture defined by a proximal curl portion and a distal curl portion. In other aspects, as depicted in FIGS. 10 and 11A-11B, the sling attachment portion may include a low profile retention latch that includes a larger entry point for a sling loop and minimizes a pinch area. In still other aspects, as depicted in FIGS. 12, 13A-13C, and 14, the sling attachment portion may be inverted as an underhook and shaped to allow extreme angle positioning and minimizing a pinch area. More details regarding such aspects as well as further aspects of the illustrative sling bars are described herein.

As used herein, a "longitudinal direction" may refer to a first longitudinal direction (e.g., in the +X direction of the coordinate axes of FIG. 1) and/or a second longitudinal direction (e.g., in the −X direction of the coordinate axes of FIG. 1), a "lateral direction" may refer to a first lateral direction (e.g., in the +Z direction of the coordinate axes of FIG. 1) and/or a second lateral direction (e.g., in the −Z direction of the coordinate axes of FIG. 1), where the lateral direction is transverse to the longitudinal direction, and a "vertical direction" may refer to a first vertical direction (e.g., in the +Y direction of the coordinate axes of FIG. 1, an upward direction) and/or a second vertical direction (e.g., in the −Y direction of the coordinate axes of FIG. 1, a downward direction), where the vertical direction is transverse to the lateral direction and the longitudinal direction.

FIG. 1 depicts a perspective view of an illustrative sling bar 100 including at least one sling attachment portion 116, 118 according to one or more aspects of the present disclosure. Referring to FIG. 1, the sling bar 100 may include a hub portion 102, a first bar portion 104, and a second bar portion 106. In such an aspect, the hub portion 102 may be defined, concentrically, about a first axis (e.g., axis A-A as depicted in FIG. 1). The hub portion 102 may define an internal hub surface (not shown, depicted generally as 108) and an external hub surface 110. Each of the internal hub surface 108 and the external hub surface 110 may be generally cylindrically shaped and extend about the first axis (e.g., axis A-A) between a first horizontal surface 109 (e.g., in the +Y direction of the coordinate axes of FIG. 1) and a second horizontal surface 111 (e.g., in the −Y direction of the coordinate axes of FIG. 1). In view of FIG. 1, a first lift hook 142 may be coupled to the sling bar 100 at or near the first horizontal surface 109. The first bar portion 104 may extend from the external hub surface 110 of the hub portion 102 in a first longitudinal direction (e.g., in the +X direction of the coordinate axes of FIG. 1) toward a first end 112, and the second bar portion 106 may extend from the external hub surface 110 of the hub portion 102 in a second longitudinal direction (e.g., in the −X direction of the coordinate axes of FIG. 1) toward a second end 114.

Referring still to FIG. 1, the sling bar 100 may further include a first sling attachment portion 116 positioned at or near the first end 112, in the second vertical direction (e.g., in the −Y direction of the coordinate axes of FIG. 1), of the first bar portion 104 and a second sling attachment portion 118 positioned at or near the second end 114, in the second vertical direction (e.g., in the −Y direction of the coordinate axes of FIG. 1), of the second bar portion 106. Each of the first sling attachment portion 116 and the second sling attachment portion 118 may selectively couple a subject sling to the sling bar 100, as described herein. In particular, each of the first sling attachment portion 116 and the second sling attachment portion 118 may be sized and/or dimensioned to couple to one or more than one sling loop (e.g., sling loop 133 including a hoop portion 135 depicted in phantom in FIG. 1) of one or more than one subject sling as described more fully herein.

In view of FIG. 1, the first sling attachment portion 116 may extend from the first bar portion 104 (e.g., at or near the first end 112) in generally the first longitudinal direction (e.g., in the +X direction of the coordinate axes of FIG. 1) a first predetermined distance, extend (e.g., hook upward) in generally the first vertical direction (e.g., in the +Y direction of the coordinate axes of FIG. 1) a second predetermined distance, and extend back (e.g., hook back) in generally the second longitudinal direction (e.g., in the −X direction of the coordinate axes of FIG. 1) toward the first bar portion 104 a third predetermined distance to define a first receiving aperture 138. Similarly in view of FIG. 1, the second sling attachment portion 118 may extend from the second bar portion 106 (e.g., at or near the second end 114) in generally the second longitudinal direction (e.g., in the −X direction of the coordinate axes of FIG. 1) the first predetermined distance, extend (e.g., hook upward) in generally the first vertical direction (e.g., in the +Y direction of the coordinate axes of FIG. 1) the second predetermined distance, and extend back (e.g., hook back) in generally the first longitudinal direction (e.g., in the +X direction of the coordinate axes of FIG. 1) toward the second bar portion 106 the third predetermined distance to define a second receiving aperture 140. As introduced herein, each of the first sling attachment portion 116 and the second sling attachment portion 118 may be sized and/or dimensioned to couple to one or more than one sling loop (e.g., sling loop 133 having a hoop portion 135 depicted in phantom in FIG. 1). Accordingly, the first predetermined distance, the second predetermined distance, and/or the third predetermined distance may be based on various parameters (e.g., thickness, width, elasticity, and/or the like) of one or more than one sling loop. Accordingly, a plurality of sling bars 100 may be manufactured to include a first sling attachment portion 116 and a second sling attachment portion 118, where each sling bar 100 has a different first, second and/or third predetermined distance. According to various aspects, the first, second, and/or third predetermined distance may be based on a combination of parameters associated with one or more than one sling loop anticipated to couple to the first sling attachment portion 116 and the second sling attachment portion 118. Furthermore, the plurality of sling bars 100 may be manufactured where each sling bar 100 has a different overall length. Here, each overall length may be based on a combination of parameters associated with a subject sling anticipated to couple to each sling bar.

In light of FIG. 1, various components of the sling bar 100 including the hub portion 102, the first bar portion 104, the second bar portion 106, the first sling attachment portion 116, and/or the second sling attachment portion 118 may be defined by a material capable of withstanding anticipated static and/or dynamic forces on the sling bar 100 without fatigue and/or failure of such various components. According to various aspects, each component may be dimensioned to withstand, alone and/or in combination with other components, the anticipated static and/or dynamic forces. In some aspects, the various components of the sling bar 100 including the hub portion 102, the first bar portion 104, the second bar portion 106, the first sling attachment portion 116, and/or the second sling attachment portion 118 may be defined by a cast aluminum, steel, a metal alloy, and/or the like.

Still referring to FIG. 1, the sling bar 100 may further include a first retention latch 120 positioned at or near the first end 112, in the first vertical direction (e.g., in the +Y direction of the coordinate axes of FIG. 1), of the first bar portion 104 and a second retention latch 122 positioned at or near the second end 114, in the first vertical direction (e.g., in the +Y direction of the coordinate axes of FIG. 1), of the second bar portion 106. In view of FIG. 1, a proximal end (e.g., in the −X direction of the coordinate axes of FIG. 1) of the first retention latch 120 may be pivotally coupled (e.g., via a first pin 125 or the like) to the first bar portion 104 and a distal end (e.g., in the +X direction of the coordinate axes of FIG. 1) of the first retention latch 120 may define a first engagement face 124 (see also FIG. 4) that selectively interfaces with a first stop surface 126 (see also FIG. 4) of the first sling attachment portion 116. As depicted in FIG. 1, the first engagement face 124 of the first retention latch 120 may interfere with the first stop surface 126 of the first sling attachment portion 116 such that the first retention latch 120 is constrained to pivot between an open position and a closed position. In particular, the first retention latch 120 may pivot (e.g., about first pin 125) in a clockwise direction about a second axis (e.g., axis B-B as depicted in FIG. 1) until a body of the first retention latch 120 interfaces with a surface of the first bar portion 104 (e.g., the open position) and to pivot (e.g., about first pin 125) in a counter-clockwise direction about the second axis until the first engagement face 124 interfaces with the first stop surface 126 (e.g., the closed position). The interface between the first engagement face 124 and the first stop surface 126 restrains any of one or more than one sling loop (not shown) coupled to (e.g., hooked onto) the first sling attachment portion 116 to prevent any of the one or more than one sling loop from inadvertently slipping out of the first sling attachment portion 116 in the closed position. In some aspects, as further described herein, a mechanical device (not shown, see FIG. 4, first spring 426) may actively generate a first closing force that causes the first engagement face 124 to interface with the first stop surface 126 (e.g., a default closed position). In some aspects, the mechanical device may be configured to generate a first closing force capable of pivoting the first retention latch 120 from the open position to the closed position and capable of maintaining the first engagement face 124 in contact with the first stop surface 126 until a first insertion force is applied to the first retention latch 120. In such aspects, the first insertion force may be capable of pivoting the first retention latch 120 (e.g., directly by a user and/or indirectly via a sling loop) from the closed position toward the open position. According to various aspects, the first insertion force may be a predetermined force (e.g., a set force). In other aspects, the first insertion force may be an average force capable of being generated via one hand by an average user of the sling bar 100. In yet further aspects, the first insertion force may be a predetermined force greater than a minimum force (e.g., the hanging weight of one or more than one sling loop and/or its associated sling positioned on a first actuation surface 134 of the first retention latch 120).

Similarly, in view of FIG. 1, a proximal end (e.g., in the +X direction of the coordinate axes of FIG. 1) of the second retention latch 122 may be pivotally coupled (e.g., via a second pin 128 or the like) to the second bar portion 106 and a distal end (e.g., in the −X direction of the coordinate axes of FIG. 1) of the second retention latch 122 may define a second engagement face 130 (see also FIG. 4) that selectively interfaces with a second stop surface 132 (see also FIG. 4) of the second sling attachment portion 118. As depicted in FIG. 1, the second engagement face 130 of the second retention latch 122 may interfere with the second stop surface 132 of the second sling attachment portion 118 such that the second retention latch 122 is constrained to pivot between an open position and a closed position. In particular, the second retention latch 122 may pivot (e.g., about second pin 128) in a counter-clockwise direction about a third axis (e.g., axis C-C as depicted in FIG. 1) until a body of the second retention latch 122 interfaces with a surface of the second bar portion 106 (e.g., the open position) and to pivot (e.g., about second pin 128) in a clockwise direction about the third axis until the second engagement face 130 interfaces with the second stop surface 132 (e.g., the closed position). The interface between the second engagement face 130 and the second stop surface 132 restrains any of one or more than one sling loop (not shown) coupled to (e.g., hooked onto) the second sling attachment portion 118 to prevent any of the one or more than one sling loop from inadvertently slipping out of the second sling attachment portion 118 in the closed position. In some aspects, as further described herein, a mechanical device (not shown, see FIG. 4, second spring 446) may actively generate a second closing force that causes the second engagement face 130 to interface with the second stop surface 132 (e.g., a default closed position). In some aspects, the mechanical device may be configured to generate a second closing force capable of pivoting the second retention latch 122 from the open position to the closed position and capable of maintaining the second engagement face 130 in contact with the second stop surface 132 until a second insertion force is applied to the second retention latch 122. In such aspects, the second insertion force may be capable of pivoting the second retention latch 122 (e.g., directly by a user and/or indirectly via a sling loop) from the closed position toward the open position. According to various aspects, the second insertion force may be a predetermined force (e.g., a set force). In other aspects, the second insertion force may be an average force capable of being generated via one hand by an average user of the sling bar 100. In yet further aspects, the second insertion force may be a predetermined force greater than a minimum force (e.g., the hanging weight of one or more than one sling loop and/or its associated sling positioned on a second actuation surface 136 of the second retention latch 122).

In view of FIG. 1, the first retention latch 120 of the sling bar 100 may be defined by a material capable of maintaining the interface between the first engagement face 124 and the first stop surface 126, as described herein (e.g., to prevent one or more than one sling loop from inadvertently slipping out of the first sling attachment portion 116). For example, the material of the first retention latch 120 should not break, flex/deflect laterally (e.g., in the +Z and/or −Z direction of the coordinate axes of FIG. 1) and/or deform vertically (e.g., in the +Y and/or −Y direction of the coordinate axes of FIG. 1) such that the first engagement face 124 of the first retention latch 120 is able to pivot (e.g., about first pin 125) in a counter-clockwise direction about the second axis (e.g., axis B-B depicted in FIG. 1) past the first stop surface 126 of the first sling attachment portion 116. In some aspects, the first retention latch 120 may be defined by a cast aluminum, a laser cut steel, and/or the like.

Similarly, the second retention latch 122 of the sling bar 100 may be defined by a material capable of maintaining the interface between the second engagement face 130 and the second stop surface 132, as described herein (e.g., to prevent one or more than one sling loop from inadvertently slipping out of the second sling attachment portion 118). For example, the material of the second retention latch 122 should not break, flex/deflect laterally (e.g., in the +Z and/or −Z direction of the coordinate axes of FIG. 1) and/or deform vertically (e.g., in the +Y and/or −Y direction of the coordinate axes of FIG. 1) such that the second engagement face 130 of the first retention latch 120 is able to pivot (e.g., about second pin 128) in a clockwise direction about the third axis (e.g., axis C-C depicted in FIG. 1) past the second stop surface 132 of the second sling attachment portion 118. In some aspects, the second retention latch 122 may be defined by a cast aluminum, a laser cut steel, and/or the like.

It should be appreciated that, as depicted in FIG. 1, the alignment of the first actuation surface 134 of the first retention latch 120 with an upper surface of the first sling attachment portion 116 and an upper surface of the first bar portion 104 is substantially continuous when the first retention latch 120 is in the closed position so as to provide a smooth transition from the upper surface of the first sling attachment portion 116 to the first bar portion 104 to avoid situations where the first sling attachment portion 116 may provide an impalement hazard. Similarly, the alignment of the second actuation surface 136 of the second retention latch 122 with an upper surface of the second sling attachment portion 118 and an upper surface of the second bar portion 106 is substantially continuous when the second retention latch 122 is in the closed position so as to provide a smooth transition from the upper surface of the second sling attachment portion 118 to the second bar portion 106 to avoid situations where the second sling attachment portion 118 may provide an impalement hazard.

FIG. 2 depicts a perspective view of an illustrative lift system 200 including the sling bar 100 of FIG. 1 coupled to a subject lift 202, according to various aspects of the present disclosure. In view of FIG. 2, the subject lift 202 (e.g., an overhead lift) may include a lift mechanism 204 coupled to a lift strap 206. A sling bar attachment mechanism 208 may be coupled to the lift strap 206. As described herein, one of the plurality of modular lift hooks 306 (see FIG. 3, e.g., a first lift hook 142 is depicted in FIG. 2) may removably couple to the sling bar attachment mechanism 208. The lift mechanism 204 may wind down (e.g., pay out) the lift strap 206 to lower the sling bar 100 (e.g., and a subject sling coupled thereto as described herein) and/or wind up (e.g., take up) the lift strap 206 to raise the sling bar 100 (e.g., and the subject sling coupled thereto as described herein). A lift control device 210 may be communicatively coupled (e.g., wired or wirelessly) to the lift mechanism 204 to control operation of the lift mechanism 204. The lift control device 210 may include a magnet 212 to removably couple the lift control device 210 to the sling bar 100, as described herein.

Figure 3:
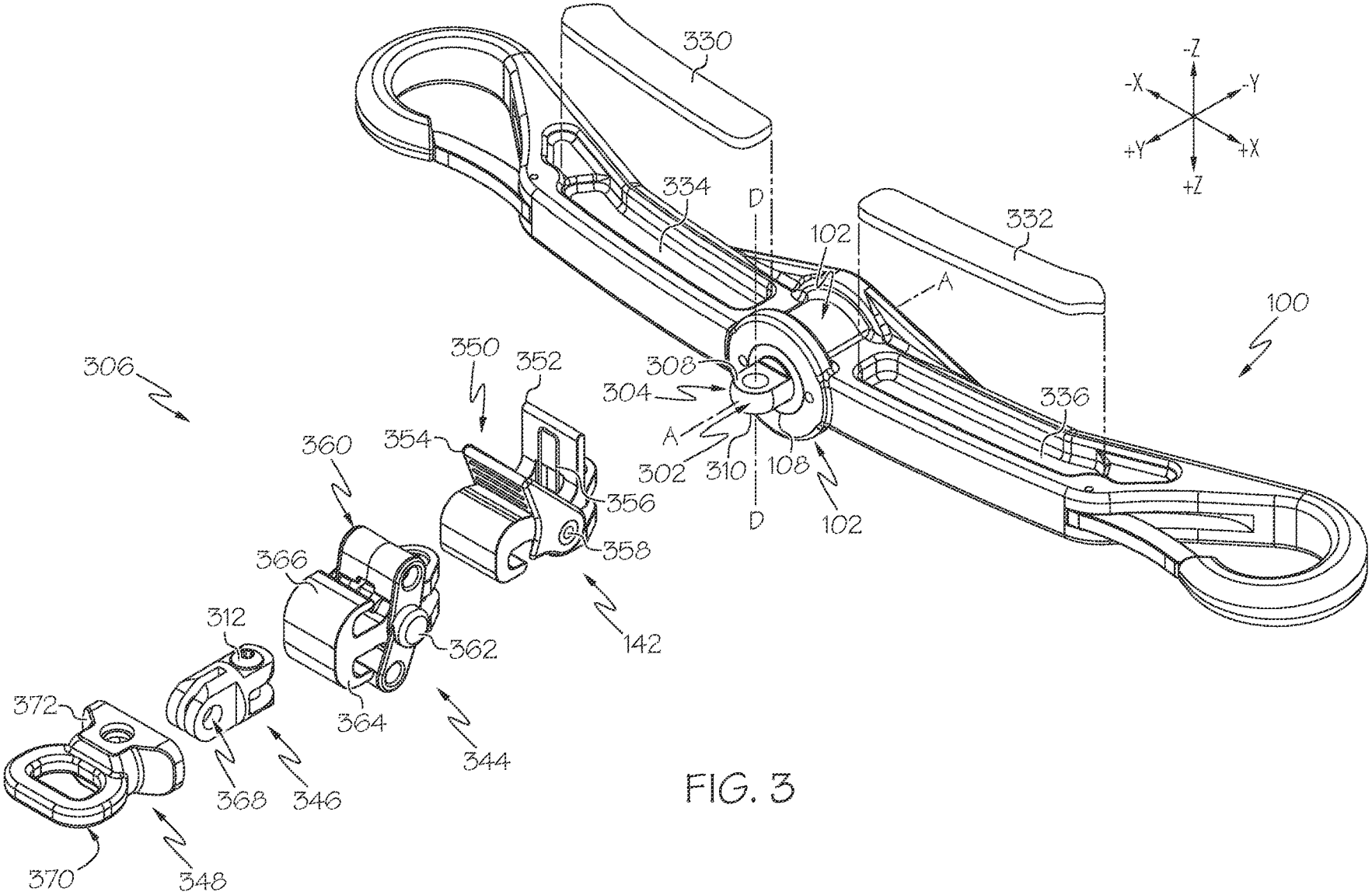
FIG. 3 depicts an exploded view of the illustrative sling bar of FIG. 1 according to one or more aspects shown and described herein.

FIG. 3 depicts an exploded view of the illustrative sling bar 100 of FIG. 1, according to one or more aspects of the present disclosure. Referring to FIG. 3, in light of FIG. 1, the first lift hook 142 is shown as detached from the sling bar 100 to illustrate a plurality of modular lift hooks 306. For example, the plurality of modular lift hooks 306 may further include a second lift hook 344, a third lift hook 346, and a fourth lift hook 348. In view of FIG. 3, a rotatable shaft 302 is insertable within the hub portion 102 of the sling bar 100. The rotatable shaft 302 may be rotatably coupled to an internal hub surface 108 of the hub portion 102 such that the sling bar 100 is rotatable (e.g., in the X-Z plane of the coordinate axes of FIG. 3) about the first axis (e.g., axis A-A as depicted in FIG. 3). A connector portion 304 (e.g., in the +Y direction of the coordinate axes of FIG. 3) of the rotatable shaft 302 may be arranged to couple to each of the plurality of modular lift hooks 306 (e.g., including the first lift hook 142, the second lift hook 344, the third lift hook 346, and/or the fourth lift hook 348). More specifically, a first connector surface 308 and a second connector surface 310 may be defined on the connector portion 304 to receive each of the plurality of modular lift hooks 306. According to various aspects, the first connector surface 308 and the second connector surface 310 are substantially parallel to one another (e.g., in the X-Y plane of the coordinate axes of FIG. 3). In such aspects, the first connector surface 308 and the second connector surface 310 may enable the sling bar 100 to pivot (e.g., in the X-Y plane of the coordinate axes of FIG. 3) about a fourth axis (e.g., axis D-D as depicted in FIG. 3). According to various aspects, the ability to pivot about the fourth axis (e.g., axis D-D as depicted in FIG. 3) may enable the sling bar 100 to facilitate an uneven loading of the sling bar 100 (e.g., resulting from different configurations of the subject sling and/or different positions of the subject on the subject sling). In light of FIG. 3, each of the plurality of modular lift hooks 306 may be coupled (e.g., via a screw 312) to the connector portion 304 of the rotatable shaft 302.

As described herein, the plurality of modular lift hooks 306 may include the first lift hook 142, the second lift hook 344, the third lift hook 346, and/or the fourth lift hook 348. In view of FIG. 3, the first lift hook 142 may include a quick release mechanism 350. More specifically, a user (e.g., caregiver) may use one hand to grasp a protrusion 352 and a quick release lever 354 of the quick release mechanism 350 to pivot the quick release lever 354 (e.g., in opposition to a spring 356) about a pivot 358 to an open position to release the first lift hook 142 (e.g., and any sling bar coupled thereto) from a sling bar attachment mechanism 208 coupled to a lift strap 206 of a subject lift 202 (See e.g., FIG. 2). The user may similarly use one hand to pivot the quick release lever 354 about the pivot 358 to recouple the first lift hook 142 to the sling bar attachment mechanism 208 (FIG. 2). In such an aspect, the spring 356 may automatically pivot the quick release lever 354 about the pivot 358 to a closed position. Next, in view of FIG. 3, the second lift hook 344 may include a toggle mechanism 360. More specifically, a user may use one hand to switch the toggle mechanism 360 about a pivot 362 to an open position to release the second lift hook 344 (e.g., and any sling bar coupled thereto) from a sling bar attachment mechanism 208 coupled to a lift strap 206 of a subject lift 202 (See e.g., FIG. 2). In the open position, the user may similarly use one hand to switch the toggle mechanism 360 about the pivot 362 to a closed position to recouple the second lift hook 344 to the sling bar attachment mechanism 208 (FIG. 2). In view of FIG. 3, the second lift hook 344 includes a first hook 364 and a second hook 366, each offset from a centerline of the second lift hook 344. Accordingly, the second lift hook 344 may be decoupled and recoupled to the sling bar attachment mechanism 208 (FIG. 2), as described herein, to redistribute a subject load. The first lift hook 142 and the second lift hook 344, as described herein, permit the user (e.g., caregiver) to efficiently couple and/or decouple the first lift hook 142 and the second lift hook 344, respectively without a need for tools. Next in view of FIG. 3, the third lift hook 346 may include an aperture 368. More specifically, a user may insert a fastener (e.g., screw) into the aperture 368 to couple and/or decouple the third lift hook 346 (e.g., and any sling bar coupled thereto) to a sling bar attachment mechanism 208 coupled to a lift strap 206 of a subject lift 202 (See e.g., FIG. 2). Here, the sling bar attachment mechanism 208 may include an aperture (not shown) to receive a fastener (e.g., screw) to couple the third lift hook 346 to the sling bar attachment mechanism 208. Next, in view of FIG. 3, the fourth lift hook 348 (e.g., contrary to the first lift hook 142, the second lift hook 344, and the third lift hook 346) may include a ring portion 370 as well as a base portion 372 that inhibits the sling bar 100 from pivoting (e.g., in the X-Y plane of the coordinate axes of FIG. 3) about the fourth axis (e.g., axis D-D as depicted in FIG. 3) while permitting the sling bar 100 to rotate about the first axis (e.g., axis A-A as depicted in FIG. 3). More specifically, a user may utilize the ring portion 370 to couple and/or decouple the fourth lift hook 348 (e.g., and any sling bar coupled thereto) to a sling bar attachment mechanism 208 coupled to a lift strap 206 of a subject lift 202 (See e.g., FIG. 2). Here, the sling bar attachment mechanism 208 may include a hook or clip (not shown) to couple and/or decouple the fourth lift hook 348 to the sling bar attachment mechanism 208.

Still referring to FIG. 3, the sling bar 100 may further include one or more than one bar insert. In some aspects, the one or more than one bar insert may be integrated into and/or part of the sling bar 100. In other aspects, the one or more than one bar insert may be coupled to the sling bar 100. For example, each of a first bar insert 330 and/or a second bar insert 332 may be coupled to a portion of the sling bar 100. More specifically, in light of FIG. 3, the first bar insert 330 may shaped and/or sized to couple to and/or fit within a first bar cavity 334 defined in the sling bar 100 and the second bar insert 332 may be shaped and/or sized to couple to and/or fit within a second bar cavity 336 defined in the sling bar 100.

It should be appreciated that the first/second bar inserts 330, 332 may be shaped and/or sized to couple to and/or fit within other bar cavities (e.g., further on an opposite side of the sling bar 100 to accommodate up to four bar inserts, in the +Z direction of the coordinate axes of FIG. 3). In some aspects, the various bar inserts 330, 332 may be more centrally located (e.g., inboard, toward the hub portion 102) on the sling bar 100 to avoid interference with the various sling attachment portions, as described herein. According to various aspects, each of the first bar insert 330 and the second bar insert 332 may comprise a ferrous material (e.g., a steel insert). In such aspects, referring briefly to FIG. 2, a lift control device 210 (e.g., hand control unit) associated with a subject lift 202 to which the sling bar 100 is coupled may include a magnet 212. Further in such aspects, the magnet 212 of the lift control device may be coupled to the first bar insert 330 and/or the second bar insert 332 to selectively stow/store the lift control device 210 (e.g., a specific placement over hanging from the subject lift 202), to provide easy access to the lift control device 210 (e.g., at a convenient location when using the sling bar 100), and/or to enable single-hand use of the lift control device 210 (e.g., no need to grasp the lift control device 210 with one hand and execute controls with another hand). It should be understood that a bar insert 330, 332 may be selectively integrated into and/or coupled to the sling bar 100 at another portion of the sling bar 100. In some aspects, the sling bar 100 itself may be defined using a ferrous material such that a magnet 212 of the lift control device 210 may couple to any portion, surface, and/or cavity of the sling bar 100 for stowing and/or storing the lift control device 210.

Figure 4:
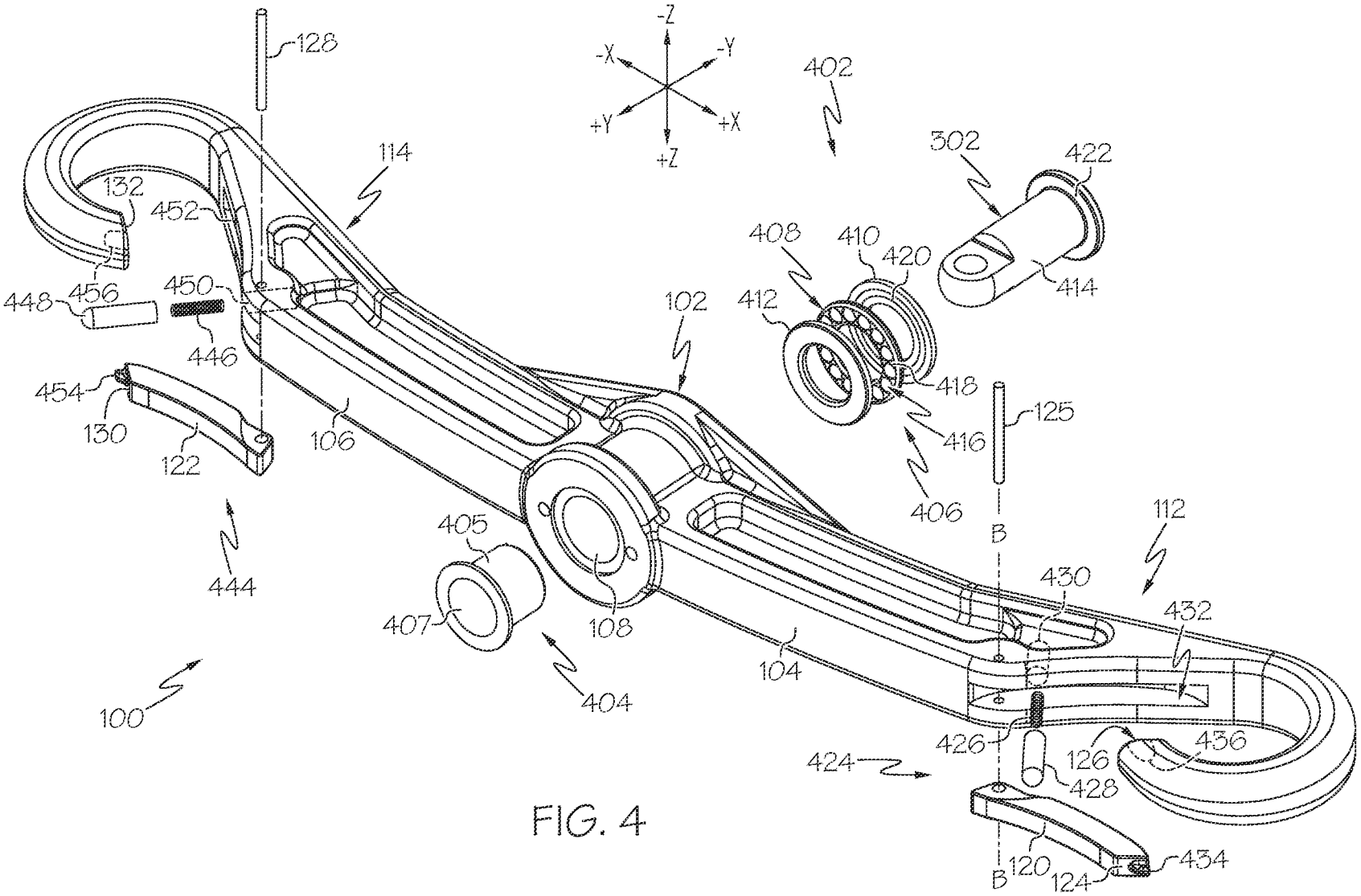
FIG. 4 depicts another exploded view of the illustrative sling bar of FIG. 1 according to one or more aspects shown and described herein.

FIG. 4 depicts another exploded view of the illustrative sling bar 100 of FIG. 1, according to various aspects of the present disclosure. In view of FIG. 4, a rotatable shaft assembly 402 as well as a first retention latch assembly 424 and a second retention latch assembly 444 of the sling bar 100 are shown in exploded view.

Referring to FIG. 4, the rotatable shaft assembly 402 may include a shaft bushing 404, a shaft bearing 406 and the rotatable shaft 302 as described herein. In view of FIG. 4, an outer cylindrical surface 405 of the shaft bushing 404 may be dimensioned to be positioned from a first side (e.g., in the +Y direction of the coordinate axes of FIG. 4) of the sling bar 100 within the internal hub surface 108 of the hub portion 102 of the sling bar 100 and an inner cylindrical surface 407 of the shaft bushing 404 may be dimensioned to rotatably receive an outer cylindrical surface 414 of the rotatable shaft 302. Further in view of FIG. 4, the shaft bearing 406 may include a bearing cage 408 positioned between a first bearing ring 410 and a second bearing ring 412. In light of FIG. 4, the bearing cage 408 may include a plurality of bearings 416 positioned within a cage structure 418 that separates and guides movement of the plurality of bearings 416. Each of the first bearing ring 410 and the second bearing ring 412 may include a raceway 420 to further guide movement of the plurality of bearings 416. An inner diameter of each of the first bearing ring 410 and the second bearing ring 412 may be dimensioned to fittingly receive the outer cylindrical surface 414 of the rotatable shaft 302. Further referring to FIG. 4, the rotatable shaft 302 may further include a flange 422 that rotatably interfaces with a second side (e.g., in the −Y direction of the coordinate axes of FIG. 4) of the first bearing ring 410.

Viewing FIG. 4 in light of FIGS. 1 and 3, upon attachment of one of the plurality of modular lift hooks 306 to the connector portion 304 of the rotatable shaft 302, a plurality of respective sling bar modules may be defined (e.g., a first sling bar module including the sling bar 100, the rotatable shaft assembly 402, and the first lift hook 142, a second sling bar module including the sling bar 100, the rotatable shaft assembly 402, and the second lift hook 344, a third sling bar module including the sling bar 100, the rotatable shaft assembly 402, and the third lift hook 346, and a fourth sling bar module including the sling bar 100, the rotatable shaft assembly 402, and the fourth lift hook 348).

Referring still to FIG. 4, the first retention latch assembly 424 may include a first spring 426 (e.g., a mechanical device), a first latch spring cover 428, as well as the first retention latch 120 and first pin 125 as described herein. In view of FIG. 4, a first spring aperture 430 and a first latch slot 432 may be further defined in the first bar portion 104 at the first end 112 of the sling bar 100. The first spring aperture 430 may be dimensioned to slidingly receive an outer cylindrical surface of the first latch spring cover 428 and an inner cylindrical surface of the first latch spring cover 428 may be dimensioned to fittingly receive the first spring 426. In light of FIG. 4, as the first retention latch 120 is rotated in a first direction (e.g., toward the first latch slot 432) the first retention latch 120 interfaces with the first latch spring cover 428 such that the first latch spring cover 428 slides into the first spring aperture 430 and compresses the first spring 426 until the first retention latch 120 seats within the first latch slot 432. Further in light of FIG. 4, the first retention latch 120 may be shaped (e.g., curved) to mimic the first bar portion 104 at the first end 112 of the sling bar 100 (e.g., to create an expanded area for insertion of one or more than one sling hoop). Potential energy stored in the compressed first spring 426 may force the first latch spring cover 428 to interface with the first retention latch 120 to automatically rotate the first retention latch 120 in a second direction (e.g., away from the first latch slot 432) such that the first latch spring cover 428 slides out of the first spring aperture 430 until the first engagement face 124 of the first retention latch 120 interferingly interfaces with the first stop surface 126 of the first sling attachment portion 116. Further in view of FIG. 4, the first engagement face 124 may include a first lock protrusion 434 and the first stop surface 126 may include a first lock aperture 436 shaped to receive the first lock protrusion 434. According to various aspects, the first lock protrusion 434 when inserted within the first lock aperture 436 may further maintain the first retention latch 120 in the closed position. According to various aspects, the first spring 426 may be configured to produce a first closing force, as described herein, between the first engagement face 124 and the first stop surface 126. According to such aspects, the first closing force may be overcome (e.g., to access the first receiving aperture 138) by a first insertion force, as described herein (e.g., an average force capable of being generated via one hand by an average user (e.g., caregiver)).

Similarly, the second retention latch assembly 444 may include a second spring 446 (e.g., a mechanical device), a second latch spring cover 448, as well as the second retention latch 122 and second pin 128 as described herein. In view of FIG. 4, a second spring aperture 450 and a second latch slot 452 may be further defined in the second bar portion 106 at the second end 114 of the sling bar 100. The second spring aperture 450 may be dimensioned to slidingly receive an outer cylindrical surface of the second latch spring cover 448 and an inner cylindrical surface of the second latch spring cover 448 may be dimensioned to fittingly receive the second spring 446. In light of FIG. 4, as the second retention latch 122 is rotated in a first direction (e.g., toward the second latch slot 452) the second retention latch 122 interfaces with the second latch spring cover 448 such that the second latch spring cover 448 slides into the second spring aperture 450 and compresses the second spring 446 until the second retention latch 122 seats within the second latch slot 452. Further in light of FIG. 4, the second retention latch 122 may be shaped (e.g., curved) to mimic the second bar portion 106 at the second end 114 of the sling bar 100 (e.g., to create an expanded area for insertion of one or more than one sling hoop). Potential energy stored in the compressed second spring 446 may force the second latch spring cover 448 to interface with the second retention latch 122 to automatically rotate the second retention latch 122 in a second direction (e.g., away from the second latch slot 452) such that the second latch spring cover 448 slides out of the second spring aperture 450 until the second engagement face 130 of the second retention latch 122 interferingly interfaces with the second stop surface 132 of the second sling attachment portion 118. Further in view of FIG. 4, the second engagement face 130 may include a second lock protrusion 454 and the second stop surface 132 may include a second lock aperture 456 shaped to receive the second lock protrusion 454. According to various aspects, the second lock protrusion 454 when inserted within the second lock aperture 456 may further maintain the second retention latch 122 in the closed position. According to various aspects, the second spring 446 may be configured to produce a second closing force, as described herein, between the second engagement face 130 and the second stop surface 132. According to such aspects, the second closing force may be overcome (e.g., to access the second receiving aperture 140) by a second insertion force, as described herein (e.g., an average force capable of being generated via one hand by an average user (e.g., caregiver)).

FIG. 5 depicts a perspective view of an illustrative sling bar assembly 500 including a plurality of sling attachment portions 526, 528, 546, 548, according to various aspects of the present disclosure. In view of FIG. 5, the sling bar assembly 500 may include a first sling bar 510, a second sling bar 530, and a sling bar coupler 550. The sling bar coupler 550 may couple the first sling bar 510 and the second sling bar 530. As illustrated in FIG. 5, the first sling bar 510 may extend a relatively shorter distance in the first longitudinal direction (e.g., in the +X direction of the coordinate axes of FIG. 5) and the second longitudinal direction (e.g., in the −X direction of the coordinate axes of FIG. 5) while the second sling bar 530 may extend a relatively longer distance in the first longitudinal direction (e.g., in the +X direction of the coordinate axes of FIG. 5) and the second longitudinal direction (e.g., in the −X direction of the coordinate axes of FIG. 5). The respective distances that each of the first sling bar 510 and the second sling bar 530 extend in the first longitudinal direction and the second longitudinal direction, respectively, is non-limiting (e.g., may be the same or different distances) and may be based on the subject sling to be coupled to the sling bar assembly 500 and/or various subject positions (e.g., laying, sitting, and/or the like) to be realized via the subject sling. It should be appreciated that each of the first sling bar 510, the second sling bar 530, and the sling bar coupler 550 may similarly include the various components as already described herein with respect to the sling bar 100 of FIG. 1. For example, the first sling bar 510 may include a first sling attachment portion 526 and a second sling attachment portion 528 and the second sling bar 530 may include a third sling attachment portion 546 and a fourth sling attachment portion 548 such that the sling bar assembly 500 of FIG. 5 includes four sling attachment portions each for coupling various sling loops of a subject sling as described herein. Further in light of FIG. 5, it should be understood that the sling bar coupler 550 may, in some aspects, couple two first sling bars 510 together and, in other aspects, couple two second sling bars 520 together. Accordingly, the sling bar assembly 500 of the present disclosure should not be limited to the sling bar assembly 500 as depicted in FIG. 5.

Referring still to FIG. 5, each of the first sling bar 510 and the second sling bar 530 may deflect laterally relative to a central plane (e.g., parallel to the X-Y plane depicted in FIG. 5) defined through the first axis (e.g., axis A-A as depicted in FIG. 5). More specifically, a first portion 514 of the first sling bar 510 may deflect a first angle (e.g., an angle in the +Z direction of the coordinate axes of FIG. 5) relative to the central plane and a second portion 516 of the first sling bar 510 may deflect a second angle (e.g., an angle in the +Z direction of the coordinate axes of FIG. 5) relative to the central plane. Similarly, a first portion 534 of the second sling bar 530 may deflect a third angle (e.g., an angle in the −Z direction of the coordinate axes of FIG. 5) relative to the central plane and a second portion 536 of the second sling bar 530 may deflect a fourth angle (e.g., an angle in the −Z direction of the coordinate axes of FIG. 5) relative to the central plane. In some aspects, each of the first angle, the second angle, the third angle, and/or the fourth angle may be substantially equal (e.g., a predetermined acute angle). In other aspects, each of the first angle, the second angle, the third angle, and/or the fourth angle, may be different. The respective deflection angles are non-limiting and may be based on the subject sling to be coupled to the sling bar assembly 500 and/or various subject positions (e.g., laying, sitting, and/or the like) to be realized via the subject sling.

It should be appreciated that, as depicted in FIG. 5, the alignment of the actuation surfaces of the retention latches with upper surfaces of the sling attachment portions and upper surfaces of the bar portions are, respectively, substantially continuous when the retention latches are in the closed position so as to provide a smooth transition from the respective upper surfaces of the sling attachment portions to the bar portions to avoid situations where the sling attachment portions may provide an impalement hazard.

Figure 6:
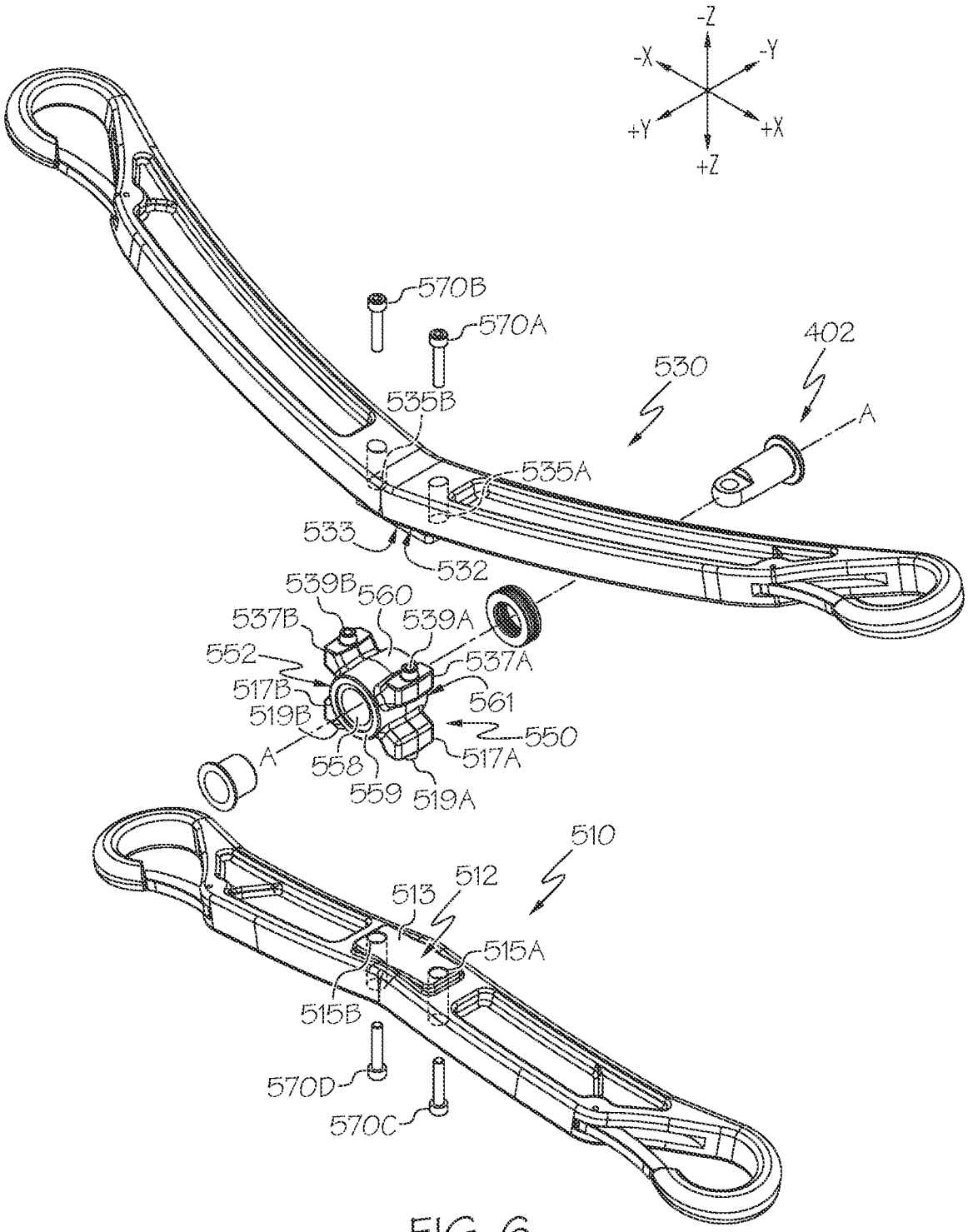
FIG. 6 depicts an exploded view of the illustrative sling bar assembly of FIG. 5 according to one or more aspects shown and described herein.

FIG. 6 depicts an exploded view of the illustrative sling bar assembly 500 of FIG. 5, according to various aspects of the present disclosure. In view of FIG. 6, a first lateral protrusion 512 (e.g., in the −Z direction of the coordinate axes of FIG. 6) may be defined on a central portion of the first sling bar 510 to removably couple the first sling bar 510 to the sling bar coupler 550. A first mating surface 513 may be defined on the first lateral protrusion 512 and a plurality of lock apertures 515A, 515B may be defined in the first mating surface 513. Similarly, a second lateral protrusion 532 (e.g., in the +Z direction of the coordinate axes of FIG. 6) may be defined on a central portion of the second sling bar 530 to removably couple the second sling bar 530 to the sling bar coupler 550. A second mating surface 533 may be defined on the second lateral protrusion 532 and a plurality of lock apertures 535A, 535B may be defined in the second mating surface 533.

Still referring to FIG. 6, the sling bar coupler 550 may include a hub portion 552 defined, concentrically, about the first axis (e.g., axis A-A as depicted in FIG. 6). The hub portion 552 may define an internal hub surface 558 and an external hub surface 560. Each of the internal hub surface 558 and the external hub surface 560 may be generally cylindrically shaped and extend about the first axis (e.g., axis A-A) between a first surface 559 (e.g., in the +Y direction of the coordinate axes of FIG. 6) and a second surface 561 (e.g., in the −Y direction of the coordinate axes of FIG. 6).

In view of FIG. 6, a plurality of first bar attachment protrusions 517A, 517B may extend (e.g., axially) from the external hub surface 560 of the hub portion 552. A respective lock protrusion 519A, 519B may be defined on each first bar attachment protrusions 517A, 517B. Each lock protrusion 519A, 519B may be shaped for insertion within a respective lock apertures 515A, 515B of the first sling bar 510. According to various aspects, the plurality of lock protrusions 519A, 519B when inserted within the plurality of lock apertures 515A, 515B may locate the first sling bar 510 in position relative to the sling bar coupler 550 and prevent rotation (e.g., in the X-Y plane of the coordinate axes of FIG. 6) of the first sling bar 510 relative to the sling bar coupler 550. Similarly, a plurality of second bar attachment protrusions 537A, 537B may extend (e.g., axially) from the external hub surface 560 of the hub portion 552. A respective lock protrusion 539A, 539B may be defined on each second bar attachment protrusion 537A, 537B. Each lock protrusion 539A, 539B may be shaped for insertion within a respective lock aperture 535A, 535B of the second sling bar 530. According to various aspects, the plurality of lock protrusions 539A, 539B when inserted within the plurality of lock apertures 535A, 535B may locate the second sling bar 530 in position relative to the sling bar coupler 550 and prevent rotation (e.g., in the X-Y plane of the coordinate axes of FIG. 6) of the second sling bar 530 relative to the sling bar coupler 550. As further depicted in FIG. 6, the internal hub surface 558 of the hub portion 552 of the sling bar coupler 550 may receive the rotatable shaft assembly 402 (e.g., similar to as described in FIG. 4 herein).

Referring still to FIG. 6, the first sling bar 510 and the second sling bar 530 may be removably coupled to the sling bar coupler 550 via a plurality of threaded fasteners 570A, 570B, 570C, 570D (e.g., machined screws). In such aspects, a threaded aperture may be defined within each respective lock protrusion 519A, 519B, 539A, 539B to receive each respective threaded fastener 570A, 570B, 570C, 570D.

FIG. 7A depicts a perspective view of an illustrative positional retention latch 700 in an open position, according to various aspects of the present disclosure. In view of FIG. 7A, the positional retention latch 700 may include a pivotable latch body 702 that pivots about a third pin 704. More specifically, the pivotable latch body 702 may include a first retention member 706 and a second retention member 708. In light of FIG. 7A, the first retention member 706 may extend a first distance from the third pin 704 and the second retention member 708 may extend a second distance from the third pin 704. The first retention member 706 may extend the first distance and the second retention member 708 may extend the second distance at a predetermined angle relative to one another. In some aspects, the predetermined angle may be based one or more than one sling loop (e.g., thicknesses and/or the like) to be received between the first retention member 706 and the second retention member 708. According to various aspects, the first distance and the second distance may be substantially equal. In some aspects, the first distance and the second distance may be such that, as the pivotable latch body 702 pivots about the third pin 704 a distal end of the first retention member 706 and/or a distal end of the second retention member 708 is in close proximity to the sling attachment portion 710 (e.g., similar to the first/second sling attachment portion 116, 118 as described herein). According to various aspects described herein, close proximity may include a closeness such that a sling loop is unable to slide therebetween. In some aspects, the second distance may be greater than the first distance. In one aspect, for example, the second retention member 708 may extend a second distance such that at least a portion of second retention member 708 overlaps (e.g., an underside of) the sling attachment portion 710. In such an aspect, the overlapping portion 711 (e.g., shown in phantom as optional) may restrain the pivotable latch body 702 from pivoting past the overlapping portion 711. Such an aspect may prevent an already inserted sling loop from inadvertently slipping out of the sling attachment portion 710.

Still referring to FIG. 7A, in the open position, the first retention member 706 and the second retention member 708 are positioned for insertion of one or more than one sling loop. In particular, the first retention member 706 may direct or funnel the one or more sling loop toward the second retention member 708. In such aspects, the second retention member 708 may be positioned to actuate the positional retention latch 700 toward the closed position to retain the one or more sling loop within a receiving aperture 712.

FIG. 7B depicts a cross-sectional view of the illustrative positional retention latch 700 of FIG. 7A in the open position, according to various aspects of the present disclosure. In view of FIG. 7B, the pivotable latch body 702 may further include a pivotable base portion 714 that defines a cam surface 716. In light of FIG. 7B, a plurality of detents 718A, 718B may be defined in the cam surface 716 of the pivotable base portion 714. More specifically, a first detent 718A may be located on the cam surface 716 such that the second retention member 708 is in alignment with a bottom surface 709 of a hook end 720 of the sling attachment portion 710. As depicted in FIG. 7B, a third spring 722 (e.g., mechanical device) may be positioned in a spring aperture 724 to continually force a ball 726 (e.g., bearing and/or the like) against the cam surface 716. In light of FIG. 7B, a user (e.g., caregiver) may actuate the positional retention latch 700 by inserting one or more than one sling loop against the second retention member 708 causing the pivotable latch body 702 to pivot about the third pin 704. A pivoting of the pivotable latch body 702 may cause the cam surface 716 to dislodge the ball 726 from the first detent 718A. In light of FIG. 7B, as the pivotable latch body 702 pivots about the third pin 704, the first retention member 706 pivots toward the hook end 720 of the sling attachment portion 710 as the ball 726 continually interfaces the cam surface 716. According to various aspects, the pivoting of the first retention member 706 may capture the one or more than one inserted sling loop (e.g., to ensure that the one or more than one sling loop enters the receiving aperture 712 of FIG. 7A).

FIG. 7C depicts a perspective view of the illustrative positional retention latch 700 of FIG. 7A in a closed position, according to various aspects of the present disclosure. In view of FIG. 7C, in the closed position, the first retention member 706 may be aligned with the hook end 720 of the sling attachment portion 710 and the second retention member 708 may be seated within a retention member slot 732.

FIG. 7D depicts a cross-sectional view of the illustrative positional retention latch 700 of FIG. 7A in the closed position, according to various aspects of the present disclosure. In view of FIG. 7D, in the closed position, the first retention member 706 is in alignment with a top surface 729 of the hook end 720 of the sling attachment portion 710, the second retention member 708 is seated within the retention member slot 732, and the ball 726 is positioned within the second detent 718B. In such aspects, the first retention member 706 is positioned to prevent one or more than one sling loop located within the receiving aperture 712 from inadvertently slipping from the receiving aperture 712. Further, as depicted in FIGS. 7C and 7D for example, the alignment of the first retention member 706 with the top surface 729 of the hook end 720 of the sling attachment portion 710 provides a smooth transition from the upper surface of the body of the sling bar to the hook end 720 of the sling attachment portion 710 to avoid situations where the hook end 720 may provide an impalement hazard.

FIG. 8 depicts a perspective view of another illustrative sling bar including sling attachment portions, according to various aspects of the present disclosure. Referring to FIG. 8, the sling bar 800 may include a hub portion 802, a first bar portion 804, and a second bar portion 806. In such an aspect, the hub portion 802 may be defined, concentrically, about a fifth axis (e.g., axis E-E as depicted in FIG. 8). The hub portion 802 may define an internal hub surface 808 and an external hub surface 810. Each of the internal hub surface 808 and the external hub surface 810 may be generally cylindrically shaped and extend about the fifth axis (e.g., axis E-E) between a first horizontal surface 809 (e.g., in the +Y direction of the coordinate axes of FIG. 8) and a second horizontal surface 811 (e.g., in the −Y direction of the coordinate axes of FIG. 8). The first bar portion 804 may extend from the external hub surface 810 of the hub portion 802 in a first longitudinal direction (e.g., in the +X direction of the coordinate axes of FIG. 8) toward a first end 812, and the second bar portion 806 may extend from the external hub surface 810 of the hub portion 802 in a second longitudinal direction (e.g., in the −X direction of the coordinate axes of FIG. 8) toward a second end 814. Furthermore, the sling bar 800 may include a first bar insert and/or first bar cavity 845 (depicted in phantom as optional) and/or a second bar insert and/or second bar cavity 847 (depicted in phantom as optional), similar to as described herein.

Referring still to FIG. 8, the sling bar 800 may further include a first sling attachment portion 816 positioned at or near the first end 812 of the first bar portion 804 and a second sling attachment portion 818 positioned at or near the second end 814 of the second bar portion 806. The first sling attachment portion 816 and the second sling attachment portion 818 of the sling bar 800 may include a first wireform 830 (e.g., a corkscrew-like wireform). More specifically, the first sling attachment portion 816 may couple to the first end 812 of the first bar portion 804 on the second vertical side (e.g., in the −Y direction of the coordinate axes of FIG. 8) and the second sling attachment portion 818 may couple to the second end 814 of the second bar portion 806 on the second vertical side (e.g., in the −Y direction of the coordinate axes of FIG. 8). According to various aspects, coupling the first sling attachment portion 816 and the second sling attachment portion 818 in vertical alignment with the first bar portion 804 and the second bar portion 806, respectively (e.g., along a plane extending through the fifth axis (axis E-E) parallel to the X-Y plane of the coordinate axes of FIG. 8) may avoid otherwise torsional effects due to non-vertically aligned loads. Each of the first sling attachment portion 816 and the second sling attachment portion 818 may selectively couple a subject sling to the sling bar 800 as described herein. In particular, each of the first sling attachment portion 816 and the second sling attachment portion 818 may be sized and/or dimensioned to couple to one or more than one sling loop of one or more than one subject sling as described more fully herein.

In view of FIG. 8, the first sling attachment portion 816 may extend from the second vertical side (e.g., in the −Y direction of the coordinate axes of FIG. 8) of the first bar portion 804 (e.g., at or near the first end 812) in the second vertical direction (e.g., in the −Y direction of the coordinate axes of FIG. 8) a first predetermined distance and curl as depicted in FIG. 8 (e.g., a corkscrew-like wireform). More specifically, the first sling attachment portion 816 may extend as follows: curl (e.g., generally toward the +X, +Y, −Z octant of the coordinate axes of FIG. 8) at a first predetermined angle a second predetermined distance, curl (e.g., generally toward the −X, +Y, +Z octant of the coordinate axes of FIG. 8) at a second predetermined angle a third predetermined distance, and curl (e.g., generally toward the +X, −Y, −Z octant of the coordinate axes of FIG. 8) a third predetermined angle a fourth predetermined distance to define a first receiving aperture 838. According to various aspects, the first receiving aperture 838 may be sized and/or dimensioned to receive a plurality of sling loops (e.g., up to four sling loops, up to eight sling loops, and/or the like). A sling bar 800 including a first receiving aperture 838 able to accommodate a plurality of sling loops is easily adaptable for different subject lift options (e.g., use of different subject slings, different sling loop configurations for different subject lift positions, and/or the like). Similarly, in view of FIG. 8, the second sling attachment portion 818 may extend from the second vertical side (e.g., in the −Y direction of the coordinate axes of FIG. 8) of the second bar portion 806 (e.g., at or near the second end 814) in the second vertical direction (e.g., in the −Y direction of the coordinate axes of FIG. 8) a first predetermined distance and curl as depicted in FIG. 8 (e.g., a corkscrew-like wireform). More specifically, the second sling attachment portion 818 may extend in the following manner: curl (e.g., generally toward the −X, +Y, +Z octant of the coordinate axes of FIG. 8) at a first predetermined angle a second predetermined distance, curl (e.g., generally toward the −X, +Y, −Z octant of the coordinate axes of FIG. 8) at a second predetermined angle a third predetermined distance, and curl (e.g., generally toward the −X, −Y, +Z octant of the coordinate axes of FIG. 8) a third predetermined angle a fourth predetermined distance to define a second receiving aperture 840. According to various aspects, the second receiving aperture 840 may be sized and/or dimensioned to receive a plurality of sling loops (e.g., up to four sling loops, up to eight sling loops, and/or the like). A sling bar 800 including a second receiving aperture 840 able to accommodate a plurality of sling loops is easily adaptable for different subject lift options (e.g., use of different subject slings, different sling loop configurations for different subject lift positions, and/or the like). As depicted in FIG. 8, the first sling attachment portion 816 may generally curl (e.g., in the +X direction of the coordinate axes of FIG. 8) away from the first end 812 of the first bar portion 804 (e.g., ear-like shape) and the second sling attachment portion 818 may generally curl (e.g., in the −X direction of the coordinate axes of FIG. 8) away from the second end 814 of the second bar portion 806 (e.g., ear-like shape).

As introduced herein, each of the first sling attachment portion 816 and the second sling attachment portion 818 may be sized and/or dimensioned to couple to one or more than one sling loop. Accordingly, the first predetermined distance, the second predetermined distance, the third predetermined distance, the fourth predetermined distance, the first predetermined angle, the second predetermined angle and/or the third predetermined angle may be based on various parameters (e.g., thickness, width, elasticity, and/or the like) of one or more than one sling loop. Accordingly, a plurality of sling bars 800 may be manufactured to include a first sling attachment portion 816 and a second sling attachment portion 818, where each sling bar 800 has a different first, second, third and/or fourth predetermined distance as well as a different first, second and/or third predetermined angle. According to various aspects, the first, second, third, and/or fourth predetermined distance as well as the first, second and/or third predetermined angle may be based on a combination of parameters associated with one or more than one sling loop anticipated to couple to the first sling attachment portion 816 and the second sling attachment portion 818. Furthermore, the plurality of sling bars 800 may be manufactured where each sling bar 800 has a different overall length. Here, each overall length may be based on a combination of parameters associated with a subject sling anticipated to couple to each sling bar.

Referring still to FIG. 8, the first receiving aperture 838 may be defined by a proximal curl portion 836 (e.g., in the −X direction of the coordinate axes of FIG. 8) and a distal curl portion 837 (e.g., in the +X direction of the coordinate axes of FIG. 8). Similarly, the second receiving aperture 840 may be defined by a proximal curl portion 839 (e.g., in the +X direction of the coordinate axes of FIG. 8) and a distal curl portion 841 (e.g., in the −X direction of the coordinate axes of FIG. 8). According to various aspects of the present disclosure, the distal curl portion 837 of the first receiving aperture 838 may be sized and/or dimensioned such that one or more than one sling loop may be placed over the distal curl portion 837 without having to thread the one or more than one sling loop onto the first sling attachment portion 816 (e.g., via a distal end 842 of the first sling attachment portion 816). Accordingly, the one or more than one sling loop (e.g., sling loop 833, depicted in phantom) may drop into a gap between the distal curl portion 837 and the proximal curl portion 836 to be fully seated within the first receiving aperture 838. In such aspects, the distal curl portion 837 of the first receiving aperture 838 may function to retain the one or more than one sling loop within the first receiving aperture 838 such that an inadvertent slip out of the one or more than one sling loop is avoided (e.g., a trap for the sling loop even when no-load conditions exist). Similarly, the distal curl portion 841 of the second receiving aperture 840 may be sized and/or dimensioned such that one or more than one sling loop may be placed over the distal curl portion 841 without having to thread the one or more than one sling loop onto the second sling attachment portion 818 (e.g., via a distal end 844 of the second sling attachment portion 818). Accordingly, the one or more than one sling loop may drop into a gap between the distal curl portion 841 and the proximal curl portion 839 to be fully seated within the second receiving aperture 840. In such aspects, the distal curl portion 841 of the second receiving aperture 840 may function to retain the one or more than one sling loop within the first receiving aperture 840 such that an inadvertent slip out of the one or more than one sling loop is avoided (e.g., a trap for the sling loop even when no-load conditions exist).

In light of FIG. 8, various components of the sling bar 800 including the hub portion 802, the first bar portion 804, the second bar portion 806, the first sling attachment portion 816, and/or the second sling attachment portion 818 may be defined by a material capable of withstanding anticipated static and/or dynamic forces on the sling bar 800 without fatigue and/or failure of such various components. According to various aspects, each component may be dimensioned to withstand, alone and/or in combination with other components, the anticipated static and/or dynamic forces. In some aspects, the various components of the sling bar 800 including the hub portion 802, the first bar portion 804, the second bar portion 806, the first sling attachment portion 816, and/or the second sling attachment portion 818 may be defined by a cast aluminum, steel, a metal alloy, and/or the like. In light of FIG. 8, according to various aspects, the first sling attachment portion 816 and/or the second sling attachment portion 818 may be defined by a solid cylindrical wireform (e.g., stainless steel bar stock bent to shape).

Still referring to FIG. 8, various components of the sling bar 800 have been omitted for ease of illustration. Here it should be appreciated that the sling bar 800 may further include various components (e.g., rotatable shaft assembly 402, one of the plurality of modular lift hooks, and/or the like) as described herein. Further, in view of FIG. 8, the first sling attachment portion 816 and the second sling attachment portion 818 of the first wireform 830 (e.g., as depicted in FIG. 8) may be sized and/or shaped in a substantially same or similar manner. In some aspects, as illustrated in FIG. 8, the distal end 842 of the first sling attachment portion 816 may extend in one lateral direction (e.g., in generally the −Z direction of the coordinate axes of FIG. 8) while the distal end 844 of the second sling attachment portion 818 may extend in another lateral direction (e.g., in generally the +Z direction of the coordinate axes of FIG. 8). In other aspects, the distal end 842 of the first sling attachment portion 816 and the distal end 844 of the second sling attachment portion 818 may both extend in the same or similar lateral direction (e.g., in generally the +Z direction or the −Z direction of the coordinate axes of FIG. 8, the first sling attachment portion 816 and the second sling attachment portion 818 may mirror each other about a Y-Z plane defined through the axis E-E as depicted in FIG. 8).

FIG. 9A depicts a front view of another illustrative sling bar 900 including sling attachment portions, according to various aspects of the present disclosure. Referring to FIG. 9A, the sling bar 900 may include a hub portion 902, a first bar portion 904, and a second bar portion 906. In such an aspect, the hub portion 902 may be defined, concentrically, about a sixth axis (e.g., axis F-F as depicted in FIG. 9A). The hub portion 902 may define an internal hub surface 908 and an external hub surface 910. Each of the internal hub surface 908 and the external hub surface 910 may be generally cylindrically shaped and extend about the sixth axis (e.g., axis F-F) between a first horizontal surface 909 (e.g., in the +Y direction of the coordinate axes of FIG. 9A) and a second horizontal surface 911 (e.g., in the −Y direction of the coordinate axes of FIG. 9A). The first bar portion 904 may extend from the external hub surface 910 of the hub portion 902 in a first longitudinal direction (e.g., in the +X direction of the coordinate axes of FIG. 9A) toward a first end 912, and the second bar portion 906 may extend from the external hub surface 910 of the hub portion 902 in a second longitudinal direction (e.g., in the −X direction of the coordinate axes of FIG. 9A) toward a second end 914. Similar to elsewhere herein, various components of the sling bar 900 have been omitted for ease of illustration. Here it should be appreciated that the sling bar 900 may further include various components (e.g., rotatable shaft assembly 402, one of the plurality of modular lift hooks, and/or the like) as described herein. Furthermore, the sling bar 900 may include a first bar insert and/or first bar cavity 945 (depicted in phantom as optional) and/or a second bar insert and/or second bar cavity 947 (depicted in phantom as optional), similar to as described herein Referring still to FIG. 9A, the sling bar 900 may further include a first sling attachment portion 916 positioned at or near the first end 912 of the first bar portion 904 and a second sling attachment portion 918 positioned at or near the second end 914 of the second bar portion 906. According to various aspects, the first sling attachment portion 916 may couple to the first end 912 of the first bar portion 904 on the second vertical side (e.g., in the −Y direction of the coordinate axes of FIG. 9A) and the second sling attachment portion 918 may couple to the second end 914 of the second bar portion 906 on the second vertical side (e.g., in the −Y direction of the coordinate axes of FIG. 9A). Each of the first sling attachment portion 916 and the second sling attachment portion 918 may selectively couple a subject sling to the sling bar 900 as described herein. In particular, each of the first sling attachment portion 916 and the second sling attachment portion 918 may be sized and/or dimensioned to couple to one or more than one sling loop of one or more than one subject sling as described more fully herein. For ease of description, the first sling attachment portion 916 and the second sling attachment portion 918 are depicted in FIG. 9A as different wireforms 930, 950.

In some aspects, it should be appreciated that both the first sling attachment portion 916 and the second sling attachment portion 918 of the sling bar 900 may include a second wireform 930 (e.g., depicted as the sling attachment portion 916 in FIG. 9A). In such aspects, the first sling attachment portion 916 and the second sling attachment portion 918 of the second wireform 930 may be sized and/or shaped in a substantially same or similar manner. In view of FIG. 9A, the distal end 942 of the first sling attachment portion 916 of the second wireform 930 may extend in one longitudinal direction (e.g., in generally the +X direction of the coordinate axes of FIG. 9A) while, in light of FIG. 9A, the distal end 944 of the second sling attachment portion 918 of the second wireform 930 may extend (not shown) in another longitudinal direction (e.g., in generally the −X direction of the coordinate axes of FIG. 9A). In some aspects, both the first sling attachment portion 916 and the second sling attachment portion 918 of the second wireform 930 may curl on a same lateral side (e.g., in the +Z direction or in the −Z direction of the coordinate axes of FIG. 9A) of the sling bar 900. In other aspects, the first sling attachment portion 916 of the second wireform 930 may curl on one lateral side (e.g., in the +Z direction of the coordinate axes of FIG. 9A) and the second sling attachment portion 918 of the second wireform 930 may curl on the other lateral side (e.g., in the −Z direction of the coordinate axes of FIG. 9A), or vice versa. In any case, the first sling attachment portion 916 and the second sling attachment portion 918 of the second wireform 930 may mirror each other about a Y-Z plane defined through the axis F-F as depicted in FIG. 9A.

Figure 9B:
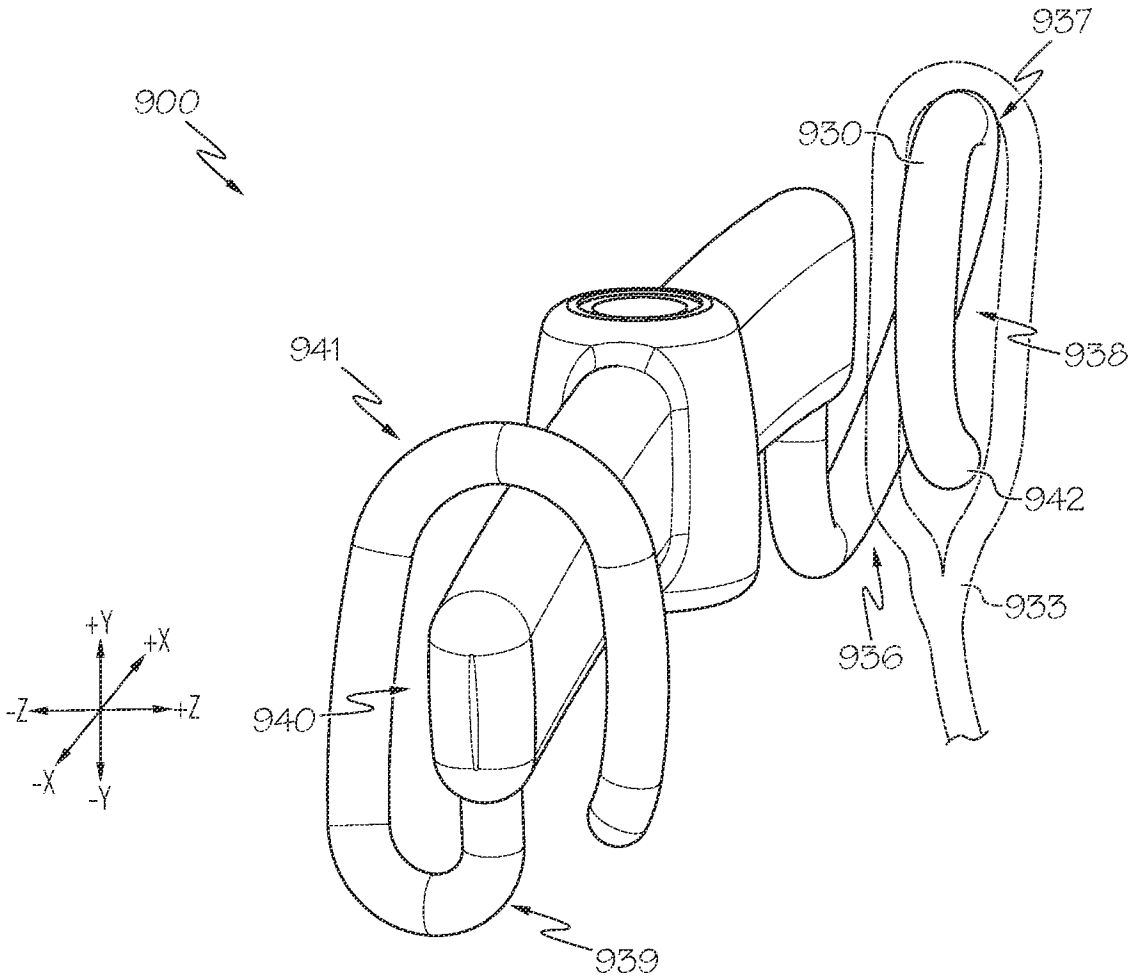
FIG. 9B depicts a first perspective view of the illustrative sling bar of FIG. 9A according to one or more aspects shown and described herein.
Figure 9C:
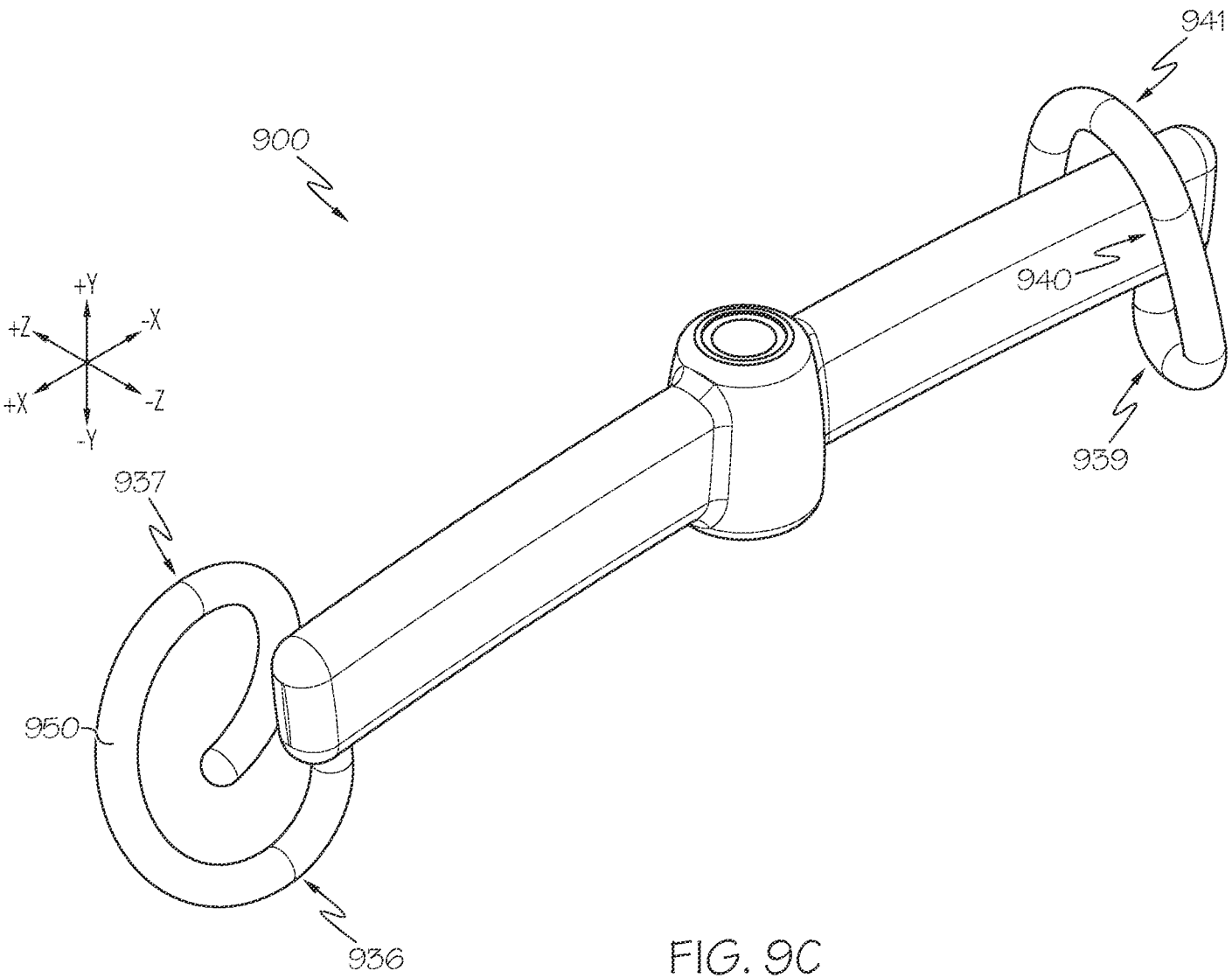
FIG. 9C depicts a second perspective view of the illustrative sling bar of FIG. 9A according to one or more aspects shown and described herein.

In view of FIG. 9A, the first sling attachment portion 916 of the second wireform 930 may extend from the second vertical side (e.g., in the −Y direction of the coordinate axes of FIG. 9A) of the first bar portion 904 (e.g., at or near the first end 912) in the second vertical direction (e.g., in the −Y direction of the coordinate axes of FIG. 9A) a first predetermined distance and curl as depicted in FIG. 9A. According to various aspects, coupling the first sling attachment portion 916 in vertical alignment with the first bar portion 904 (e.g., along a plane extending through the sixth axis (axis F-F) parallel to the X-Y plane of the coordinate axes of FIG. 9A) may avoid otherwise torsional effects due to non-vertically aligned loads. More specifically, the first sling attachment portion 916 of the second wireform 930 may extend in the following manner: curl (e.g., generally toward the +X, +Y, +Z octant of the coordinate axes of FIG. 9A) at a first predetermined angle a second predetermined distance, curl (e.g., generally toward the −X, −Y, +Z octant of the coordinate axes of FIG. 9A) at a second predetermined angle a third predetermined distance, and curl (e.g., generally toward the +X, −Y, +Z octant of the coordinate axes of FIG. 9A) a third predetermined angle a fourth predetermined distance to define a first receiving aperture 938. FIG. 9B depicts a first perspective view of the illustrative sling bar of FIG. 9A and FIG. 9C depicts a second perspective view of the illustrative sling bar of FIG. 9A, according to various aspects of the present disclosure. The second wireform 930, as described with respect to FIG. 9A, may be further understood in view of FIGS. 9B and 9C and their respective coordinate axes.

Similarly, in light of FIG. 9A, the second sling attachment portion 918 of the second wireform 930 may extend (not shown) from the second vertical side (e.g., in the −Y direction of the coordinate axes of FIG. 9A) of the second bar portion 906 (e.g., at or near the second end 914) in the second vertical direction (e.g., in the −Y direction of the coordinate axes of FIG. 9A) a first predetermined distance and curl in a manner similar to the first sling attachment portion 916 of the second wireform 930 as depicted in FIG. 9A. According to various aspects, coupling the second sling attachment portion 918 in vertical alignment with the second bar portion 906 (e.g., along a plane extending through the sixth axis (axis F-F) parallel to the X-Y plane of the coordinate axes of FIG. 9A) may avoid otherwise torsional effects due to non-vertically aligned loads. More specifically, the second sling attachment portion 918 of the second wireform 930 may extend as follows: curl (not shown, e.g., generally toward the −X, +Y, +Z octant of the coordinate axes of FIG. 9A) at a first predetermined angle a second predetermined distance, curl (not shown, e.g., generally toward the +X, −Y, +Z octant of the coordinate axes of FIG. 9A) at a second predetermined angle a third predetermined distance, and curl (not shown, e.g., generally toward the −X, −Y, +Z octant of the coordinate axes of FIG. 9A) a third predetermined angle a fourth predetermined distance to define a second receiving aperture 940.

In view of FIGS. 9A-9C, the first sling attachment portion 916 of the second wireform 930 may extend as follows: initially curl (e.g., in the +X direction of the coordinate axes of FIGS. 9A-9C) away from the first end 912 of the first bar portion 904 and curl (e.g., in the −X direction of the coordinate axes of FIGS. 9A-9C) back toward the first end 912 of the first bar portion 904 to overlap at least a portion of the first end 912 of the first bar portion 904 on a lateral side (e.g., in the +Z or −Z direction of the coordinate axes of FIG. 9A-9C). Similarly, in light of FIGS. 9A-9C, the second sling attachment portion 918 of the second wireform 930 may extend as follows: initially curl (e.g., in the −X direction of the coordinate axes of FIGS. 9A-9C) away from the second end 914 of the second bar portion 906 and curl (e.g., in the +X direction of the coordinate axes of FIGS. 9A-9C) back toward the second end 914 of the second bar portion 906 to overlap at least a portion of the second end 914 of the second bar portion 906 on a lateral side (e.g., in the +Z or −Z direction of the coordinate axes of FIG. 9A-9C).

As introduced herein, each of the first sling attachment portion 916 and the second sling attachment portion 918 of the second wireform 930 may be sized and/or dimensioned to couple to one or more than one sling loop. Accordingly, the first predetermined distance, the second predetermined distance, the third predetermined distance, the fourth predetermined distance, the first predetermined angle, the second predetermined angle and/or the third predetermined angle may be based on various parameters (e.g., thickness, width, elasticity, and/or the like) of one or more than one sling loop. Accordingly, a plurality of sling bars 900 may be manufactured to include a first sling attachment portion 916 and a second sling attachment portion 918 of the second wireform 930, where each sling bar 900 has a different first, second, third and/or fourth predetermined distance as well as a different first, second and/or third predetermined angle. According to various aspects, the first, second, third, and/or fourth predetermined distance as well as the first, second and/or third predetermined angle may be based on a combination of parameters associated with one or more than one sling loop anticipated to couple to the first sling attachment portion 916 and the second sling attachment portion 918 of the second wireform 930. Furthermore, the plurality of sling bars 900 may be manufactured where each sling bar 900 has a different overall length. Here, each overall length may be based on a combination of parameters associated with a subject sling anticipated to couple to each sling bar.

In view of FIGS. 9B and 9C, the first receiving aperture 938 may be defined by a proximal curl portion 936 (e.g., in the −Z direction of the coordinate axes of FIGS. 9B and 9C) and a distal curl portion 937 (e.g., in the +Z direction of the coordinate axes of FIGS. 9B and 9C). Similarly, in light of FIGS. 9B and 9C, the second receiving aperture 940 (not shown) may be defined by a proximal curl portion 939 (e.g., in the −Z or +Z direction of the coordinate axes of FIGS. 9B and 9C) and a distal curl portion 941 (e.g., in the +Z or −Z direction, respectively of the coordinate axes of FIGS. 9B and 9C). According to various aspects of the present disclosure, the distal curl portion 937 of the first receiving aperture 938 may be sized and/or dimensioned such that one or more than one sling loop may be placed over the distal curl portion 937 without having to thread the one or more than one sling loop onto the first sling attachment portion 916 of the second wireform 930 (e.g., via the distal end 942 of the first sling attachment portion 916 of the second wireform 930). Accordingly, the one or more than one sling loop may drop into a gap between the distal curl portion 937 and the proximal curl portion 936 to be fully seated within the first receiving aperture 938 (e.g., phantom loop 933 in FIG. 9B). In such aspects, the distal curl portion 937 of the first receiving aperture 938 may function to retain the one or more than one sling loop within the first receiving aperture 938 such that an inadvertent slip out of the one or more than one sling loop is avoided (e.g., a trap for the sling loop even when no-load conditions exist). Similarly, the distal curl portion 941 of the second receiving aperture 940 may be sized and/or dimensioned such that one or more than one sling loop may be placed over the distal curl portion 941 without having to thread the one or more than one sling loop onto the second sling attachment portion 918 of the second wireform 930 (e.g., via a distal end 944 of the second sling attachment portion 918 of the second wireform 930). Accordingly, the one or more than one sling loop may drop into a gap between the distal curl portion 941 and the proximal curl portion 939 to be fully seated within the second receiving aperture 940. In such aspects, the distal curl portion 941 of the second receiving aperture 940 may function to retain the one or more than one sling loop within the second receiving aperture 940 such that an inadvertent slip out of the one or more than one sling loop is avoided (e.g., a trap for the sling loop even when no-load conditions exist).

In other aspects, it should be appreciated that both the first sling attachment portion 916 and the second sling attachment portion 918 of the sling bar 900 may include a third wireform 950 (depicted as the sling attachment portion 918 in FIG. 9A). In such aspects, the first sling attachment portion 916 and the second sling attachment portion 918 of the third wireform 950 may be sized and/or shaped in a substantially same or similar manner. In view of FIG. 9A, in some aspects, the distal end 944 of the second sling attachment portion 918 of the third wireform 950 may extend in one lateral direction (e.g., in generally the −Z direction of the coordinate axes of FIG. 9A) while, in light of FIG. 9A, the distal end 942 of the first sling attachment portion 916 of the third wireform 950 may extend (not shown) in another lateral direction (e.g., in generally the +Z direction of the coordinate axes of FIG. 9A). In other aspects, the distal end 944 of the second sling attachment portion 918 and the distal end 942 of the first sling attachment portion 916 of the third wireform 950 may both extend in the same or similar lateral direction (e.g., in generally the +Z direction or the −Z direction of the coordinate axes of FIG. 9A, the second sling attachment portion 918 and the first sling attachment portion 916 may mirror each other about a Y-Z plane defined through the axis F-F as depicted in FIG. 9A).

In view of FIG. 9A, the second sling attachment portion 918 of the third wireform 950 may extend from the second vertical side (e.g., in the −Y direction of the coordinate axes of FIG. 9A) of the second bar portion 906 (e.g., at or near the second end 914) in the second vertical direction (e.g., in the −Y direction of the coordinate axes of FIG. 9A) a first predetermined distance and curl as depicted in FIG. 9A. According to various aspects, coupling the second sling attachment portion 918 in vertical alignment with the second bar portion 906 (e.g., along a plane extending through the sixth axis (axis F-F) parallel to the X-Y plane of the coordinate axes of FIG. 9A) may avoid otherwise torsional effects due to non-vertically aligned loads. More specifically, the second sling attachment portion 918 of the third wireform 950 may extend as follows: curl (e.g., generally toward the +X, +Y, −Z octant of the coordinate axes of FIG. 9A) at a first predetermined angle a second predetermined distance, curl (e.g., generally toward the +X, −Y, +Z octant of the coordinate axes of FIG. 9A) at a second predetermined angle a third predetermined distance, and curl (e.g., generally toward the +X, −Y, −Z octant of the coordinate axes of FIG. 9A) a third predetermined angle a fourth predetermined distance to define a second receiving aperture 940. FIG. 9B depicts a first perspective view of the illustrative sling bar of FIG. 9A and FIG. 9C depicts a second perspective view of the illustrative sling bar of FIG. 9A, according to various aspects of the present disclosure. The third wireform 950, as described with respect to FIG. 9A, may be further understood in view of FIGS. 9B and 9C and their respective coordinate axes.

Similarly, in light of FIG. 9A, the first sling attachment portion 916 of the third wireform 950 may extend (not shown) from the second vertical side (e.g., in the −Y direction of the coordinate axes of FIG. 9A) of the first bar portion 904 (e.g., at or near the first end 912) in the second vertical direction (e.g., in the −Y direction of the coordinate axes of FIG. 9A) a first predetermined distance and curl in a manner similar to the second sling attachment portion 918 of the third wireform 950 as depicted in FIG. 9A. According to various aspects, coupling the first sling attachment portion 916 in vertical alignment with the first bar portion 904 (e.g., along a plane extending through the sixth axis (axis F-F) parallel to the X-Y plane of the coordinate axes of FIG. 9A) may avoid otherwise torsional effects due to non-vertically aligned loads. More specifically, the first sling attachment portion 916 of the third wireform 950 may extend as follows: curl (not shown, e.g., generally toward the −X, +Y, −Z octant of the coordinate axes of FIG. 9A) at a first predetermined angle a second predetermined distance, curl (not shown, e.g., generally toward the −X, −Y, +Z octant of the coordinate axes of FIG. 9A) at a second predetermined angle a third predetermined distance, and curl (not shown, e.g., generally toward the −X, −Y, −Z octant of the coordinate axes of FIG. 9A) a third predetermined angle a fourth predetermined distance to define a first receiving aperture 938.

In view of FIGS. 9A-9C, the second sling attachment portion 918 of the third wireform 950 may curl around the second end 914 of the second bar portion 906 toward the hub portion 902 of the sling bar 900. Similarly in light of FIGS. 9A-9C, the first sling attachment portion 916 of the third wireform 950 may curl around the first end 912 of the first bar portion 904 toward the hub portion 902 of the sling bar 900.

As introduced herein, each of the first sling attachment portion 916 and the second sling attachment portion 918 of the third wireform 950 may be sized and/or dimensioned to couple to one or more than one sling loop. Accordingly, the first predetermined distance, the second predetermined distance, the third predetermined distance, the fourth predetermined distance, the first predetermined angle, the second predetermined angle and/or the third predetermined angle may be based on various parameters (e.g., thickness, width, elasticity, and/or the like) of one or more than one sling loop. Accordingly, a plurality of sling bars 900 may be manufactured to include a first sling attachment portion 916 and a second sling attachment portion 918 of the third wireform 950, where each sling bar 900 has a different first, second, third and/or fourth predetermined distance as well as a different first, second and/or third predetermined angle. According to various aspects, the first, second, third, and/or fourth predetermined distance as well as the first, second and/or third predetermined angle may be based on a combination of parameters associated with one or more than one sling loop anticipated to couple to the first sling attachment portion 916 and the second sling attachment portion 918 of the third wireform 950. Furthermore, the plurality of sling bars 900 may be manufactured where each sling bar 900 has a different overall length. Here, each overall length may be based on a combination of parameters associated with a subject sling anticipated to couple to each sling bar.

In view of FIGS. 9B and 9C, the second receiving aperture 940 may be defined by a proximal curl portion 939 (e.g., in the −Y direction of the coordinate axes of FIGS. 9B and 9C) and a distal curl portion 941 (e.g., in the +Y direction of the coordinate axes of FIGS. 9B and 9C). Similarly, in light of FIGS. 9B and 9C, the first receiving aperture 938 (not shown) may be defined by a proximal curl portion 936 (e.g., in the −Y direction of the coordinate axes of FIGS. 9B and 9C) and a distal curl portion 937 (e.g., in the +Y direction of the coordinate axes of FIGS. 9B and 9C). According to various aspects of the present disclosure, the distal curl portion 941 of the second receiving aperture 940 may be sized and/or dimensioned such that one or more than one sling loop may be threaded onto the second sling attachment portion 918 of the third wireform 950 (e.g., via a distal end 944 of the second sling attachment portion 918 of the third wireform 950). In such aspects, the distal curl portion 941 of the second receiving aperture 940 may function to retain the one or more than one sling loop within the second receiving aperture 940 such that an inadvertent slip out of the one or more than one sling loop is avoided (e.g., a trap for the sling loop even when no-load conditions exist). Similarly, the distal curl portion 937 of the first receiving aperture 938 may be sized and/or dimensioned such that one or more than one sling loop may be threaded onto the first sling attachment portion 916 of the third wireform 950 (e.g., via the distal end 942 of the first sling attachment portion 916 of the third wireform 950). In such aspects, the distal curl portion 937 of the first receiving aperture 938 may function to retain the one or more than one sling loop within the first receiving aperture 938 such that an inadvertent slip out of the one or more than one sling loop is avoided (e.g., a trap for the sling loop even when no-load conditions exist).

In light of FIGS. 9A-9C, various components of the sling bar 900 including the hub portion 902, the first bar portion 904, the second bar portion 906, the first sling attachment portion 916, and/or the second sling attachment portion 918 may be defined by a material capable of withstanding anticipated static and/or dynamic forces on the sling bar 900 without fatigue and/or failure of such various components. According to various aspects, each component may be dimensioned to withstand, alone and/or in combination with other components, the anticipated static and/or dynamic forces. In some aspects, the various components of the sling bar 900 including the hub portion 902, the first bar portion 904, the second bar portion 906, the first sling attachment portion 916, and/or the second sling attachment portion 918 may be defined by a cast aluminum, steel, a metal alloy, and/or the like. According to various aspects, the first sling attachment portion 916 and/or the second sling attachment portion 918 may be defined by a solid cylindrical wireform (e.g., stainless steel bar stock bent to shape).

In yet further aspects, it should be appreciated that the first sling attachment portion 916 and the second sling attachment portion 918 of the sling bar 900 may include any combination of the first wireform 830, the second wireform 930 and/or the third wireform 950 as described herein.

FIG. 10 depicts a side view of another illustrative sling bar 1000 that includes at least one low profile sling attachment portion 1016, 1018 according to one or more aspects of the present disclosure. Referring to FIG. 10, the sling bar 1000 may include a hub portion 1002, a first bar portion 1004, and a second bar portion 1006. In such an aspect, the hub portion 1002 may be defined, concentrically, about a first axis (e.g., axis A-A as depicted in FIG. 10). The hub portion 1002 may define an internal hub surface (not shown) and an external hub surface 1010. Each of the internal hub surface and the external hub surface 1010 may be generally cylindrically shaped and extend about the first axis (e.g., axis A-A as depicted in FIG. 10) between a first horizontal surface 1009 (e.g., in the +Y direction of the coordinate axes of FIG. 10) and a second horizontal surface 1011 (e.g., in the −Y direction of the coordinate axes of FIG. 10). In view of FIG. 10, a lift hook (e.g., the lift hooks described herein with respect to FIGS. 1 and 3) may be coupled to the sling bar 1000 at or near the first horizontal surface 1009. The first bar portion 1004 may extend from the external hub surface 1010 of the hub portion 1002 in a first longitudinal direction (e.g., in the +X direction of the coordinate axes of FIG. 10) toward a first end 1012, and the second bar portion 1006 may extend from the external hub surface 1010 of the hub portion 1002 in a second longitudinal direction (e.g., in the −X direction of the coordinate axes of FIG. 10) toward a second end 1014.

Referring still to FIG. 10, the sling bar 1000 may further include a first low profile sling attachment portion 1016 positioned at or near the first end 1012, in the second vertical direction (e.g., in the −Y direction of the coordinate axes of FIG. 10), of the first bar portion 1004 and a second low profile sling attachment portion 1018 positioned at or near the second end 1014, in the second vertical direction (e.g., in the −Y direction of the coordinate axes of FIG. 10), of the second bar portion 1006. Each of the first low profile sling attachment portion 1016 and the second low profile sling attachment portion 1018 may selectively couple a subject sling to the sling bar 1000, as described herein. In particular, each of the first low profile sling attachment portion 1016 and the second low profile sling attachment portion 1018 may be sized and/or dimensioned to couple to one or more than one sling loop of one or more than one subject sling as described more fully herein. In addition, each of the first low profile sling attachment portion 1016 and the second low profile sling attachment portion 1018 may be sized and/or dimensioned to allow one or more than one sling loop of the one or more than one subject sling to be supported for extreme angle use of the sling bar 1000, as described more fully herein.

In view of FIG. 10, the first low profile sling attachment portion 1016 may extend from the first bar portion 1004 (e.g., at or near the first end 1012 thereof) in generally the first longitudinal direction (e.g., in the +X direction of the coordinate axes of FIG. 10) a first predetermined distance, extend (e.g., hook upward) in generally the first vertical direction (e.g., in the +Y direction of the coordinate axes of FIG. 10) a second predetermined distance, and extend back (e.g., hook back) in generally the second longitudinal direction (e.g., in the −X direction of the coordinate axes of FIG. 10) toward the first bar portion 1004 a third predetermined distance to define a first receiving aperture 1038. Accordingly, a first terminus 1052 of the first low profile sling attachment portion 1016 faces the first bar portion 1004 at a distance from the first bar portion 1004, defining an opening into the first receiving aperture 1038 between the first terminus 1052 and the first bar portion 1004, as depicted in FIG. 10. Similarly in view of FIG. 10, the second low profile sling attachment portion 1018 may extend from the second bar portion 1006 (e.g., at or near the second end 1014 thereof) in generally the second longitudinal direction (e.g., in the −X direction of the coordinate axes of FIG. 10) the first predetermined distance, extend (e.g., hook upward) in generally the first vertical direction (e.g., in the +Y direction of the coordinate axes of FIG. 10) the second predetermined distance, and extend back (e.g., hook back) in generally the first longitudinal direction (e.g., in the +X direction of the coordinate axes of FIG. 10) toward the second bar portion 1006 the third predetermined distance to define a second receiving aperture 1040. Accordingly, a second terminus 1054 of the second low profile sling attachment portion 1018 faces the second bar portion 1006 at a distance from the second bar portion 1006, defining an opening into the second receiving aperture 1040 between the second terminus 1054 and the second bar portion 1006, as depicted in FIG. 10. As introduced herein, each of the first low profile sling attachment portion 1016 and the second low profile sling attachment portion 1018 may be sized and/or dimensioned to couple to one or more than one sling loop. Accordingly, the first predetermined distance, the second predetermined distance, and/or the third predetermined distance may be based on various parameters (e.g., thickness, width, elasticity, and/or the like) of one or more than one sling loop. Further, a plurality of sling bars 1000 may be manufactured to include a first low profile sling attachment portion 1016 and a second low profile sling attachment portion 1018, where each sling bar 1000 has a different first, second and/or third predetermined distance. According to various aspects, the first, second, and/or third predetermined distance may be based on a combination of parameters associated with one or more than one sling loop anticipated to couple to the first low profile sling attachment portion 1016 and the second low profile sling attachment portion 1018. Furthermore, the plurality of sling bars 1000 may be manufactured where each sling bar 1000 has a different overall length. Here, each overall length may be based on a combination of parameters associated with a subject sling anticipated to couple to each sling bar.

In some aspects, the first end 1012 of the first bar portion 1004 may further include a first protrusion 1060 that extends a distance D1 from an upper part of the first end 1012 in generally the first longitudinal direction (e.g., in the +X direction of the coordinate axes of FIG. 10) toward the first low profile sling attachment portion 1016 (e.g., toward the first terminus 1052 of the first low profile sling attachment portion 1016) to define a first undercut portion 1070 of the first receiving aperture 1038 that is located underneath the first protrusion 1060 (e.g., the area located directly adjacent to the first protrusion 1060 in generally the −Y direction of the coordinate axes of FIG. 10). The first undercut portion 1070 is generally an extension of the first receiving aperture 1038, as described herein. The distance D1 is generally a distance that is sufficiently long to cause an extension of the first receiving aperture 1038 in the form of the first undercut portion 1070 to maintain a positioning of one or more than one sling loop secured on the first low profile sling attachment portion 1016 in the first undercut portion 1070 when the sling bar 1000 is positioned in an extreme angle positioning (e.g., when the sling bar 1000 is coupled to the sling bar attachment mechanism 208 depicted in FIG. 2 and the first bar portion 1004 is shifted higher in the first vertical direction relative to the second bar portion 1006), but is not so long that when one or more than one sling loop is secured on the first low profile sling attachment portion 1016 and the extreme angle positioning forces the one or more than one sling loop into the first undercut portion 1070, the one or more than one sling loop becomes folded, caught, or the like, thereby potentially hindering movement of various components such as retention latches or the like, as described herein. For example, in some aspects, the distance D1 may be from about 1 mm to about 25 mm, including about 1 mm, about 5 mm, about 10 mm, about 15 mm, about 20 mm, about 25 mm, or any value or range between any two of these values (including endpoints). In some aspects, the distance D1 may be a distance that is less than or equal to a width of a sling loop to be used with the sling bar 1000 to avoid a situation where the sling loop is wider than the distance D1, which could result in instances of misuse at extreme angle positioning, such as bunching, folding, catching, pinching, or the like, as described herein. For example, if the width of a sling loop is 25 mm, the distance D1 may be less than or equal to 25 mm, such as 20 mm or less.

Accordingly, the first undercut portion 1070 may be shaped, sized and/or configured to receive one or more than one sling loop and maintain a position of the one or more than one sling loop in instances when the sling bar 1000 is positioned in the extreme angle positioning, as described in further detail hereinbelow. For example, the first undercut portion 1070 may have a shelf, a notch, or the like that provides a surface for supporting one or more than one sling loop when the sling bar 1000 is positioned in the extreme angle positioning. In another example, the first undercut portion 1070 may be formed as an acute angle at a point where the underside of the first protrusion 1060 (e.g., the portion of the first protrusion 1060 towards the −Y direction of the coordinate axes of FIG. 10) meets the body of the first sling attachment portion 1016 and/or the body of the first bar portion 1004. In yet another example, the first undercut portion 1070 may be formed as a rounded area at an area where the underside of the first protrusion 1060 meets the body of the first sling attachment portion 1016 and/or the body of the first bar portion 1004. The acute angle or the rounded area may prevent one or more than one sling loop from becoming bunched, folded, pinched or the like within the first undercut portion 1070.

Still referring to FIG. 10, the second end 1014 of the second bar portion 1006 may further include a second protrusion 1080 that extends a distance D2 from an upper part of the second end 1014 in generally the second longitudinal direction (e.g., in the −X direction of the coordinate axes of FIG. 10) toward the second low profile sling attachment portion 1018 (e.g., toward the second terminus 1054 of the second low profile sling attachment portion 1018) to define a second undercut portion 1090 of the second receiving aperture 1040 that is located underneath the second protrusion 1080 (e.g., the area located directly adjacent to the second protrusion 1080 in generally the −Y direction of the coordinate axes of FIG. 10). The second undercut portion 1090 is generally an extension of the second receiving aperture 1040, as described herein. The distance D2 is generally a distance that is sufficiently long to cause an extension of the second receiving aperture 1040 in the form of the second undercut portion 1090 to maintain a positioning of one or more than one sling loop secured on the second low profile sling attachment portion 1018 in the second undercut portion 1090 when the sling bar 1000 is positioned in an extreme angle positioning (e.g., when the sling bar 1000 is coupled to the sling bar attachment mechanism 208 depicted in FIG. 2 and the second bar portion 1006 is shifted higher in the first vertical direction relative to the first bar portion 1004), but is not so long that when one or more than one sling loop is secured on the second low profile sling attachment portion 1018 and the extreme angle positioning forces the one or more than one sling loop into the second undercut portion 1090, the one or more than one sling loop becomes folded, caught, or the like, thereby potentially hindering movement of various components such as retention latches or the like, as described herein. For example, in some aspects, the distance D2 may be from about 1 mm to about 25 mm, including about 1 mm, about 5 mm, about 10 mm, about 15 mm, about 20 mm, about 25 mm, or any value or range between any two of these values (including endpoints). In some aspects, the distance D2 may be a distance that is less than or equal to a width of a sling loop to be used with the sling bar 1000 to avoid a situation where the sling loop is wider than the distance D2, which could result in instances of misuse at extreme angle positioning, such as bunching, folding, catching, pinching, or the like, as described herein. For example, if the width of a sling loop is 25 mm, the distance D2 may be less than or equal to 25 mm, such as 20 mm or less.

Accordingly, the second undercut portion 1090 may be shaped, sized and/or configured to receive one or more than one sling loop and maintain a positioning of the one or more than one sling loop in instances when the sling bar 1000 is positioned in the extreme angle positioning, as described in further detail hereinbelow. For example, the second undercut portion 1090 may have a shelf, a notch, or the like that provides a surface for supporting one or more than one sling loop when the sling bar 1000 is positioned in the extreme angle positioning. In another example, the second undercut portion 1090 may be formed as an acute angle at a point where the underside of the second protrusion 1080 (e.g., the portion of the second protrusion 1080 towards the −Y direction of the coordinate axes of FIG. 10) meets the body of the second sling attachment portion 1018 and/or the body of the second bar portion 1006. In yet another example, the second undercut portion 1090 may be formed as a rounded area at an area where the underside of the second protrusion 1080 meets the body of the second sling attachment portion 1018 and/or the body of the second bar portion 1006. The acute angle or the rounded area may prevent one or more than one sling loop from becoming bunched, folded, pinched, or the like within the second undercut portion 1090.

In light of FIG. 10, various components of the sling bar 1000 including the hub portion 1002, the first bar portion 1004, the second bar portion 1006, the first low profile sling attachment portion 1016, and/or the second low profile sling attachment portion 1018 may be defined by a material capable of withstanding anticipated static and/or dynamic forces on the sling bar 1000 without fatigue and/or failure of such various components. According to various aspects, each component may be dimensioned to withstand, alone and/or in combination with other components, the anticipated static and/or dynamic forces. In some aspects, the various components of the sling bar 1000 including the hub portion 1002, the first bar portion 1004, the second bar portion 1006, the first low profile sling attachment portion 1016, and/or the second low profile sling attachment portion 1018 may be defined by a cast aluminum, steel, a metal alloy, and/or the like.

Still referring to FIG. 10, the sling bar 1000 may further include a first retention latch 1020 positioned at or near the first end 1012 (e.g., at or near a distal end 1062 of the first protrusion 1060), in the first vertical direction (e.g., in the +Y direction of the coordinate axes of FIG. 10), of the first bar portion 1004 and a second retention latch 1022 positioned at or near the second end 1014 (e.g., at or near a distal end 1082 of the second protrusion 1080), in the first vertical direction (e.g., in the +Y direction of the coordinate axes of FIG. 10), of the second bar portion 1006. In view of FIG. 10, a proximal end (e.g., an end located toward the −X direction of the coordinate axes of FIG. 10) of the first retention latch 1020 may be pivotally coupled (e.g., via a first pin 1025 or the like) to the first bar portion 1004 at the first protrusion 1060 and a distal end 1062 (e.g., an end located toward the +X direction of the coordinate axes of FIG. 10) of the first retention latch 1020 may define a first engagement face 1024 that selectively interfaces with a first stop surface 1026 at the first terminus 1052 of the first low profile sling attachment portion 1016. As depicted in FIG. 10, the first engagement face 1024 of the first retention latch 1020 may interfere with the first stop surface 1026 at the first terminus 1052 of the first low profile sling attachment portion 1016 such that the first retention latch 1020 is constrained to pivot between an open position and a closed position. In particular, the first retention latch 1020 may pivot (e.g., about the first pin 1025) in a clockwise direction about a second axis until a body of the first retention latch 1020 ceases to interface with the first stop surface 1026 at the first terminus 1052 and/or a surface located adjacent to the first undercut portion 1070 (e.g., the open position) and to pivot (e.g., about first pin 1025) in a counter-clockwise direction about the second axis until the first engagement face 1024 interfaces with the first stop surface 1026 (e.g., the closed position). The interface between the first engagement face 1024 and the first stop surface 1026 restrains any of one or more than one sling loop 1033 coupled to (e.g., hooked onto) the first low profile sling attachment portion 1016 to prevent any of the one or more than one sling loop 1033 from inadvertently slipping out of the first low profile sling attachment portion 1016 in the closed position, as depicted in FIG. 11A (one sling loop 1033 is depicted in phantom in FIG. 11A). In some aspects, as depicted in FIG. 11B, a mechanical device 1100 may actively generate a first closing force that causes the first engagement face 1024 to interface with the first stop surface 1026 (e.g., a default closed position). In some aspects, the mechanical device 1100 may include a biasing mechanism 1102 (e.g., a spring) that generates a first closing force capable of pushing a pin 1104 in contact with the first retention latch 1020 to cause the first retention latch 1020 to pivot from the open position to the closed position and maintains the first engagement face 1024 in contact with the first stop surface 1026 until a first insertion force is applied to the first retention latch 1020. In such aspects, the first insertion force may be capable of pivoting the first retention latch 1020 (e.g., directly by a user and/or indirectly via a sling loop 1033) from the closed position toward the open position by overcoming the first closing force provided by the biasing mechanism 1102. According to various aspects, the first insertion force may be a predetermined force (e.g., a set force). In other aspects, the first insertion force may be an average force capable of being generated via one hand by an average user of the sling bar 1000. In yet further aspects, the first insertion force may be a predetermined force greater than a minimum force (e.g., the hanging weight of one or more than one sling loop and/or its associated sling positioned on a first actuation surface 1034 of the first retention latch 1020).

Similarly, in view of FIG. 10, a proximal end (e.g., an end located toward the +X direction of the coordinate axes of FIG. 10) of the second retention latch 1022 may be pivotally coupled (e.g., via a second pin 1028 or the like) to the second bar portion 1006 at the second protrusion 1080 and a distal end (e.g., an end located toward the −X direction of the coordinate axes of FIG. 10) of the second retention latch 1022 may define a second engagement face 1030 that selectively interfaces with a second stop surface 1032 of the second low profile sling attachment portion 1018. As depicted in FIG. 10, the second engagement face 1030 of the second retention latch 1022 may interfere with the second stop surface 1032 of the second low profile sling attachment portion 1018 such that the second retention latch 1022 is constrained to pivot between an open position and a closed position. In particular, the second retention latch 1022 may pivot (e.g., about second pin 1028) in a counter-clockwise direction about a third axis until a body of the second retention latch 1022 ceases to interface with the second stop surface 1032 at the second terminus 1054 and/or a surface located adjacent to the second undercut portion 1090 (e.g., the open position) and to pivot (e.g., about second pin 1028) in a clockwise direction about the third axis until the second engagement face 1030 interfaces with the second stop surface 1032 (e.g., the closed position). The interface between the second engagement face 1030 and the second stop surface 1032 restrains any of one or more than one sling loop (not shown) coupled to (e.g., hooked onto) the second low profile sling attachment portion 1018 to prevent any of the one or more than one sling loop from inadvertently slipping out of the second low profile sling attachment portion 1018 in the closed position. In some aspects, as further described herein, a mechanical device (not shown, see, e.g., FIG. 11B) may actively generate a second closing force that causes the second engagement face 1030 to interface with the second stop surface 1032 (e.g., a default closed position). In some aspects, the mechanical device may be configured to generate a second closing force capable of pivoting the second retention latch 1022 from the open position to the closed position and capable of maintaining the second engagement face 1030 in contact with the second stop surface 1032 until a second insertion force is applied to the second retention latch 1022. In such aspects, the second insertion force may be capable of pivoting the second retention latch 1022 (e.g., directly by a user and/or indirectly via a sling loop 1033) from the closed position toward the open position. According to various aspects, the second insertion force may be a predetermined force (e.g., a set force). In other aspects, the second insertion force may be an average force capable of being generated via one hand by an average user of the sling bar 1000. In yet further aspects, the second insertion force may be a predetermined force greater than a minimum force (e.g., the hanging weight of one or more than one sling loop and/or its associated sling positioned on a second actuation surface 1036 of the second retention latch 1022).

In view of FIG. 10, the first retention latch 1020 of the sling bar 1000 may be defined by a material capable of maintaining the interface between the first engagement face 1024 and the first stop surface 1026, as described herein (e.g., to prevent one or more than one sling loop from inadvertently slipping out of the first low profile sling attachment portion 1016). For example, the material of the first retention latch 1020 should not break, flex/deflect laterally (e.g., in the +Z and/or −Z direction of the coordinate axes of FIG. 10) and/or deform vertically (e.g., in the +Y and/or −Y direction of the coordinate axes of FIG. 10) such that the first engagement face 1024 of the first retention latch 1020 is able to pivot (e.g., about first pin 1025) in a counter-clockwise direction about the second axis past the first stop surface 1026 of the first low profile sling attachment portion 1016. In some aspects, the first retention latch 1020 may be defined by a cast aluminum, a laser cut steel, and/or the like.

Similarly, the second retention latch 1022 of the sling bar 1000 may be defined by a material capable of maintaining the interface between the second engagement face 1030 and the second stop surface 1032, as described herein (e.g., to prevent one or more than one sling loop from inadvertently slipping out of the second low profile sling attachment portion 1018). For example, the material of the second retention latch 1022 should not break, flex/deflect laterally (e.g., in the +Z and/or −Z direction of the coordinate axes of FIG. 10) and/or deform vertically (e.g., in the +Y and/or −Y direction of the coordinate axes of FIG. 10) such that the second engagement face 1030 of the second retention latch 1022 is able to pivot (e.g., about second pin 1028) in a clockwise direction about the third axis past the second stop surface 1032 of the second low profile sling attachment portion 1018. In some aspects, the second retention latch 1022 may be defined by a cast aluminum, a laser cut steel, and/or the like.

Given the foregoing description of FIGS. 10 and 11A-11B, it should be appreciated that such a maintaining of the one or more than one sling loop within the first undercut portion 1070 may prevent the one or more than one sling loop from becoming wedged or bunched up against the first retention latch 1020 when the sling bar 1000 is positioned in the extreme angle positioning, yet still allows for the one or more than one sling loop to be supported within the first undercut portion 1070 during extreme angle positioning. Similarly such a maintaining of the one or more than one sling loop within the second undercut portion 1090 may prevent the one or more than one sling loop from becoming wedged or bunched up against the second retention latch 1022 when the sling bar 1000 is positioned in the extreme angle positioning, yet still allows for the one or more than one sling loop to be supported within the second undercut portion 1090 during extreme angle positioning. The shape, size, and configuration of the first protrusion 1060 and the second protrusion 1080 (as well as the shape, size, and configuration of the first undercut portion 1070 and the second undercut portion 1090 formed therefrom, respectively) represent an improvement over other retention latches that have no protrusion at all or a longer protrusion because the one or more than one sling loop can be maintained and prevented from further movement during extreme angle positioning where such maintaining would not be feasible or possible in other configurations because the one or more than one sling loop would slip or would get caught, bunched, or the like and prevent movement of components such as the first retention latch 1020 and/or the second retention latch 1022.

It should be appreciated that, as depicted in FIG. 10, the alignment of the first actuation surface 1034 of the first retention latch 1020 with an upper surface of the first sling attachment portion 1016 and an upper surface of the first protrusion 1060 of the first bar portion 1004 is substantially continuous when the first retention latch 1020 is in the closed position so as to provide a smooth transition from the upper surface of the first sling attachment portion 1016 to the first protrusion 1060 to avoid situations where the first sling attachment portion 1016 may provide an impalement hazard. Similarly, the alignment of the second actuation surface 1036 of the second retention latch 1022 with an upper surface of the second sling attachment portion 1018 and an upper surface of the second protrusion 1080 of the second bar portion 1006 is substantially continuous when the second retention latch 1022 is in the closed position so as to provide a smooth transition from the upper surface of the second sling attachment portion 1018 to the second protrusion 1080 to avoid situations where the second sling attachment portion 1018 may provide an impalement hazard.

Figure 12:
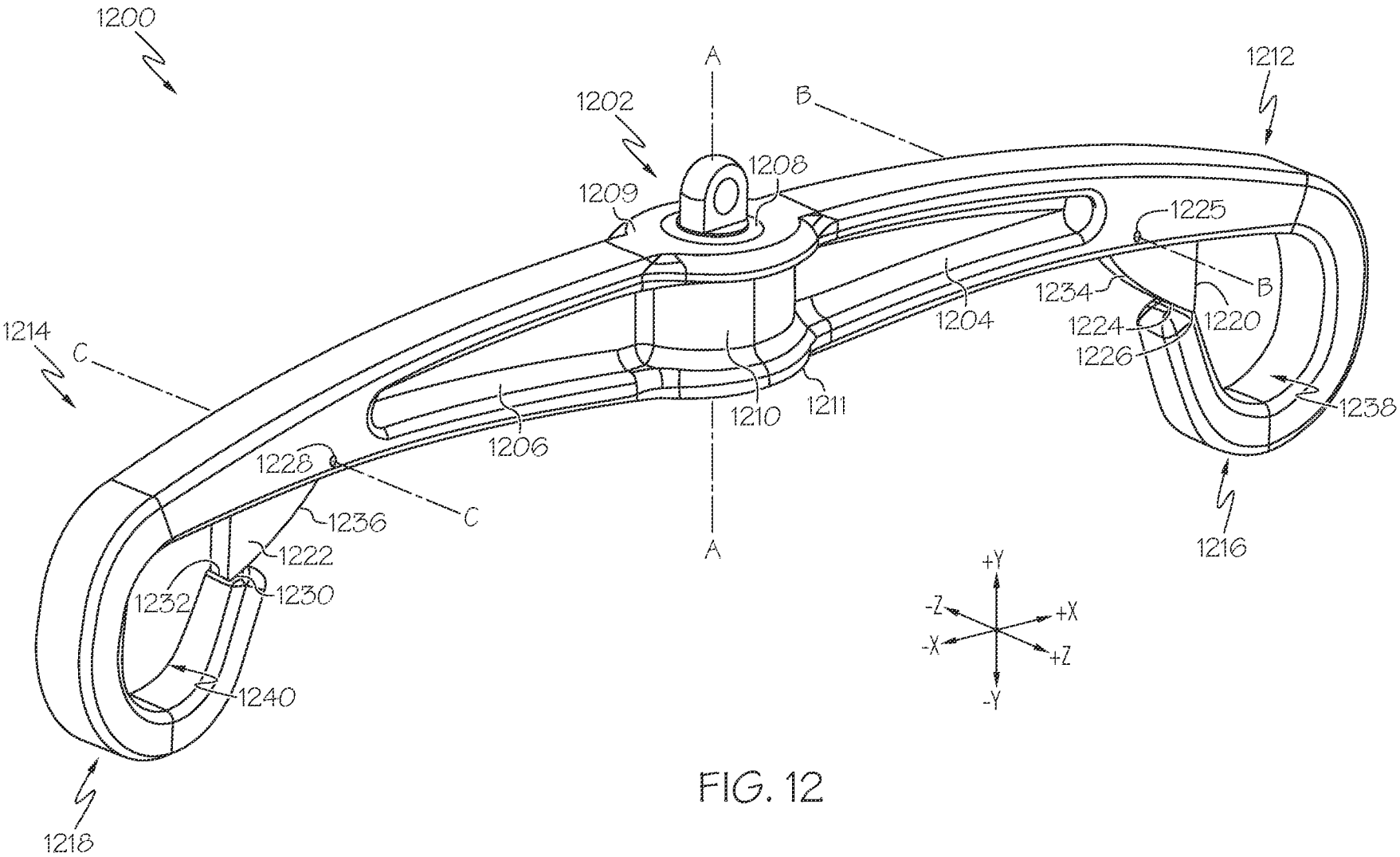
FIG. 12 depicts a perspective view of another illustrative sling bar including underhook attachment portions according to one or more aspects shown and described herein.

FIG. 12 depicts a perspective view of an illustrative sling bar 1200 including at least one sling attachment portion 1216, 1218 according to one or more aspects of the present disclosure. Referring to FIG. 12, the sling bar 1200 may include a hub portion 1202, a first bar portion 1204, and a second bar portion 1206. In such an aspect, the hub portion 1202 may be defined, concentrically, about a first axis (e.g., axis A-A as depicted in FIG. 12). The hub portion 1202 may define an internal hub surface (not shown, depicted generally as 1208) and an external hub surface 1210. Each of the internal hub surface 1208 and the external hub surface 1210 may be generally cylindrically shaped and extend about the first axis (e.g., axis A-A) between a first horizontal surface 1209 (e.g., in the +Y direction of the coordinate axes of FIG. 12) and a second horizontal surface 1211 (e.g., in the −Y direction of the coordinate axes of FIG. 12). In view of FIG. 12, a first lift hook (not depicted) may be coupled to the sling bar 1200 at or near the first horizontal surface 1209. The first bar portion 1204 may extend from the external hub surface 1210 of the hub portion 1202 in a first longitudinal direction (e.g., in the +X direction of the coordinate axes of FIG. 1) toward a first end 1212, and the second bar portion 1206 may extend from the external hub surface 1210 of the hub portion 1202 in a second longitudinal direction (e.g., in the −X direction of the coordinate axes of FIG. 12) toward a second end 1214.

Referring still to FIG. 12, the sling bar 1200 may further include a first sling attachment portion 1216 positioned at or near the first end 1212, in the first vertical direction (e.g., in the +Y direction of the coordinate axes of FIG. 12), of the first bar portion 1204 (e.g., coupled to an upper part of the first bar portion 1204) and a second sling attachment portion 1218 positioned at or near the second end 1214, in the first vertical direction (e.g., in the +Y direction of the coordinate axes of FIG. 12), of the second bar portion 1206 (e.g., coupled to an upper part of the second bar portion 1206). Each of the first sling attachment portion 1216 and the second sling attachment portion 1218 may selectively couple a subject sling to the sling bar 1200, as described herein. In particular, each of the first sling attachment portion 1216 and the second sling attachment portion 1218 may be sized and/or dimensioned to couple to one or more than one sling loop (e.g., sling loops 1233(1) and 1233(2) depicted in phantom in FIG. 14) of one or more than one subject sling as described more fully herein.

In view of FIG. 12, the first sling attachment portion 1216 may extend from the first bar portion 1204 (e.g., at or near the first end 1212) in generally the first longitudinal direction (e.g., in the +X direction of the coordinate axes of FIG. 12) a first predetermined distance, extend (e.g., hook downward) in generally the second vertical direction (e.g., in the −Y direction of the coordinate axes of FIG. 12) a second predetermined distance, extend back (e.g., hook back) in generally the second longitudinal direction (e.g., in the −X direction of the coordinate axes of FIG. 1) a third predetermined distance, and extend up (e.g., hook upward) in generally the first vertical direction (e.g., in the +Y direction of the coordinate axes of FIG. 12) toward the first bar portion 1204 a fourth predetermined distance to define a first receiving aperture 1238. The fourth predetermined distance may define an opening distance Do (FIG. 13C) between a terminus of the first sling attachment portion 1216 and the first bar portion 1204, the opening distance Do providing an opening into the first receiving aperture 1238. The opening distance Do is generally not limited by the present disclosure, and may be any distance, particularly distances that provide sufficient space to place one or more than one sling loops on the first sling attachment portion 1216, as described in greater detail herein. That is, the opening distance Do may be equal to or greater than a width of one or more than one sling loops. A plurality of sling bars 1200 may be manufactured with different opening distances Do that correspond to various sling loop widths in some aspects. In some aspects, the opening distance Do may be about 25 mm or greater than 25 mm. In a particular aspect, the opening distance Do may be about 32.9 mm. In some aspects, the first sling attachment portion 1216 may extend toward the first bar portion the fourth predetermined distance at an angle $\theta_O$ (FIG. 13C) relative to the direction of the first bar portion 1204. Angle $\theta_O$ is not limited by this disclosure, and may be any angle. In one aspect, the angle $\theta_O$ may be obtuse, such as about 120°.

Similarly in view of FIG. 12, the second sling attachment portion 1218 may extend from the second bar portion 1206 (e.g., at or near the second end 1214) in generally the second longitudinal direction (e.g., in the −X direction of the coordinate axes of FIG. 12) the first predetermined distance, extend (e.g., hook downward) in generally the second vertical direction (e.g., in the −Y direction of the coordinate axes of FIG. 12) the second predetermined distance, extend back (e.g., hook back) in generally the first longitudinal direction (e.g., in the +X direction of the coordinate axes of FIG. 1) the third predetermined distance, and extend up (e.g., hook upwards) in generally the first vertical direction (e.g., in the +Y direction of the coordinate axes of FIG. 12) the fourth predetermined distance toward the second bar portion 1206 to define a second receiving aperture 1240. As introduced herein, each of the first sling attachment portion 1216 and the second sling attachment portion 1218 may be sized and/or dimensioned to couple to one or more than one sling loop (e.g., sling loops 1233(1) and 1233(2) depicted in phantom in FIG. 14). Still referring to FIG. 12, the first predetermined distance, the second predetermined distance, the third predetermined distance, and/or the fourth predetermined distance may be based on various parameters (e.g., thickness, width, elasticity, and/or the like) of one or more than one sling loop. Accordingly, a plurality of sling bars 1200 may be manufactured to include a first sling attachment portion 1216 and a second sling attachment portion 1218, where each sling bar 1200 has a different first, second, third, and/or fourth predetermined distance. According to various aspects, the first, second, third, and/or fourth predetermined distance may be based on a combination of parameters associated with one or more than one sling loop anticipated to couple to the first sling attachment portion 1216 and the second sling attachment portion 1218. Furthermore, the plurality of sling bars 1200 may be manufactured where each sling bar 1200 has a different overall length. Here, each overall length may be based on a combination of parameters associated with a subject sling anticipated to couple to each sling bar.

In light of FIG. 12, various components of the sling bar 1200 including the hub portion 1202, the first bar portion 1204, the second bar portion 1206, the first sling attachment portion 1216, and/or the second sling attachment portion 1218 may be defined by a material capable of withstanding anticipated static and/or dynamic forces on the sling bar 1200 without fatigue and/or failure of such various components. According to various aspects, each component may be dimensioned to withstand, alone and/or in combination with other components, the anticipated static and/or dynamic forces. In some aspects, the various components of the sling bar 1200 including the hub portion 1202, the first bar portion 1204, the second bar portion 1206, the first sling attachment portion 1216, and/or the second sling attachment portion 1218 may be defined by a cast aluminum, steel, a metal alloy, and/or the like.

Still referring to FIG. 12, the sling bar 1200 may further include a first retention latch 1220 positioned at or near the first end 1212, in the second vertical direction (e.g., in the −Y direction of the coordinate axes of FIG. 12), of the first bar portion 1204 and a second retention latch 1222 positioned at or near the second end 1214, in the second vertical direction (e.g., in the −Y direction of the coordinate axes of FIG. 12), of the second bar portion 1206. In view of FIG. 12, a proximal end (e.g., in the −X direction of the coordinate axes of FIG. 12) of the first retention latch 1220 may be pivotally coupled (e.g., via a first pin 1225 or the like) to the first bar portion 1204 and a distal end (e.g., in the +X direction of the coordinate axes of FIG. 12) of the first retention latch 1220 may define a first engagement face 1224 (see also FIGS. 13A-13C) that selectively interfaces with a first stop surface 1226 (see also FIGS. 13A-13C) of the first sling attachment portion 1216. As depicted in FIG. 12, the first engagement face 1224 of the first retention latch 1220 may interfere with the first stop surface 1226 of the first sling attachment portion 1216 such that the first retention latch 1220 is constrained to pivot between an open position (e.g., depicted in FIG. 13C) and a closed position (e.g., depicted in FIG. 13A). In particular, the first retention latch 1220 may pivot (e.g., about first pin 1225) in a counter-clockwise direction about a second axis (e.g., axis B-B as depicted in FIG. 12) until a body of the first retention latch 1220 interfaces with a surface of the first bar portion 1204 (e.g., the open position) and to pivot (e.g., about first pin 1225) in a clockwise direction about the second axis until the first engagement face 1224 interfaces with the first stop surface 1226 (e.g., the closed position). The interface between the first engagement face 1224 and the first stop surface 1226 restrains any of one or more than one sling loop (not shown) coupled to (e.g., hooked onto) the first sling attachment portion 1216 to prevent any of the one or more than one sling loop from inadvertently slipping out of the first sling attachment portion 1216 in the closed position. In some aspects, as further described herein, a mechanical device (not shown, see FIG. 13B, biasing mechanism 1304) may actively generate a first closing force that causes the first engagement face 1224 to interface with the first stop surface 1226 (e.g., a default closed position). Referring to FIG. 13B, in some aspects, the mechanical device may include a biasing mechanism 1304 (e.g., a spring) that generates a first closing force capable of pushing a pin 1306 in contact with the first retention latch 1220 to cause the first retention latch 1220 to pivot from the open position to the closed position and maintains the first engagement face 1224 in contact with the first stop surface 1226 until a first insertion force is applied to the first retention latch 1220. In such aspects, the first insertion force may be capable of pivoting the first retention latch 1220 (e.g., directly by a user and/or indirectly via a sling loop) from the closed position toward the open position. According to various aspects, the first insertion force may be a predetermined force (e.g., a set force). In other aspects, the first insertion force may be an average force capable of being generated via one hand by an average user of the sling bar 1200. In yet further aspects, the first insertion force may be a predetermined force greater than a minimum force (e.g., the hanging weight of one or more than one sling loop and/or its associated sling positioned on a first actuation surface 1234 of the first retention latch 1220). In still further aspects, the first insertion force may be a force that is greater than a predetermined biasing force of the mechanical device.

Similarly, in view of FIG. 12, a proximal end (e.g., in the +X direction of the coordinate axes of FIG. 12) of the second retention latch 1222 may be pivotally coupled (e.g., via a second pin 1228 or the like) to the second bar portion 1206 and a distal end (e.g., in the −X direction of the coordinate axes of FIG. 12) of the second retention latch 1222 may define a second engagement face 1230 (see also FIGS. 13A-13C) that selectively interfaces with a second stop surface 1232 (see also FIGS. 13A-13C) of the second sling attachment portion 1218. As depicted in FIG. 12, the second engagement face 1230 of the second retention latch 1222 may interfere with the second stop surface 1232 of the second sling attachment portion 1218 such that the second retention latch 1222 is constrained to pivot between an open position and a closed position. In particular, the second retention latch 1222 may pivot (e.g., about second pin 1228) in a clockwise direction about a third axis (e.g., axis C-C as depicted in FIG. 12) until a body of the second retention latch 1222 interfaces with a surface of the second bar portion 1206 (e.g., the open position) and to pivot (e.g., about second pin 1228) in a counter-clockwise direction about the third axis until the second engagement face 1230 interfaces with the second stop surface 1232 (e.g., the closed position). The interface between the second engagement face 1230 and the second stop surface 1232 restrains any of one or more than one sling loop (not shown) coupled to (e.g., hooked onto) the second sling attachment portion 1218 to prevent any of the one or more than one sling loop from inadvertently slipping out of the second sling attachment portion 1218 in the closed position. In some aspects, as further described herein, a mechanical device (not shown, see e.g., FIG. 13B) may actively generate a second closing force that causes the second engagement face 1230 to interface with the second stop surface 1232 (e.g., a default closed position). In some aspects, the mechanical device may be configured to generate a second closing force capable of pivoting the second retention latch 1222 from the open position to the closed position and capable of maintaining the second engagement face 1230 in contact with the second stop surface 1232 until a second insertion force is applied to the second retention latch 1222. In such aspects, the second insertion force may be capable of pivoting the second retention latch 1222 (e.g., directly by a user and/or indirectly via a sling loop) from the closed position toward the open position. According to various aspects, the second insertion force may be a predetermined force (e.g., a set force). In other aspects, the second insertion force may be an average force capable of being generated via one hand by an average user of the sling bar 1200. In yet further aspects, the second insertion force may be a predetermined force greater than a minimum force (e.g., the hanging weight of one or more than one sling loop and/or its associated sling positioned on a second actuation surface 1236 of the second retention latch 1222). In still further aspects, the second insertion force may be a force that is greater than a predetermined biasing force of the mechanical device.

In view of FIG. 12, the first retention latch 1220 of the sling bar 1200 may be defined by a material capable of maintaining the interface between the first engagement face 1224 and the first stop surface 1226, as described herein (e.g., to prevent one or more than one sling loop from inadvertently slipping out of the first sling attachment portion 1216). For example, the material of the first retention latch 1220 should not break, flex/deflect laterally (e.g., in the +Z and/or −Z direction of the coordinate axes of FIG. 12) and/or deform vertically (e.g., in the +Y and/or −Y direction of the coordinate axes of FIG. 12) such that the first engagement face 1224 of the first retention latch 1220 is able to pivot (e.g., about first pin 1225) in a clockwise direction about the second axis (e.g., axis B-B depicted in FIG. 12) past the first stop surface 1226 of the first sling attachment portion 1216. In some aspects, the first retention latch 1220 may be defined by a cast aluminum, a laser cut steel, and/or the like.

Similarly, the second retention latch 1222 of the sling bar 1200 may be defined by a material capable of maintaining the interface between the second engagement face 1230 and the second stop surface 1232, as described herein (e.g., to prevent one or more than one sling loop from inadvertently slipping out of the second sling attachment portion 1218). For example, the material of the second retention latch 1222 should not break, flex/deflect laterally (e.g., in the +Z and/or −Z direction of the coordinate axes of FIG. 12) and/or deform vertically (e.g., in the +Y and/or −Y direction of the coordinate axes of FIG. 12) such that the second engagement face 1230 of the second retention latch 1222 is able to pivot (e.g., about second pin 1228) in a counter-clockwise direction about the third axis (e.g., axis C-C depicted in FIG. 2) past the second stop surface 1232 of the second sling attachment portion 1218. In some aspects, the second retention latch 1222 may be defined by a cast aluminum, a laser cut steel, and/or the like.

Figure 13A:
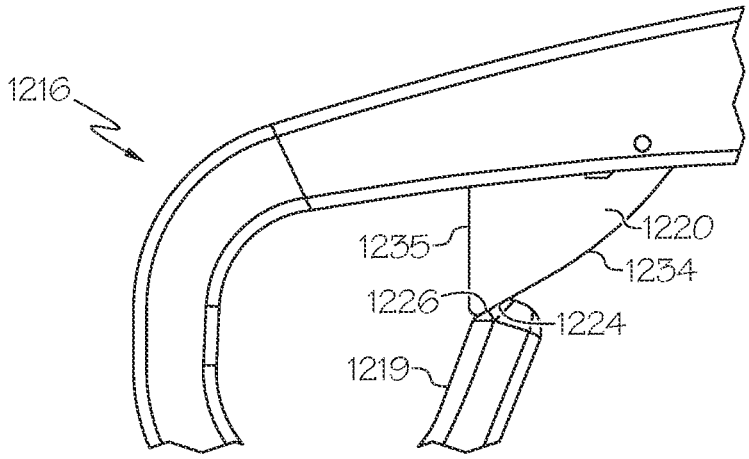
FIG. 13A depicts a side view of an illustrative underhook attachment portion of the illustrative sling bar of FIG. 12 according to one or more aspects shown and described herein.
Figure 13B:
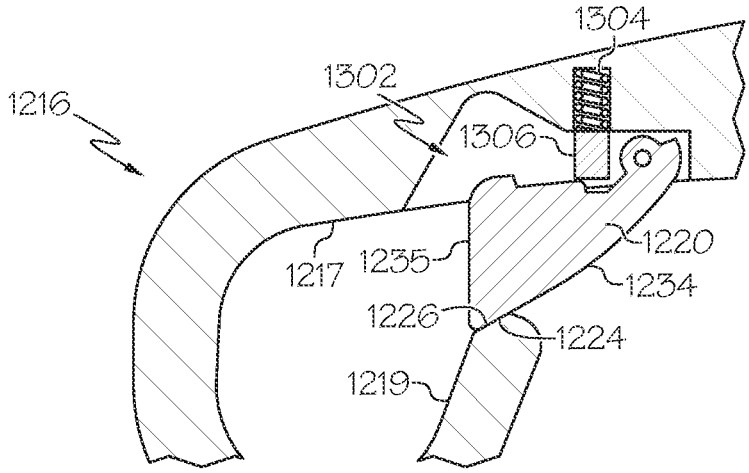
FIG. 13B depicts a cross-sectional side view of the illustrative underhook attachment portion of FIG. 13A according to one or more aspects shown and described herein.
Figure 14:
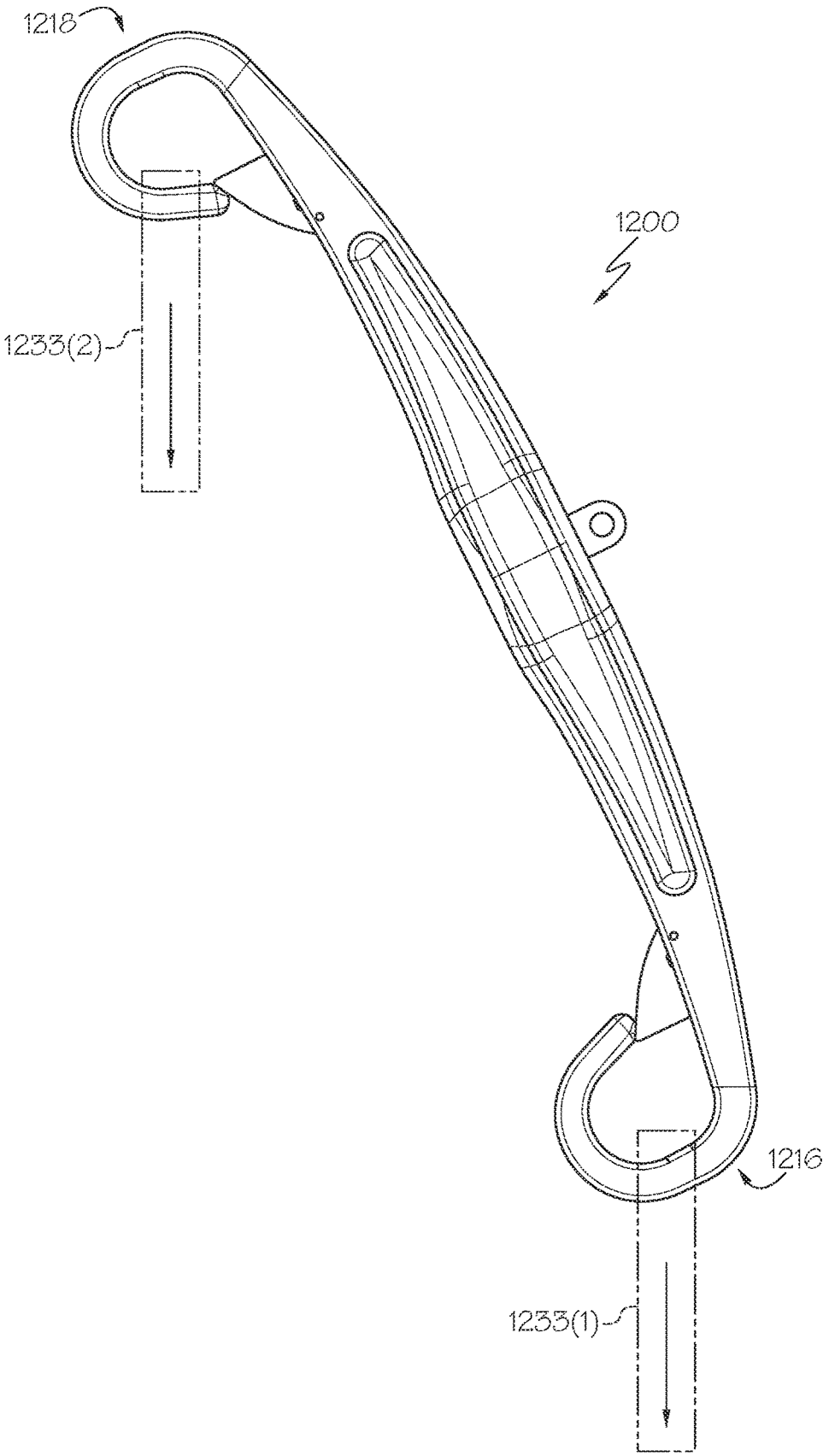
FIG. 14 depicts a side view of the illustrative sling bar of FIG. 12 in an extreme angle positioning according to one or more aspects shown and described herein.

Referring to FIGS. 13A-13B, the first retention latch 1220 may be shaped and/or sized to support a load if one or more than one sling loops slides from an aperture facing side 1219 of the first sling attachment portion 1216 to an aperture-facing side 1235 of the first retention latch 1220 without the first retention latch 1220 moving from the closed position to the open position. In some aspects, a load may be supported by the aperture-facing side 1235 of the first retention latch 1220 when the sling bar 1200 is in an extreme angle positioning as depicted, for example, in FIG. 14. That is, as shown in FIG. 14, when in the extreme angle positioning, one end of the sling bar 1200 is raised higher than another end of the sling bar (e.g., the second sling attachment portion 1218 is raised higher than the first sling attachment portion 1216 in FIG. 14). Referring again to FIGS. 13A-13B, the aperture-facing side 1235 of the first retention latch 1220 is generally aligned with the aperture facing side 1219 of the first sling attachment portion 1216 that extends the fourth predetermined distance such that one or more than one slink loops can slide between the sling attachment portion 1216 and the first retention latch 1220. Further, as depicted in FIG. 13B, the aperture-facing side 1235 of the first retention latch 1220 is substantially parallel to the axis of rotation of the first retention latch 1220 (e.g., axis B-B depicted in FIG. 12) when the first retention latch 1220 is in the closed position such that forces on the aperture-facing side 1235 of the first retention latch 1220 that are transverse to the axis of rotation of the first retention latch 1220 (e.g., forces from the one or more than one straps when the sling bar 1200 is in the extreme angle positioning) will not cause the first retention latch 1220 to rotate to the open position. Such a shape of the aperture-facing side 1235 of the first retention latch 1220 also allows for the one or more than one loop to slide into place on the first sling attachment portion 1216 under force of gravity when the sling bar is not in an extreme angle positioning, thereby avoiding strap misplacement and/or false connection.

Figure 13C:
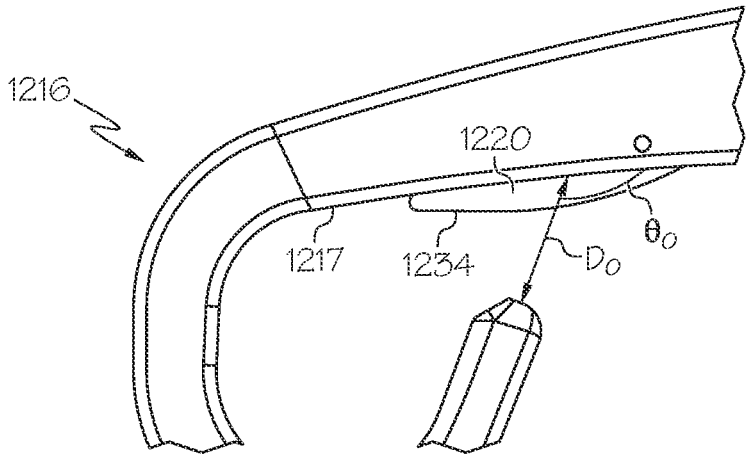
FIG. 13C depicts a side view of the illustrative underhook attachment portion of FIG. 13A with the latch in an open position according to one or more aspects shown and described herein.

Referring to FIGS. 12 and 13B-13C, the first retention latch 1220 is further shaped to be received within a recess 1302 (FIG. 13B) of the first bar portion 1204 when the first retention latch 1220 is rotated into the open position (e.g., as depicted in FIG. 13C). In some aspects, the recess 1302 of the first bar portion 1204 may be shaped and/or sized to correspond to the first retention latch 1220 such that the first retention latch 1220, when in the open position, sits within the recess so that the first actuation surface 1234 is flush with a downward-facing surface 1217 of the first bar portion 1204 or extends slightly outward from the downward-facing surface 1217 of the first bar portion 1204, as depicted in FIG. 13C. Such as shape and/or size of the recess 1302 may prevent the one or more than one sling loop from becoming wedged or bunched up against the first retention latch 1220 when located on the first sling attachment portion 1216.

It should be understood that while FIGS. 13A-13C relate primarily to the first sling attachment portion 1216 and the first retention latch 1220, similar features may also be used for the second sling attachment portion 1218 and the second retention latch 1222 depicted in FIG. 12.

Figure 15:
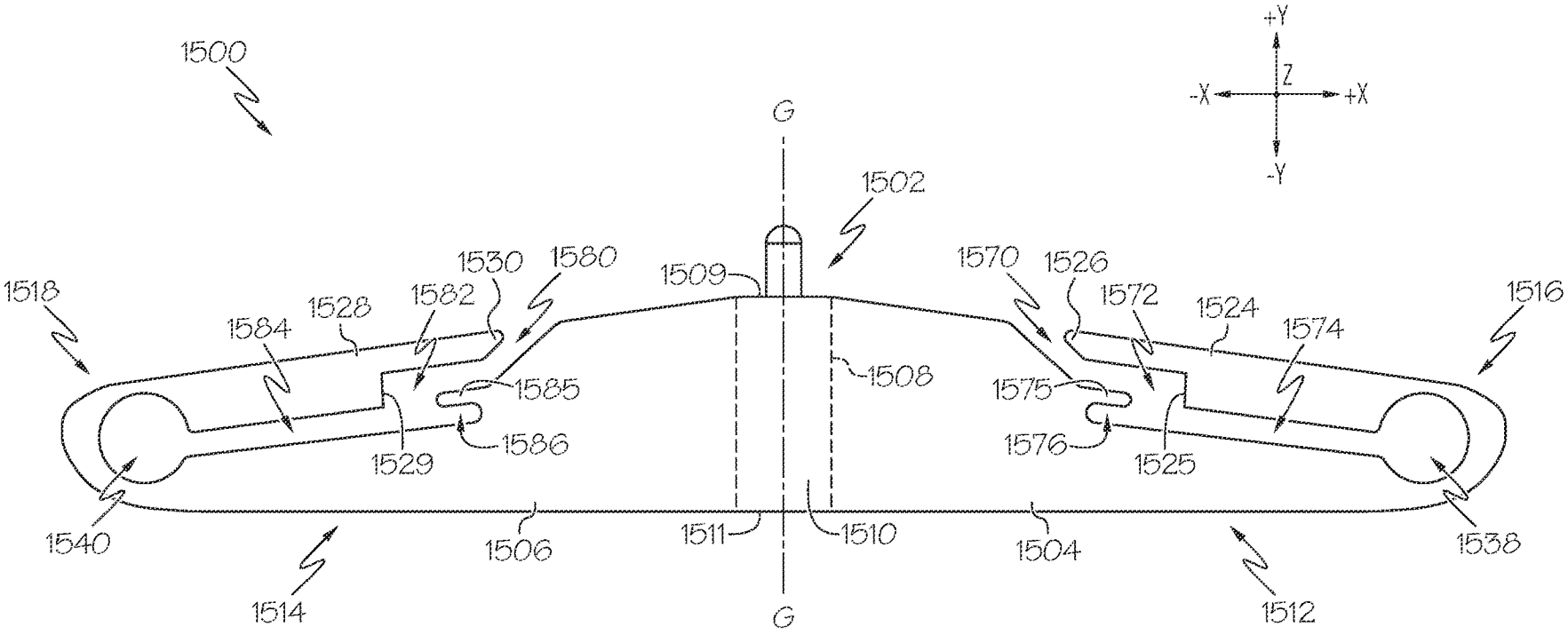
FIG. 15 depicts a side view of another illustrative sling bar that includes at least one latch free sling attachment portion according to one or more aspects shown and described herein.

FIG. 15 depicts a side view of another illustrative sling bar 1500 that includes at least one latch free sling attachment portion 1516, 1518 according to one or more aspects of the present disclosure. Referring to FIG. 15, the sling bar 1500 may include a hub portion 1502, a first bar portion 1504, and a second bar portion 1506. In such an aspect, the hub portion 1502 may be defined, concentrically, about a first axis (e.g., axis G-G as depicted in FIG. 15). The hub portion 1502 may define an internal hub surface (not shown) and an external hub surface 1510. Each of the internal hub surface and the external hub surface 1510 may be generally cylindrically shaped and extend about the first axis (e.g., axis G-G as depicted in FIG. 15) between a first horizontal surface 1509 (e.g., in the +Y direction of the coordinate axes of FIG. 15) and a second horizontal surface 1511 (e.g., in the −Y direction of the coordinate axes of FIG. 15). In view of FIG. 15, a lift hook (e.g., the lift hooks described herein with respect to FIGS. 1 and 3) may be coupled to the sling bar 1500 at or near the first horizontal surface 1509. The first bar portion 1504 may extend from the external hub surface 1510 of the hub portion 1502 in a first longitudinal direction (e.g., in the +X direction of the coordinate axes of FIG. 15) toward a first end 1512, and the second bar portion 1506 may extend from the external hub surface 1510 of the hub portion 1502 in a second longitudinal direction (e.g., in the −X direction of the coordinate axes of FIG. 15) toward a second end 1514.

Referring still to FIG. 15, the sling bar 1500 may further include a first latch free sling attachment portion 1516 positioned at or near the first end 1512, in the first longitudinal direction (e.g., in the =X direction of the coordinate axes of FIG. 15), of the first bar portion 1504 and a second latch free sling attachment portion 1518 positioned at or near the second end 1514, in the second longitudinal direction (e.g., in the −X direction of the coordinate axes of FIG. 15), of the second bar portion 1506. Each of the first latch free sling attachment portion 1516 and the second latch free sling attachment portion 1518 may selectively couple a subject sling to the sling bar 1500, as described herein. In particular, each of the first latch free sling attachment portion 1516 and the second latch free sling attachment portion 1518 may be sized and/or dimensioned to couple to one or more than one sling loop of one or more than one subject sling as described more fully herein. In addition, each of the first latch free sling attachment portion 1516 and the second latch free sling attachment portion 1518 may be sized and/or dimensioned to allow one or more than one sling loop of the one or more than one subject sling to be supported for extreme angle use of the sling bar 1500, as described more fully herein.

In view of FIG. 15, the first latch free sling attachment portion 1516 may extend from the first bar portion 1504 (e.g., at or near the first end 1512 thereof) in generally the first longitudinal direction (e.g., in the +X direction of the coordinate axes of FIG. 15) a first predetermined distance, extend (e.g., hook upward) in generally the first vertical direction (e.g., in the +Y direction of the coordinate axes of FIG. 15) a second predetermined distance, and extend back (e.g., hook back) in generally the second longitudinal direction (e.g., in the −X direction of the coordinate axes of FIG. 15) toward the first bar portion 1504 a third predetermined distance to define a first receiving aperture 1538. Accordingly, a first terminus 1526 of the first latch free sling attachment portion 1516 faces the first bar portion 1504 at a distance from the first bar portion 1504, defining a first opening 1570 into the first receiving aperture 1538 (via a first elevation channel 1572 and a first extension channel 1574) between the first terminus 1526 and the first bar portion 1504, as depicted in FIG. 15. The first elevation channel 1572 may generally define a passageway along the Y axis of the coordinate axes of FIG. 15 between the first opening 1570 and the first extension channel 1574 (e.g., traversing the first elevation channel 1572 from the first opening 1570 to the first extension channel 1574 may include generally moving in the −Y direction of the coordinate axes of FIG. 15). In addition, the first extension channel 1574 may generally define a passageway along the X axis of the coordinate axes of FIG. 15 between the first elevation channel 1572 and the first receiving aperture 1538 (e.g., traversing the first extension channel 1574 from the first elevation channel 1572 to the first receiving aperture 1538 may include generally moving in the +X direction of the coordinate axes of FIG. 15).

Similarly in view of FIG. 15, the second latch free sling attachment portion 1518 may extend from the second bar portion 1506 (e.g., at or near the second end 1514 thereof) in generally the second longitudinal direction (e.g., in the −X direction of the coordinate axes of FIG. 15) the first predetermined distance, extend (e.g., hook upward) in generally the first vertical direction (e.g., in the +Y direction of the coordinate axes of FIG. 15) the second predetermined distance, and extend back (e.g., hook back) in generally the first longitudinal direction (e.g., in the +X direction of the coordinate axes of FIG. 15) toward the second bar portion 1506 the third predetermined distance to define a second receiving aperture 1540. Accordingly, a second terminus 1530 of the second latch free sling attachment portion 1518 faces the second bar portion 1506 at a distance from the second bar portion 1506, defining a second opening 1580 into the second receiving aperture 1540 (via a second elevation aperture 1582 and a second extension aperture 1584) between the second terminus 1530 and the second bar portion 1506, as depicted in FIG. 15. The second elevation channel 1582 may generally define a passageway along the Y axis of the coordinate axes of FIG. 15 between the second opening 1580 and the second extension channel 1584 (e.g., traversing the second elevation channel 1582 from the second opening 1580 to the second extension channel 1584 may include generally moving in the −Y direction of the coordinate axes of FIG. 15). In addition, the second extension channel 1584 may generally define a passageway along the X axis of the coordinate axes of FIG. 15 between the second elevation channel 1582 and the second receiving aperture 1540 (e.g., traversing the second extension channel 1584 from the second elevation channel 1582 to the second receiving aperture 1540 may include generally moving in the −X direction of the coordinate axes of FIG. 15).

As introduced herein, each of the first latch free sling attachment portion 1516 and the second latch free sling attachment portion 1518 may be sized and/or dimensioned to couple to one or more than one sling loop. Accordingly, the first predetermined distance, the second predetermined distance, and/or the third predetermined distance that define the first and second openings 1570, 1580, the first and second elevation channels 1572, 1582, the first and second extension channels 1574, 1584, and the first and second receiving apertures 1538, 1540 may be based on various parameters (e.g., thickness, width, elasticity, and/or the like) of one or more than one sling loop. Further, a plurality of sling bars 1500 may be manufactured to include a first latch free sling attachment portion 1516 and a second latch free sling attachment portion 1518, where each sling bar 1500 has a different first, second and/or third predetermined distance. According to various aspects, the first, second, and/or third predetermined distance may be based on a combination of parameters associated with one or more than one sling loop anticipated to couple to the first latch free sling attachment portion 1516 and the second latch free sling attachment portion 1518. Furthermore, the plurality of sling bars 1500 may be manufactured where each sling bar 1500 has a different overall length. Here, each overall length may be based on a combination of parameters associated with a subject sling anticipated to couple to each sling bar.

In some aspects, the first end 1512 of the first bar portion 1504 may further include a first protrusion 1575 that extends a distance from the hub portion 1502 in generally the first longitudinal direction (e.g., in the +X direction of the coordinate axes of FIG. 15) into the first elevation channel 1572 to define a first undercut portion 1576 of the first elevation channel 1572 that is located underneath the first protrusion 1575 (e.g., the area located directly adjacent to the first protrusion 1575 in generally the −Y direction of the coordinate axes of FIG. 15). The first undercut portion 1576 is generally an extension of the first extension channel 1574, as described herein. The distance in which the first protrusion 1575 extends is generally a distance that is sufficiently long to cause an extension of the first extension channel 1574 in the form of the first undercut portion 1576 to maintain a positioning of one or more than one sling loop secured on the first latch free sling attachment portion 1516 in the first undercut portion 1576 when the sling bar 1500 is positioned in an extreme angle positioning (e.g., when the sling bar 1500 is coupled to the sling bar attachment mechanism 208 depicted in FIG. 2 and the first bar portion 1504 is shifted higher in the first vertical direction relative to the second bar portion 1506), but is not so long that when one or more than one sling loop is secured on the first latch free sling attachment portion 1516 and the extreme angle positioning forces the one or more than one sling loop into the first undercut portion 1570, the one or more than one sling loop becomes folded, caught, or the like. For example, in some aspects, the distance in which the first protrusion 1575 extends may be from about 1 mm to about 25 mm, including about 1 mm, about 5 mm, about 10 mm, about 15 mm, about 20 mm, about 25 mm, or any value or range between any two of these values (including endpoints). In some aspects, the distance in which the first protrusion 1575 extends may be a distance that is less than or equal to a width of a sling loop to be used with the sling bar 1000 to avoid a situation where the sling loop is wider than the distance, which could result in instances of misuse at extreme angle positioning, such as bunching, folding, catching, pinching, or the like, as described herein. For example, if the width of a sling loop is 25 mm, the distance in which the first protrusion 1575 extends may be less than or equal to 25 mm, such as 20 mm or less.

Accordingly, the first undercut portion 1576 may be shaped, sized and/or configured to receive one or more than one sling loop and maintain a position of the one or more than one sling loop in instances when the sling bar 1500 is positioned in the extreme angle positioning, as described in further detail hereinbelow. For example, the first undercut portion 1576 may have a shelf, a notch, or the like that provides a surface for supporting one or more than one sling loop when the sling bar 1500 is positioned in the extreme angle positioning. In another example, the first undercut portion 1576 may be formed as a right angle or an acute angle at a point where the underside of the first protrusion 1575 (e.g., the portion of the first protrusion 1575 towards the −Y direction of the coordinate axes of FIG. 15) meets the body of the first sling attachment portion 1516 and/or the body of the first bar portion 1504. In yet another example, the first undercut portion 1576 may be formed as a rounded area at an area where the underside of the first protrusion 1575 meets the body of the first sling attachment portion 1516 and/or the body of the first bar portion 1504. The angle or the rounded area may prevent one or more than one sling loop from becoming bunched, folded, pinched or the like within the first undercut portion 1576.

Still referring to FIG. 15, the second end 1514 of the second bar portion 1506 may further include a second protrusion 1585 that extends a distance from the hub portion 1502 in generally the second longitudinal direction (e.g., in the −X direction of the coordinate axes of FIG. 15) into the second elevation channel 1582 to define a second undercut portion 1586 of the second elevation channel 1572 that is located underneath the second protrusion 1585 (e.g., the area located directly adjacent to the second protrusion 1585 in generally the −Y direction of the coordinate axes of FIG. 15). The second undercut portion 1586 is generally an extension of the second extension channel 1574, as described herein. The distance in which the second protrusion 1576 extends is generally a distance that is sufficiently long to cause an extension of the second extension channel 1584 in the form of the second undercut portion 1586 to maintain a positioning of one or more than one sling loop secured on the second latch free sling attachment portion 1518 in the second undercut portion 1586 when the sling bar 1500 is positioned in an extreme angle positioning (e.g., when the sling bar 1500 is coupled to the sling bar attachment mechanism 208 depicted in FIG. 2 and the second bar portion 1506 is shifted higher in the first vertical direction relative to the first bar portion 1504), but is not so long that when one or more than one sling loop is secured on the second latch free sling attachment portion 1518 and the extreme angle positioning forces the one or more than one sling loop into the second undercut portion 1586, the one or more than one sling loop becomes folded, caught, or the like, thereby potentially hindering movement of various components such as retention latches or the like, as described herein. For example, in some aspects, the distance in which the second protrusion 1576 extends may be from about 1 mm to about 25 mm, including about 1 mm, about 5 mm, about 10 mm, about 15 mm, about 20 mm, about 25 mm, or any value or range between any two of these values (including endpoints). In some aspects, the distance in which the second protrusion 1576 extends may be a distance that is less than or equal to a width of a sling loop to be used with the sling bar 1500 to avoid a situation where the sling loop is wider than the distance in which the second protrusion 1576 extends, which could result in instances of misuse at extreme angle positioning, such as bunching, folding, catching, pinching, or the like, as described herein. For example, if the width of a sling loop is 25 mm, the distance in which the second protrusion 1576 extends may be less than or equal to 25 mm, such as 20 mm or less.

Accordingly, the second undercut portion 1586 may be shaped, sized and/or configured to receive one or more than one sling loop and maintain a positioning of the one or more than one sling loop in instances when the sling bar 1500 is positioned in the extreme angle positioning, as described in further detail hereinbelow. For example, the second undercut portion 1586 may have a shelf, a notch, or the like that provides a surface for supporting one or more than one sling loop when the sling bar 1500 is positioned in the extreme angle positioning. In another example, the second undercut portion 1586 may be formed as a right angle or an acute angle at a point where the underside of the second protrusion 1585 (e.g., the portion of the second protrusion 1585 towards the −Y direction of the coordinate axes of FIG. 15) meets the body of the second sling attachment portion 1518 and/or the body of the second bar portion 1506. In yet another example, the second undercut portion 1586 may be formed as a rounded area at an area where the underside of the second protrusion 1585 meets the body of the second sling attachment portion 1518 and/or the body of the second bar portion 1506. The angle or the rounded area may prevent one or more than one sling loop from becoming bunched, folded, pinched, or the like within the second undercut portion 1586.

Given the foregoing description of FIG. 15, it should be appreciated that such a maintaining of the one or more than one sling loop within the first undercut portion 1576 may prevent the one or more than one sling loop from becoming wedged or bunched up when the sling bar 1500 is positioned in the extreme angle positioning, yet still allows for the one or more than one sling loop to be supported within the first undercut portion 1576 during extreme angle positioning. Similarly, such a maintaining of the one or more than one sling loop within the second undercut portion 1586 may prevent the one or more than one sling loop from becoming wedged or bunched up when the sling bar 1500 is positioned in the extreme angle positioning, yet still allows for the one or more than one sling loop to be supported within the second undercut portion 1586 during extreme angle positioning. The shape, size, and configuration of the first protrusion 1575 and the second protrusion 1585 (as well as the shape, size, and configuration of the first undercut portion 1576 and the second undercut portion 1586 formed therefrom, respectively) represent an improvement over other retention latches that have no protrusion at all or a longer protrusion because the one or more than one sling loop can be maintained and prevented from further movement during extreme angle positioning where such maintaining would not be feasible or possible in other configurations because the one or more than one sling loop would slip or would get caught, bunched, or the like.

Still referring to FIG. 15, the first latch free sling attachment portion 1516, when extending in the third predetermined distance, defines a first extension portion 1524. The first extension portion 1524 is generally a section of the first latch free sling attachment portion 1516 that extends above (e.g., in the +Y direction of the coordinate axes of FIG. 15) the first elevation channel 1572, the first protrusion 1575, the first undercut portion 1576, the first extension channel 1574, and the first receiving aperture 1538, thereby defining the first elevation channel 1572, the first extension channel 1574, and the first receiving aperture 1538. As such, the first extension portion 1524 has varying thicknesses across a length thereof such that the first receiving aperture 1538 is a particular shape (e.g., round, as depicted in FIG. 15), the first extension channel 1574 has a height (e.g., in the +Y/−Y directions of the coordinate axes of FIG. 15) that is less than a height (e.g., in the +Y/−Y directions of the coordinate axes of FIG. 15) of the first elevation channel 1572. As such, when traversing the first extension channel 1574 from the first receiving aperture 1538 to the first elevation channel 1572, the varying thicknesses of the first extension portion 1524 cause the first elevation channel 1572 to extend to a height in the +Y direction of the coordinate axes that is higher than that of the first extension channel 1574. That is, the thickness of the first extension portion 1524 is such that a relatively thinner section above the first elevation channel 1572 transitions to a relatively thicker section above the first extension portion 1524, resulting in a first wall 1524 that is an outward limit (e.g., in the +X direction of the coordinate axes of FIG. 15) of the first elevation channel 1572. It should be appreciated that this change in thickness may avoid or reduce the likelihood of a sling loop slipping off the first latch free sling attachment portion 1516 during use, including when the sling bar 1500 is positioned in an extreme angle positioning as described herein.

Similarly, the second latch free sling attachment portion 1518, when extending in the third predetermined distance, defines a second extension portion 1528. The second extension portion 1528 is generally a section of the second latch free sling attachment portion 1518 that extends above (e.g., in the +Y direction of the coordinate axes of FIG. 15) the second elevation channel 1582, the second protrusion 1585, the second undercut portion 1586, the second extension channel 1584, and the second receiving aperture 1540, thereby defining the second elevation channel 1582, the second extension channel 1584, and the second receiving aperture 1540. As such, the second extension portion 1528 has varying thicknesses across a length thereof such that the second receiving aperture 1540 is a particular shape (e.g., round, as depicted in FIG. 15), the second extension channel 1584 has a height (e.g., in the +Y/−Y directions of the coordinate axes of FIG. 15) that is less than a height (e.g., in the +Y/−Y directions of the coordinate axes of FIG. 15) of the second elevation channel 1582. As such, when traversing the second extension channel 1584 from the second receiving aperture 1540 to the second elevation channel 1582, the varying thicknesses of the second extension portion 1528 cause the second elevation channel 1582 to extend to a height in the +Y direction of the coordinate axes that is higher than that of the second extension channel 1584. That is, the thickness of the second extension portion 1528 is such that a relatively thinner section above the second elevation channel 1582 transitions to a relatively thicker section above the second extension portion 1528, resulting in a second wall 1529 that is an outward limit (e.g., in the −X direction of the coordinate axes of FIG. 15) of the second elevation channel 1582. It should be appreciated that this change in thickness may avoid or reduce the likelihood of a sling loop slipping off the second latch free sling attachment portion 1518 during use, including when the sling bar 1500 is positioned in an extreme angle positioning as described herein.

In light of FIG. 15, various components of the sling bar 1500 including the hub portion 1502, the first bar portion 1504, the second bar portion 1506, the first latch free sling attachment portion 1516, and/or the second latch free sling attachment portion 1518 may be defined by a material capable of withstanding anticipated static and/or dynamic forces on the sling bar 1500 without fatigue and/or failure of such various components. According to various aspects, each component may be dimensioned to withstand, alone and/or in combination with other components, the anticipated static and/or dynamic forces. In some aspects, the various components of the sling bar 1500 including the hub portion 1502, the first bar portion 1504, the second bar portion 1506, the first latch free sling attachment portion 1516, and/or the second latch free sling attachment portion 1518 may be defined by a cast aluminum, steel, a metal alloy, and/or the like.

It should be appreciated that, as depicted in FIG. 15, an alignment of the first extension portion 1524 with an upper surface of the hub portion 1502 and an alignment of the second extension portion 1528 with the upper surface of the hub portion 1502 provides a smooth transition to avoid or reduce the chances of situations where the first and second sling attachment portions 1516, 1518 may provide an impalement hazard. It should also be appreciated that the sling bar 1500 described with respect to FIG. 15 may be combined with various features described herein with respect to other aspects depicted in FIGS. 1-14, and the aspects of FIG. 15 are not solely limited to those depicted in FIG. 15.

Figure 16A:
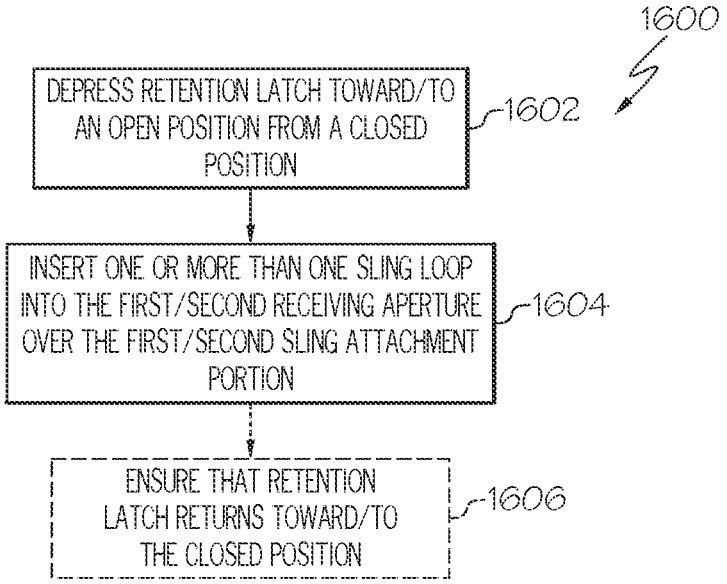
FIG. 16A depicts a flow diagram of an illustrative method for attaching a subject sling to the sling bar of FIG. 1, the sling bar of FIG. 10, or the sling bar of FIG. 12 according to one or more aspects shown and described herein.

FIG. 16A depicts a flow diagram of an illustrative method 1600 for attaching a subject sling to the sling bar 100 of FIG. 1, the sling bar 1000 of FIG. 10, or the sling bar 1200 of FIG. 12 according to one or more aspects of the present disclosure. For the purposes of brevity, the following disclosure references the components depicted in FIG. 10, but it should be understood that the components depicted in FIGS. 1 and 12 may also be manipulated accordingly. Referring to FIGS. 10 and 16A, at block 1602, a user (e.g., caregiver) may depress the first/second retention latch 1020, 1022 toward or to an open position from a closed position (e.g., by applying a first/second insertion force to the first/second retention latch 1020, 1022 to overcome a first/second closing force, respectively). In some aspects, the user may manually depress the first/second retention latch 1020, 1022 using one hand. According to various aspects, manually depressing the first/second retention latch 1020, 1022 may include depressing the first/second retention latch 1020, 1022 using one or more than one sling loop itself. In such aspects, each sling loop (e.g., sling loop 1033, depicted in phantom in FIG. 11A for example) associated with a subject sling may include a hoop portion 1035 (e.g., having a stiffened portion) configured to interface with the first/second retention latch 1020, 1022 (see FIG. 10, e.g., a first actuation surface 1034 and/or a second actuation surface 1036) to depress the first/second retention latch 1020, 1022 respectively toward or to the open position (e.g., when the sling loop 1033 is pulled in a second vertical direction (e.g., downward) by a user). At block 1604, the user may insert one or more than one sling loop into the first/second receiving aperture 1038, 1040 over the first/second low profile sling attachment portion 1016, 1018 such that a loop of each sling loop hooks onto or couples to the first/second low profile sling attachment portion 1016, 1018, respectively. Such aspects are an improvement over sling bars that require a two-handed and/or two-step operation to attach sling loops (e.g., one hand/step to manually lift up a latch and another hand/step to attach a sling loop). A one-handed and/or one-step operation for attaching a sling loop enables a user (e.g., caregiver) to maintain contact with a subject with their other hand as the user attaches each sling loop of the one or more than one sling loop to the sling bar 1000. At block 1606 (e.g., depicted in phantom as optional), the user may ensure that the first/second retention latch 1020, 1022 returns toward or to the closed position. In some aspects, the first/second retention latch 1020, 1022 may automatically return to the closed position. In such aspects, the first/second retention latch 1020, 1022 may be returned to the closed position via a mechanical device as described herein. In other aspects, the user may manually return the first/second retention latch 1020, 1022 to the closed position. According to various aspects, in the closed position, each sling loop hooked onto or coupled to the first/second low profile sling attachment portion 1016, 1018 is retained by the first/second low profile sling attachment portion 1016, 1018 respectively. Each sling loop associated with the subject sling may be coupled to the sling bar 1000 as described herein to attach the subject sling to the sling bar 1000.

It should be appreciated that while FIG. 16A depicts block 1606 as optional, this is only one illustrative aspect. That is, block 1606 may be required in other aspects. In addition, the depiction of block 1606 as optional does not imply that the processes described with respect to blocks 1602 and 1604 are required.

Figure 16B:
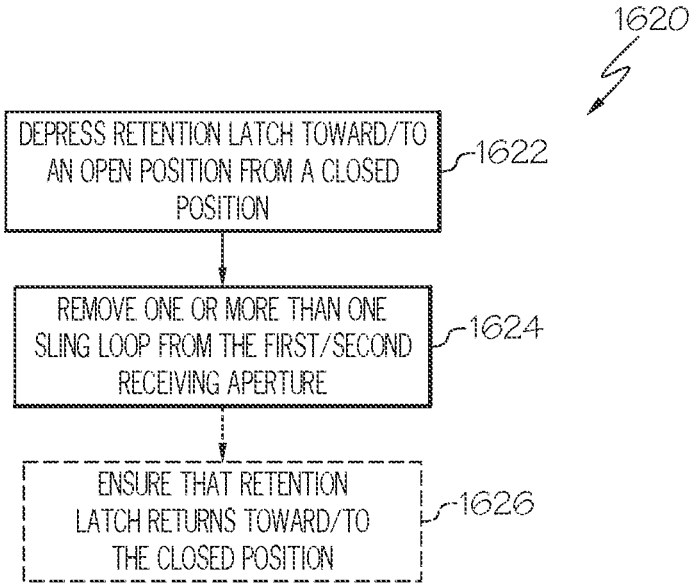
FIG. 16B depicts a flow diagram of an illustrative method for detaching a subject sling from the sling bar of FIG. 1, the sling bar of FIG. 10, or the sling bar of FIG. 12 according to one or more aspects shown and described herein.

FIG. 16B depicts a flow diagram of an illustrative method 1620 for detaching a subject sling from the sling bar 100 of FIG. 1, the sling bar 1000 of FIG. 10, or the sling bar 1200 of FIG. 12 according to one or more aspects of the present disclosure. For the purposes of brevity, the following disclosure references the components depicted in FIG. 10, but it should be understood that the components depicted in FIGS. 1 and 12 may also be manipulated accordingly. Referring to FIGS. 10 and 16B, at block 1622, a user (e.g., caregiver) may depress the first/second retention latch 1020, 1022 toward or to an open position from a closed position. In some aspects, the user may manually depress the first/second retention latch 1020, 1022 using their first hand. At block 1624, the user may remove one or more than one sling loop from the first/second receiving aperture 1038, 1040, respectively. According to various aspects, the user may, while depressing the first/second retention latch 1020, 1022 with their first hand, remove the one or more than one sling loop from the first/second receiving aperture 1038, 1040 respectively, with their second hand. In such aspects, a two-hand removal of each sling loop may ensure that only one or more than one particular sling loop is removed from the first/second receiving aperture 1038, 1040 (e.g., requires the user to focus on which sling loop(s) are to be removed). At block 1626 (e.g., depicted in phantom as optional) the user may ensure that the first/second retention latch 1020, 1022 returns toward or to the closed position. In some aspects, the first/second retention latch 1020, 1022 may automatically return to the closed position. In such aspects, the first/second retention latch 1020, 1022 may be returned to the closed position via a mechanical device as described herein. In other aspects, the user may manually return the first/second retention latch 1020, 1022 to the closed position. According to various aspects, in the closed position, each remaining sling loop hooked onto or coupled to the first/second low profile sling attachment portion 1016, 1018 is still retained by the first/second low profile sling attachment portion 1016, 1018 respectively. Each sling loop associated with the subject sling may be selectively detached from the sling bar 1000 as described herein to remove the subject sling from the sling bar 1000.

It should be appreciated that while FIG. 16B depicts block 1626 as optional, this is only one illustrative aspect. That is, block 1626 may be required in other aspects. In addition, the depiction of block 1626 as optional does not imply that the processes described with respect to blocks 1622 and 1624 are required.

Figure 17A:
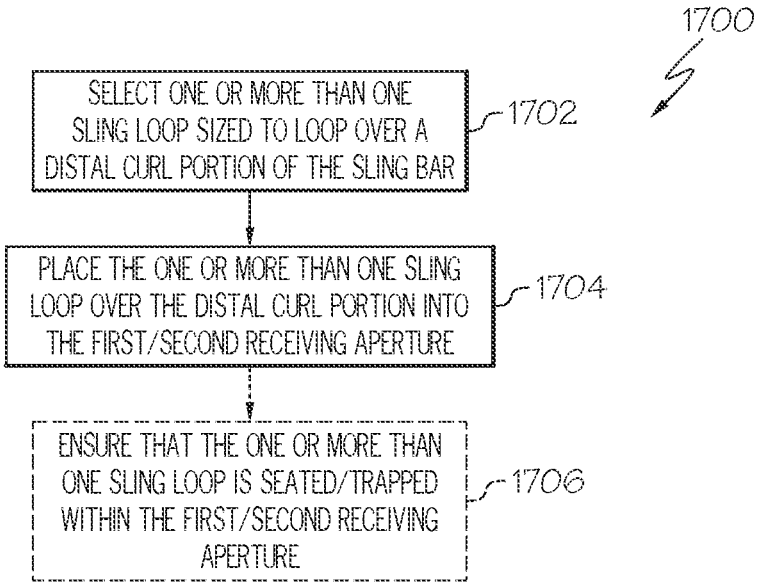
FIG. 17A depicts a flow diagram of an illustrative method for attaching a subject sling to the sling bar of FIGS. 8 and 9B according to one or more aspects shown and described herein.

FIG. 17A depicts a flow diagram of an illustrative method 1700 for attaching a subject sling to the sling bar of FIGS. 8 and 9B, according to one or more aspects of the present disclosure. Referring to FIG. 17A, at block 1702, a user (e.g., caregiver) may select one or more than one sling loop sized to loop over a distal curl portion 837, 841 of the sling bar 800 or the distal curl portion 937, 941 of the sling bar 900, respectively. At block 1704, the user may place the one or more than one sling loop over the distal curl portion 837, 841 into the first/second receiving aperture 838, 840 of the sling bar 800 or over the distal curl portion 937, 941 into the first/second receiving aperture 938, 940 of the sling bar 900, respectively. In some aspects, the user may place the one or more than one sling loop as described using one hand. Such aspects are an improvement over sling bars that require a two-handed and/or two-step operation to attach sling loops. A one-handed and/or one-step operation for attaching a sling loop enables a user (e.g., caregiver) to maintain contact with a subject with their other hand as the user attaches each sling loop of the one or more than one sling loop to the sling bar 800, 900. At block 1706 (e.g., depicted in phantom as optional), the user may ensure that the one or more than one sling loop is fully seated and/or trapped within the first/second receiving aperture 838, 840 of the sling bar 800 or the first/second receiving aperture 938, 940 of the sling bar 900, respectively. In some aspects, the distal curl portion 837, 841 of the sling bar 800 and the distal curl portion 937, 941 of the sling bar 900, respectively, may function to trap the one or more than one sling loop within the first/second receiving aperture 838, 840 of the sling bar 800 or the first/second receiving aperture 938, 940 of the sling bar 900, respectively such that an inadvertent slip out of the one or more than one sling loop is avoided (e.g., even when no-load conditions exist). Each sling loop associated with the subject sling may be coupled to the sling bar 800, 900 as described herein to attach the subject sling to the sling bar 800, 900.

It should be appreciated that while FIG. 17A depicts block 1706 as optional, this is only one illustrative aspect. That is, block 1706 may be required in other aspects. In addition, the depiction of block 1706 as optional does not imply that the processes described with respect to blocks 1702 and 1704 are required.

Figure 17B:
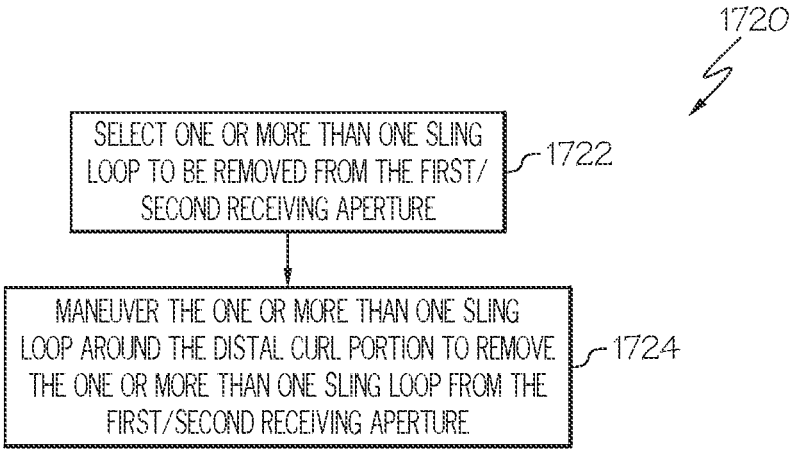
FIG. 17B depicts a flow diagram of an illustrative method for detaching a subject sling from the sling bar of FIGS. 8 and 9B according to one or more aspects shown and described herein.

FIG. 17B depicts a flow diagram of an illustrative method 1720 for detaching a subject sling from the sling bar of FIGS. 8 and 9A, according to one or more aspects of the present disclosure. Referring to FIG. 17B, at block 1722, a user (e.g., caregiver) may select one or more than one sling loop to be removed from a first/second receiving aperture 838, 840 of the sling bar 800 or a first/second receiving aperture 938, 940 of the sling bar 900, respectively. At block 1724, the user may remove the one or more than one sling loop from the first/second receiving aperture 838, 840 of the sling bar 800 or the first/second receiving aperture 938, 940 of the sling bar 900, respectively. According to various aspects described herein, removing the one or more than one sling loop may include maneuvering the one or more than one sling loop around a distal curl portion 837, 841 of the sling bar 800 or a distal curl portion 937, 941 of the sling bar 900, respectively. In some aspects, the user may remove the one or more than one sling loop as described using one hand. In other aspects, the user may stabilize the sling bar 800, 900 with a first hand and remove the one or more than one sling loop as described using their second hand. In such aspects, a two-hand removal of each sling loop may ensure that only one or more than one particular sling loop is removed from the first/second receiving aperture 838, 840 of the sling bar 800 or the first/second receiving aperture 938, 940 of the sling bar 900, respectively (e.g., requires the user to focus on which sling loop(s) are to be removed). Each sling loop associated with the subject sling may be selectively detached from the sling bar 800, 900 as described herein to remove the subject sling from the sling bar 800, 900.

It should now be understood that the sling bars described herein encompass various sling attachment portions arranged to ensure the retention of one or more than one sling loop associated with a subject sling. In particular, the various sling bars may include a first/second sling attachment portion that defines a first/second receiving aperture and a first/second retention latch restrained to pivot between an open position, where the first/second retention latch is positionable within a first/second latch slot, and a closed position, where a first/second engagement face is forced, via a first/second spring, to interface with a first/second stop surface of the first/second sling attachment portion. Furthermore, the various sling bars may include a first/second sling attachment portion that comprises a wireform (e.g., a first, second, or third wireform) that extends in vertical alignment with a first/second bar portion to define a first/second receiving aperture, where the first receiving aperture is defined by a proximal curl portion and a distal curl portion to receive one or more than one sling loop. In some aspects, various sling bars may include low profile sling attachment portions that include protrusions from the bar portions of the sling bars, the protrusions defining undercut portions that maintain sling loops when the sling bar is in an extreme angle positioning. In some aspects, various sling bars may include latch free sling attachment portions that are shaped such that latches are not needed and also include protrusions from the bar portions of the sling bars, the protrusions defining undercut portions that maintain sling loops when the sling bar is in an extreme angle positioning. Methods of operating the various sling bars as well as lift systems that utilize the various sling bars should be similarly understood.

While particular aspects have been illustrated and described herein, it should be understood that various other changes and modifications may be made without departing from the spirit and scope of the claimed subject matter. Moreover, although various aspects of the claimed subject matter have been described herein, such aspects need not be utilized in combination. It is therefore intended that the appended claims cover all such changes and modifications that are within the scope of the claimed subject matter.

What is claimed is:

1. A sling bar, comprising:

a first bar portion that extends in a first longitudinal direction, the first bar portion defining a first latch slot and a first spring aperture;

a first sling attachment portion positioned at a first end of the first bar portion, the first sling attachment portion extending from a lower part of the first bar portion to define a first receiving aperture, and the first sling attachment portion defining a first stop surface having a first lock aperture defined within the first stop surface;

a first retention latch pivotally coupled to an upper part of the first bar portion and defining a first engagement face, the first engagement face restraining the first retention latch to pivot between an open position, where the first retention latch is positionable against the first bar portion within the first latch slot, and a closed position, where the first engagement face interfaces with the first stop surface of the first sling attachment portion, the first retention latch comprising a first lock protrusion protruding from the first engagement face, the first retention latch comprising an outer curved surface matching a shape of the first bar portion at a first end of the outer curved surface and a shape of the first retention latch at a second end of the outer curved surface, the outer curved surface curving concavely between the first end and the second end toward the first receiving aperture to provide a consistent transition from an upper surface of the first sling attachment portion to the outer curved surface of the first retention latch; and a first spring positioned within the first spring aperture to force the first retention latch toward the closed position, wherein the first lock aperture is shaped to receive the first lock protrusion to maintain the first retention latch in the closed position.

2. The sling bar of claim 1, wherein the first spring is configured to produce a first closing force between the first engagement face and the first stop surface.

3. The sling bar of claim 2, wherein the first retention latch includes a first actuation surface, and wherein the first closing force is overcomable when a first insertion force is applied to a sling loop in contact with the first actuation surface.

4. The sling bar of claim 1, wherein at least one of the first bar portion and the first sling attachment portion is cast aluminum.

5. The sling bar of claim 1, wherein the first retention latch is defined by a material such that the first engagement face interfaces with the first stop surface without a lateral deflection or a vertical deformation in the first retention latch.

6. The sling bar of claim 5, wherein the material of the first retention latch is cast aluminum or steel.

7. The sling bar of claim 1, further comprising:

a hub portion, wherein the first bar portion extends from the hub portion;

a shaft positioned within the hub portion, wherein the sling bar is rotatable about an axis defined through the shaft; and a lift hook pivotally coupled to a connector portion of the shaft, wherein the sling bar is pivotable about an axis defined through the connector portion, and wherein the axis defined through the connector portion is transverse to the axis defined through the shaft.

8. The sling bar of claim 1, wherein the first sling attachment portion extends in the first longitudinal direction a first predetermined distance, extends in a first vertical direction a second predetermined distance, and extends in a second longitudinal direction back toward the first bar portion a third predetermined distance to define the first receiving aperture, and wherein the first, second, and third predetermined distance are based on a plurality of sling loops to be retained within the first receiving aperture.

9. The sling bar of claim 1, further comprising:

at least one bar insert coupled within at least one cavity defined in the first bar portion, wherein the at least one bar insert comprises a material to which a device associated with a subject lift is removably couplable.

10. The sling bar of claim 9, wherein the material comprises a ferrous material, wherein the device comprises a lift control device including a magnet, and wherein the magnet removably couples the lift control device to the at least one bar insert of the sling bar.

11. The sling bar of claim 1, further comprising:

a second bar portion that extends in a second longitudinal direction, the second bar portion defining a second latch slot and a second spring aperture;

a second sling attachment portion positioned at a second end of the second bar portion, the second sling attachment portion extending from a lower part of the second bar portion to define a second receiving aperture, and the second sling attachment portion defining a second stop surface;

a second retention latch pivotally coupled to an upper part of the second bar portion and defining a second engagement face, the second engagement face restraining the second retention latch to pivot between an open position, where the second retention latch is positionable against the second bar portion within the second latch slot, and a closed position, where the second engagement face interfaces with the second stop surface of the second sling attachment portion, the second retention latch comprising an outer curved surface matching a shape of the second bar portion at a first end of the outer curved surface and a shape of the second retention latch at a second end of the outer curved surface, the outer curved surface curving concavely between the first end and the second end toward the second receiving aperture to provide a consistent transition from an upper surface of the second sling attachment portion to the outer curved surface of the second retention latch; and a second spring positioned within the second spring aperture to force the second retention latch toward the closed position.

12. A method of attaching a subject sling to a sling bar, the method comprising:

applying a first insertion force, via one or more than one sling loop, to a first retention latch on a sling bar, wherein the first insertion force is a predetermined force that overcomes a first closing force, generated by a first spring positioned within a first spring aperture defined in a first bar portion of the sling bar, to pivot the first retention latch toward an open position where the first retention latch is positionable within a first latch slot defined in the first bar portion of the sling bar, and where a first engagement face of the first retention latch is separated from a first stop surface defined on a first sling attachment portion positioned at a first end of the first bar portion;

inserting the one or more than one sling loop associated with a subject sling over the first sling attachment portion into a first receiving aperture defined by the first sling attachment portion; and returning the first retention latch to a closed position in which a first lock protrusion protruding from the first engagement face is received within a first lock aperture defined within the first stop surface, the first lock aperture shaped to receive the first lock protrusion to maintain the first retention latch in the closed position, the first retention latch comprising an outer curved surface matching a shape of the first bar portion at a first end of the outer curved surface and a shape of the first retention latch at a second end of the outer curved surface, the outer curved surface curving concavely between the first end and the second end toward the first receiving aperture to provide a consistent transition from an upper surface of the first sling attachment portion to the outer curved surface of the first retention latch.

13. The method of claim 12, wherein the predetermined force is greater than a hanging weight associated with at least one of:

the one or more than one sling loop; or the subject sling.

14. The method of claim 12, further comprising manually returning the first retention latch to the closed position.

15. The method of claim 12, further comprising:

applying a second insertion force, via one or more than one second sling loop, to a second retention latch on the sling bar, wherein the second insertion force is a predetermined force that overcomes a second closing force, generated by a second spring positioned within a second spring aperture defined in a second bar portion of the sling bar, to pivot the second retention latch toward an open position where the second retention latch is positionable within a second latch slot defined in the second bar portion of the sling bar, and where a second engagement face of the second retention latch is separated from a second stop surface defined on a second sling attachment portion positioned at a second end of the second bar portion; and inserting the one or more than one second sling loop over the second sling attachment portion into a second receiving aperture defined by the second sling attachment portion.

16. The method of claim 15, further comprising manually returning the second retention latch to a closed position.

17. A lift system, comprising:

a subject lift including a lift mechanism coupled to a lift strap, wherein a sling bar attachment mechanism is coupled to the lift strap; and a sling bar coupled to the sling bar attachment mechanism, the sling bar comprising:

a first bar portion that extends in a first longitudinal direction, the first bar portion defining a first latch slot and a first spring aperture;

a first sling attachment portion positioned at a first end of the first bar portion, the first sling attachment portion extending from a lower part of the first bar portion to define a first receiving aperture, and the first sling attachment portion defining a first stop surface having a first lock aperture defined within the first stop surface;

a first retention latch pivotally coupled to an upper part of the first bar portion and defining a first engagement face, the first engagement face restraining the first retention latch to pivot between an open position, where the first retention latch is positionable against the first bar portion within the first latch slot, and a closed position, where the first engagement face interfaces with the first stop surface of the first sling attachment portion, the first retention latch comprising a first lock protrusion protruding from the first engagement face, the first retention latch comprising an outer curved surface matching a shape of the first bar portion at a first end of the outer curved surface and a shape of the first retention latch at a second end of the outer curved surface, the outer curved surface curving concavely between the first end and the second end toward the first receiving aperture to provide a consistent transition from an upper surface of the first sling attachment portion to the outer curved surface of the first retention latch; and a first spring positioned within the first spring aperture to force the first retention latch toward the closed position, wherein the first lock aperture shaped to receive the first lock protrusion to maintain the first retention latch in the closed position.

18. The lift system of claim 17, wherein the sling bar further comprises:

a hub portion, wherein the first bar portion extends from the hub portion;

a shaft positioned within the hub portion; and a lift hook pivotally coupled to the shaft, wherein the lift hook couples the sling bar to the sling bar attachment mechanism of the subject lift.

19. The lift system of claim 17, wherein the sling bar further comprises:

at least one bar insert coupled within at least one cavity defined in the first bar portion, wherein the at least one bar insert comprises a ferrous material; and a lift control device communicatively coupled to the lift mechanism, wherein the lift control device comprises a magnet, wherein the magnet removably couples the lift control device to the at least one bar insert of the sling bar.

* * * * *